US009953563B2

(12) United States Patent
Kishi et al.

(10) Patent No.: US 9,953,563 B2
(45) Date of Patent: Apr. 24, 2018

(54) DISPLAY DEVICE AND DRIVE CURRENT DETECTION METHOD FOR SAME

(71) Applicant: Sharp Kabushiki Kaisha, Osaka-shi, Osaka (JP)

(72) Inventors: Noritaka Kishi, Osaka (JP); Hiromitsu Katsui, Osaka (JP); Noboru Noguchi, Osaka (JP); Masanori Ohara, Osaka (JP); Shigetsugu Yamanaka, Osaka (JP); Yoshifumi Ohta, Osaka (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 141 days.

(21) Appl. No.: 14/784,391

(22) PCT Filed: Mar. 4, 2014

(86) PCT No.: PCT/JP2014/055492
§ 371 (c)(1),
(2) Date: Oct. 14, 2015

(87) PCT Pub. No.: WO2014/174905
PCT Pub. Date: Oct. 30, 2014

(65) Prior Publication Data

US 2016/0055791 A1 Feb. 25, 2016

(30) Foreign Application Priority Data

Apr. 23, 2013 (JP) ..... 2013-090146

(51) Int. Cl.
*G09G 3/30* (2006.01)
*G09G 3/3241* (2016.01)
*G09G 3/3266* (2016.01)

(52) U.S. Cl.
CPC ..... *G09G 3/30* (2013.01); *G09G 3/3241* (2013.01); *G09G 3/3266* (2013.01);
(Continued)

(58) Field of Classification Search
CPC ..... G09G 3/3241; G09G 3/3266; G09G 3/30; G09G 2310/0251; G09G 2320/0285;
(Continued)

(56) References Cited

U.S. PATENT DOCUMENTS 6,870,322 B1 * 3/2005 Mizukoshi ..... G09G 3/3216 315/169.1
7,619,597 B2 11/2009 Nathan et al.
(Continued)

FOREIGN PATENT DOCUMENTS

JP 2004252110 A 9/2004
JP 2005031630 A 2/2005
(Continued)

OTHER PUBLICATIONS

International Search Report PCT/ISA/210 for International Application No. PCT/JP2007/069184 dated Dec. 20, 2007.
(Continued)

*Primary Examiner* — Vinh T Lam
(74) *Attorney, Agent, or Firm* — ScienBiziP, P.C.

(57) ABSTRACT

A data line drive circuit provides a voltage according to a detection voltage and to a reference voltage, between the gate and source of a drive transistor in a pixel circuit, and detects a drive current having passed through the drive transistor and outputted external to the pixel circuit. A threshold voltage correction memory stores, for each pixel circuit, data representing a threshold voltage of the drive transistor. A display control circuit controls the reference voltage based on the data stored in the threshold voltage correction memory. By this, even if the threshold voltage of the drive transistor is changed, the drive current can be detected with a high accuracy. The threshold voltage correction memory may store, for each pixel circuit, data
(Continued)

representing a difference between the threshold voltage of the drive transistor and the reference voltage.

17 Claims, 31 Drawing Sheets

(52) U.S. Cl.
CPC ..... *G09G 2300/0426* (2013.01); *G09G 2310/0202* (2013.01); *G09G 2310/0251* (2013.01); *G09G 2310/0275* (2013.01); *G09G 2320/0285* (2013.01); *G09G 2320/045* (2013.01); *G09G 2330/021* (2013.01); *G09G 2330/027* (2013.01); *G09G 2330/028* (2013.01); *G09G 2330/12* (2013.01)

(58) Field of Classification Search
CPC ..... G09G 2320/045; G09G 2330/12; G09G 2330/028; G09G 2300/0426; G09G 2310/0202; G09G 2310/0275; G09G 2330/021; G09G 2330/027
USPC ..... 345/76–82; 313/498; 315/167–169.3, 315/300
See application file for complete search history.

(56) References Cited

U.S. PATENT DOCUMENTS 8,022,908 B2* 9/2011 Mizukoshi ..... G09G 3/20 345/690
8,564,587 B2* 10/2013 Lee ..... G09G 3/32 345/204
8,847,939 B2* 9/2014 Kishi ..... G09G 3/3233 345/211
2004/0239596 A1 12/2004 Ono et al.
2005/0017934 A1 1/2005 Chung et al.
2006/0176250 A1* 8/2006 Nathan ..... G09G 3/3233 345/76
2006/0262051 A1* 11/2006 Kim ..... G09G 3/325 345/76
2007/0052646 A1 3/2007 Ishiguchi
2007/0057874 A1 3/2007 Le Roy et al.
2007/0200804 A1 8/2007 Kwon
2007/0210996 A1* 9/2007 Mizukoshi ..... G09G 3/3233 345/77
2007/0268210 A1 11/2007 Uchino et al.
2008/0100545 A1* 5/2008 Hong ..... G09G 3/325 345/82
2008/0150843 A1* 6/2008 Yamamoto ..... G09G 3/3233 345/76
2008/0174574 A1* 7/2008 Yoo ..... G09G 3/3233 345/204
2008/0284691 A1* 11/2008 Chung ..... G09G 3/3291 345/76
2009/0213046 A1* 8/2009 Nam ..... G09G 3/3233 345/76
2009/0256854 A1 10/2009 Mizukoshi et al.
2010/0045646 A1 2/2010 Kishi
2010/0245343 A1 9/2010 Takei et al.
2010/0253659 A1 10/2010 Sugimoto et al.
2010/0328297 A1* 12/2010 Shimoda ..... G09G 3/3233 345/212
2011/0096059 A1* 4/2011 Ohhashi ..... G09G 3/3233 345/212
2011/0122119 A1* 5/2011 Bae ..... G09G 3/3233 345/211
2011/0285691 A1* 11/2011 Takasugi ..... G09G 3/3233 345/212
2012/0138922 A1 6/2012 Yamazaki et al.
2012/0154352 A1* 6/2012 Yamashita ..... G09G 3/3233 345/207
2012/0176422 A1* 7/2012 Ono ..... G09G 3/325 345/690
2013/0050292 A1* 2/2013 Mizukoshi ..... G09G 3/3291 345/690
2013/0057532 A1* 3/2013 Lee ..... G09G 3/3225 345/211
2013/0113779 A1* 5/2013 Yoon ..... G09G 3/3233 345/212
2013/0120228 A1* 5/2013 Yoon ..... G09G 3/3291 345/80
2013/0127692 A1* 5/2013 Yoon ..... G09G 3/3258 345/80
2013/0162617 A1* 6/2013 Yoon ..... G09G 3/3291 345/211
2013/0201173 A1* 8/2013 Chaji ..... G09G 3/3233 345/212
2013/0335456 A1* 12/2013 Matsui ..... G09G 3/30 345/690
2014/0022289 A1* 1/2014 Lee ..... G09G 3/3283 345/691
2014/0035799 A1* 2/2014 Bae ..... G09G 3/3266 345/82
2014/0062331 A1* 3/2014 Nam ..... G09G 3/3233 315/226
2014/0078028 A1* 3/2014 Qing ..... G09G 3/3233 345/77
2015/0317951 A1* 11/2015 Genoe ..... G09G 3/3283 345/212
2015/0379940 A1* 12/2015 Kishi ..... G09G 3/3225 345/690

FOREIGN PATENT DOCUMENTS

JP 2005128521 A 5/2005
JP 2005284172 A 10/2005
JP 2005352411 A 12/2005
JP 2006195310 A 7/2006
JP 2007072162 A 3/2007
JP 2007233326 A 9/2007
JP 2007310311 A 11/2007
JP 2009199057 A 9/2009
JP 2009258302 A 11/2009
JP 2010237581 A 10/2010
JP 2010243645 A 10/2010
JP 2010256783 A 11/2010
JP 2011028214 A 2/2011
JP 2011242767 A 12/2011
JP 2012128149 A 7/2012
JP 2012134475 A 7/2012
WO WO-2005013250 A1 2/2005
WO WO-2008108024 A1 9/2008

OTHER PUBLICATIONS

Written Opinion of the International Searching Authority PCT/ISA/237 for International Application No. PCT/JP2007/069184 dated Dec. 20, 2007.
Yeon Gon Mo et al., "69.3: Amorphous Oxide TFT Backplane for Large Size AMOLED TVs", SID 10 Digest, 2010, pp. 1037-1040.
Written Opinion of the International Searching Authority PCT/ISA/237 for International Application No. PCT/JP2014/055492 dated May 9, 2014.

* cited by examiner

DISPLAY DEVICE AND DRIVE CURRENT DETECTION METHOD FOR SAME

TECHNICAL FIELD

The present invention relates to a display device, and more particularly to a display device having pixel circuits each including an electro-optical element such as an organic EL (Electro Luminescence) element, and a drive current detection method for the display device.

BACKGROUND ART

For a slim, high image quality, and low power consumption display device, an organic EL display device is known. An active matrix-type organic EL display device has a plurality of two-dimensionally arranged pixel circuits each including an organic EL element and a drive transistor. The organic EL element is a self-light emitting type electro-optical element that changes in luminance according to a drive current. The drive transistor is provided in series with the organic EL element, and controls the amount of drive current flowing through the organic EL element, according to a gate-source voltage thereof.

In general, a thin film transistor (hereinafter, abbreviated as TFT) is used as the drive transistor in the pixel circuit. Specifically, an amorphous silicon TFT, a low-temperature polysilicon TFT, an oxide TFT (also called oxide semiconductor TFT), or the like, is used as the drive transistor. The oxide TFT is a TFT in which a semiconductor layer is formed of an oxide semiconductor. For example, indium gallium zinc oxide (In—Ga—Zn—O) is used for the oxide TFT.

In general, the gain of the transistor is determined by mobility, channel width, channel length, gate insulating film capacitance, etc., and the amount of current flowing through the transistor changes according to gate-source voltage, gain, threshold voltage, etc. When a TFT is used as the drive transistor, variations occur in threshold voltage, mobility, channel width, channel length, gate insulating film capacitance, etc. If variations occur in the characteristics of the drive transistor, then variations occur in the amount of drive current flowing through the organic EL element. Due to this, variations also occur in the luminance of pixels, degrading display quality.

In view of this, conventionally, there is devised an organic EL display device that compensates for variations in the characteristics of a drive transistor. Patent Documents 1 to 4 and Non-Patent Document 1 describe organic EL display devices that perform only threshold voltage compensation. Patent Documents 5 to 9 describe organic EL display devices that perform both threshold voltage compensation and gain compensation (mobility compensation).

Patent Document 8 describes an organic EL display device including a pixel circuit shown in FIG. 33. The pixel circuit shown in FIG. 33 includes an organic EL element L0, a drive transistor DR, two control transistors SW1 and SW2, and a capacitor Cst. When a scanning signal GL is at a high level, the control transistor SW1 is turned on and a fixed reference voltage Vref is provided to one end of the capacitor Cst. Patent Document 9 describes an organic EL display device that performs both threshold voltage compensation and gain compensation on a per pixel circuit basis, using correction data obtained for each pixel circuit which is stored in a memory.

PRIOR ART DOCUMENTS

Patent Documents

[Patent Document 1] Japanese Laid-Open Patent Publication No. 2005-31630

[Patent Document 2] International Publication No. WO 2008/108024

[Patent Document 3] Japanese Laid-Open Patent Publication No. 2011-242767

[Patent Document 4] Official Gazette for U.S. Pat. No. 7,619,597

[Patent Document 5] Japanese Laid-Open Patent Publication No. 2005-284172

[Patent Document 6] Japanese Laid-Open Patent Publication No. 2007-233326

[Patent Document 7] Japanese Laid-Open Patent Publication No. 2007-310311

[Patent Document 8] Japanese Laid-Open Patent Publication No. 2009-199057

[Patent Document 9] Japanese Laid-Open Patent Publication No. 2009-258302

Non-Patent Document

[Non-Patent Document 1] Yeon Gon Mo et al., "Amorphous Oxide TFT Backplane for Large Size AMOLED TVs" Symposium Digest for 2010 Society for Information Display Symposium, pp. 1037-1040, 2010

SUMMARY OF THE INVENTION

Problems to be Solved by the Invention

In the organic EL display device, the threshold voltage of the drive transistor changes due to deterioration over time. For example, a case is considered in which, to perform threshold voltage compensation and gain compensation in the pixel circuit shown in FIG. 33, a drive current (a current flowing through the drive transistor DR) obtained when a detection voltage is provided to the pixel circuit is detected external to the pixel circuit. If the threshold voltage of the drive transistor DR changes in this case, then the amount of drive current significantly changes, decreasing the accuracy of current detection. In addition, there may be a case in which the drive current exceeds a detection range. In addition, if the threshold voltage of the drive transistor DR changes, then the end-to-end voltage of the organic EL element L0 changes. Accordingly, an unwanted current flows through the organic EL element L0, decreasing the accuracy of current detection.

In addition, in an organic EL display device that stores, in a memory, data representing the threshold voltages of drive transistors, the number of bits of data needs to be determined taking into account the amount of variations and amount of change in threshold voltage. Thus, the number of bits of data increases, causing another problem of an increase in required memory capacity. These problems are noticeable in an organic EL display device that uses, as a drive transistor, an oxide TFT which is likely to change in characteristics due to deterioration over time (e.g., a TFT in which a semiconductor layer includes indium gallium zinc oxide).

An object of the present invention is therefore to provide a display device capable of detecting a drive current with a high accuracy even when a threshold voltage of a drive transistor is changed.

Means for Solving the Problems

According to a first aspect of the present invention, there is provided an active matrix-type display device including: a display unit including a plurality of scanning lines, a plurality of data lines, and a plurality of pixel circuits provided at respective intersections of the scanning lines and the data lines; a scanning line drive circuit configured to drive the scanning lines; a data line drive circuit configured to drive the data lines; and a display control circuit, wherein each of the pixel circuits includes an electro-optical element and a drive transistor provided in series with the electro-optical element, upon current detection, the data line drive circuit is configured to provide a voltage between a control terminal and a first conduction terminal of the drive transistor, and detect a drive current having passed through the drive transistor and outputted external to the pixel circuit, the voltage being according to a detection voltage and a reference voltage, and the display control circuit is configured to control the reference voltage.

According to a second aspect of the present invention, in the first aspect of the present invention, the display device further includes a storage unit configured to store, for each of the pixel circuits, data according to a threshold voltage of the drive transistor, wherein the display control circuit is configured to control the reference voltage based on the data stored in the storage unit.

According to a third aspect of the present invention, in the second aspect of the present invention, the display control circuit is configured to determine a statistical value of the threshold voltages of the drive transistors based on the data stored in the storage unit, and control the reference voltage based on the determined statistical value.

According to a fourth aspect of the present invention, in the third aspect of the present invention, the storage unit is configured to store, for each of the pixel circuits, data representing a difference between the statistical value of the threshold voltages of the drive transistors and the reference voltage.

According to a fifth aspect of the present invention, in the second aspect of the present invention, the display control circuit is configured to update the data stored in the storage unit, based on results of the detection by the data line drive circuit.

According to a sixth aspect of the present invention, in the fifth aspect of the present invention, the display control circuit is configured to perform a correction process on video data, using the data stored in the storage unit, the correction process compensating for the threshold voltage and a gain of the drive transistor.

According to a seventh aspect of the present invention, in the fifth aspect of the present invention, the display control circuit is configured to perform a correction process on video data, using the data stored in the storage unit, the correction process compensating for the threshold voltage of the drive transistor.

According to an eighth aspect of the present invention, in the first aspect of the present invention, the display control circuit is configured to measure cumulative lighting time and control the reference voltage based on the measured cumulative lighting time.

According to a ninth aspect of the present invention, in the first aspect of the present invention, the display unit further includes a characteristic detection transistor, and the display control circuit is configured to control the reference voltage based on a characteristic of the characteristic detection transistor.

According to a tenth aspect of the present invention, in the first aspect of the present invention, the display unit further includes reference voltage lines configured to supply the reference voltage to the pixel circuits, and upon current detection, the data line drive circuit is configured to provide the detection voltage to each of the data lines and detect a drive current having flowed through the data line from the pixel circuit.

According to an eleventh aspect of the present invention, in the tenth aspect of the present invention, each of the pixel circuits further includes: a reference voltage application transistor provided between a corresponding reference voltage line and the control terminal of the drive transistor, and having a control terminal connected to a corresponding scanning line; an input/output transistor provided between a corresponding data line and the first conduction terminal of the drive transistor, and having a control terminal connected to the scanning line; and a capacitive element provided between the control terminal and first conduction terminal of the drive transistor.

According to a twelfth aspect of the present invention, in the first aspect of the present invention, the display unit further includes a plurality of monitoring lines, and upon current detection, the data line drive circuit is configured to provide a voltage to each of the data lines and detect a drive current having flowed through a corresponding monitoring line from the pixel circuit, the voltage being obtained by adding the reference voltage to the detection voltage.

According to a thirteenth aspect of the present invention, in the first aspect of the present invention, the display unit further includes a plurality of monitoring lines, and upon current detection, the data line drive circuit is configured to provide the detection voltage to each of the data lines and provide the reference voltage to each of the monitoring lines, and detect a drive current having flowed through the monitoring line from the pixel circuit.

According to a fourteenth aspect of the present invention, in the twelfth or thirteenth aspect of the present invention, each of the pixel circuits further includes: an input transistor provided between a corresponding data line and the control terminal of the drive transistor, and having a control terminal connected to a corresponding scanning line; an output transistor provided between a corresponding monitoring line and the first conduction terminal of the drive transistor, and having a control terminal connected to the scanning line; and a capacitive element provided between the control terminal and first conduction terminal of the drive transistor.

According to a fifteenth aspect of the present invention, in the first aspect of the present invention, the scanning lines are divided into one or more blocks, for each block, the scanning line drive circuit is configured to select all or some of scanning lines in the block collectively during a first period, and select all of the scanning lines in the block in turn during a second period, and for each block, the data line drive circuit is configured to convert drive currents outputted external to corresponding pixel circuits into voltages during the first period, and apply voltages to the data lines during the second period, the voltages being based on voltages according to video data and on the voltages obtained during the first period.

According to a sixteenth aspect of the present invention, in the first aspect of the present invention, the drive transistors are thin film transistors in which a semiconductor layer is formed of an oxide semiconductor.

According to a seventeenth aspect of the present invention, in the sixteenth aspect of the present invention, the oxide semiconductor is indium gallium zinc oxide.

According to an eighteenth aspect of the present invention, in the seventeenth aspect of the present invention, the indium gallium zinc oxide has crystallinity.

According to a nineteenth aspect of the present invention, there is provided a drive current detection method for an active matrix-type display device having a display unit including a plurality of scanning lines, a plurality of data lines, and a plurality of pixel circuits provided at respective intersections of the scanning lines and the data lines, when each of the pixel circuits includes an electro-optical element and a drive transistor provided in series with the electro-optical element, the method including the steps of: providing a voltage between a control terminal and a first conduction terminal of the drive transistor by driving a corresponding scanning line and a corresponding data line, the voltage being according to a detection voltage and a reference voltage; detecting a drive current having passed through the drive transistor and outputted external to the pixel circuit; and controlling the reference voltage.

Effects of the Invention

According to the first or nineteenth aspect of the present invention, by suitably controlling the reference voltage, even when the threshold voltage of the drive transistor is changed, a change in the amount of drive current flowing through the drive transistor is suppressed, enabling to detect the drive current with a high accuracy. In addition, upon current detection, a change in the end-to-end voltage of the electro-optical element is suppressed to prevent an unwanted current from flowing through the electro-optical element. By this, the drive current can be detected with a high accuracy.

According to the second aspect of the present invention, by suitably controlling the reference voltage by controlling the reference voltage based on data according to the threshold voltage of the drive transistor, which is stored for each pixel circuit, the drive current can be detected with a high accuracy.

According to the third aspect of the present invention, by suitably controlling the reference voltage by controlling the reference voltage based on a statistical value of the threshold voltages of the drive transistors, the drive current can be detected with a high accuracy.

According to the fourth aspect of the present invention, by storing data representing a difference between the statistical value of the threshold voltages of the drive transistors and the reference voltage, the number of bits of data to be stored is reduced, enabling to reduce the capacity of the storage unit.

According to the fifth aspect of the present invention, data according to the threshold voltages of the drive transistors can be obtained based on the results of drive current detection.

According to the sixth aspect of the present invention, by compensating for the threshold voltage and gain of the drive transistor on a per pixel circuit basis, the image quality of a display image can be improved.

According to the seventh aspect of the present invention, by compensating for the threshold voltage of the drive transistor on a per pixel circuit basis, the image quality of a display image can be improved.

According to the eighth aspect of the present invention, since the characteristics of the drive transistor change according to cumulative lighting time, by suitable controlling the reference voltage based on the cumulative lighting time, the drive current can be detected with a high accuracy.

According to the ninth aspect of the present invention, by suitably controlling the reference voltage based on the characteristic of the characteristic detection transistor, the drive current can be detected with a high accuracy.

According to the tenth aspect of the present invention, in the display device that supplies the reference voltage to the pixel circuits, by suitably controlling the reference voltage by providing the detection voltage to the data line, the drive current flowing through the data line can be detected with a high accuracy. In addition, by detecting the drive current using the data line, the number of wiring lines can be reduced.

According to the eleventh aspect of the present invention, by controlling the reference voltage in the pixel circuit that has the capacitive element between the control terminal and first conduction terminal of the drive transistor and that is used by applying a voltage on the data line and the reference voltage to both ends of the capacitive element, respectively, the drive current can be detected with a high accuracy.

According to the twelfth aspect of the present invention, in the display device having monitoring lines separately from the data lines, by suitably controlling the reference voltage by providing a voltage obtained by adding the reference voltage to the detection voltage, to the data line, the drive current flowing through the monitoring line can be detected with a high accuracy.

According to the thirteenth aspect of the present invention, in the display device having monitoring lines separately from the data lines, by suitably controlling the reference voltage by providing the detection voltage to the data line and providing the reference voltage to the monitoring line, the drive current flowing through the monitoring line can be detected with a high accuracy.

According to the fourteenth aspect of the present invention, by controlling the reference voltage in the pixel circuit that has the capacitive element between the control terminal and first conduction terminal of the drive transistor and that is used by applying a voltage on the data line to one end of the capacitive element (or by applying a voltage on the data line and the reference voltage to both ends of the capacitive element, respectively), the drive current can be detected with a high accuracy.

According to the fifteenth aspect of the present invention, by detecting currents outputted external to the pixel circuits, on a block-by-block basis, the time required for current detection can be reduced.

According to the sixteenth to eighteenth aspects of the present invention, by using an oxide TFT (e.g., a TFT in which a semiconductor layer includes indium gallium zinc oxide) as the drive transistor, the drive current is increased, enabling to reduce write time and increase the luminance of a screen.

MODES FOR CARRYING OUT THE INVENTION

Organic EL display devices according to embodiments of the present invention will be described below with reference to the drawings. In the following description, it is assumed that m and n are integers greater than or equal to 2, i is an integer between 1 and m, inclusive, and j is an integer between 1 and n, inclusive. In each embodiment, transistors included in a pixel circuit are field-effect transistors, typically, thin film transistors. As the transistors included in the pixel circuit, for example, oxide TFTs, low-temperature polysilicon TFTs, amorphous silicon TFTs, or the like, are used. The oxide TFTs are effective when used as n-channel transistors. Note that in the present invention, p-channel oxide TFTs may be used.

First Embodiment

Figure 1:
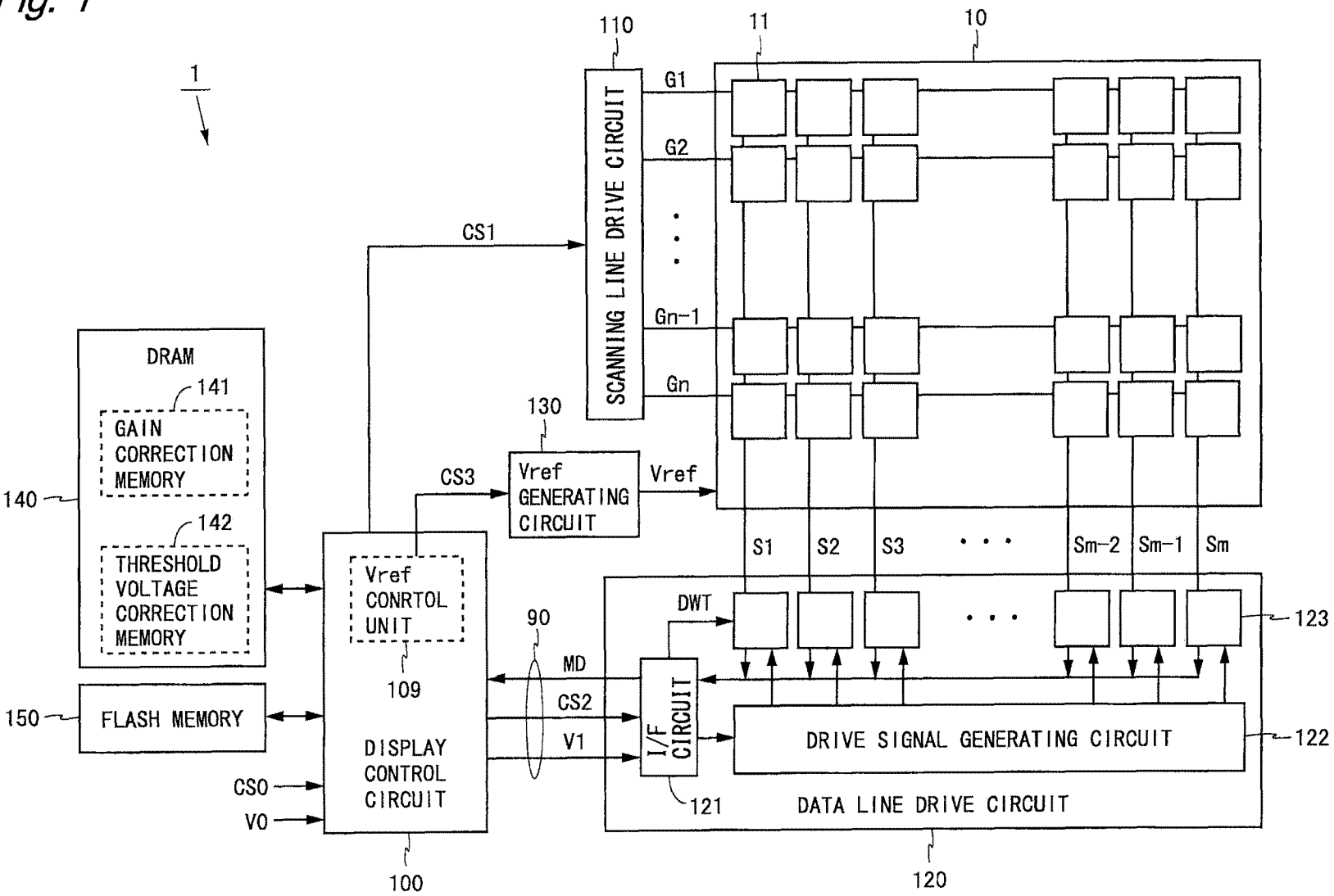
FIG. 1 is a block diagram showing a configuration of an organic EL display device according to a first embodiment of the present invention.

FIG. 1 is a block diagram showing a configuration of an organic EL display device according to a first embodiment of the present invention. An organic EL display device 1 shown in FIG. 1 includes a display unit 10, a display control circuit 100, a scanning line drive circuit 110, a data line drive circuit 120, a Vref generating circuit 130, a DRAM 140, and a flash memory 150. The organic EL display device 1 is an active matrix-type display device.

The display unit 10 includes n scanning lines G1 to Gn, m data lines S1 to Sm, and (m×n) pixel circuits 11. The data lines S1 to Sm are arranged parallel to each other. The scanning lines G1 to Gn are arranged parallel to each other and orthogonal to the data lines S1 to Sm. The scanning lines G1 to Gn intersect with the data lines S1 to Sm at (m×n) locations. The (m×n) pixel circuits 11 are provided at the respective intersections of the scanning lines G1 to Gn and the data lines S1 to Sm. A direction in which the scanning lines G1 to Gn extend is hereinafter referred to as row direction, a direction in which the data lines S1 to Sm extend is hereinafter referred to as column direction, and a pixel circuit 11 arranged in a j-th row and an i-th column is hereinafter referred to as pixel circuit PX(i, j).

To the display unit 10 are supplied a high-level power supply voltage ELVDD and a low-level power supply voltage ELVSS from a power supply circuit (not shown), and is supplied a reference voltage Vref from the Vref generating circuit 130. To supply these voltages to the pixel circuits 11, the display unit 10 is provided with high-level power supply lines, low-level power supply lines, and reference voltage lines (none of which is shown). The high-level power supply voltage ELVDD and the low-level power supply voltage ELVSS are fixed voltages. The reference voltage Vref is a variable voltage which is controlled by the display control circuit 100. To control the reference voltage Vref, the display control circuit 100 outputs a control signal CS3 to the Vref generating circuit 130. The Vref generating circuit 130 generates the reference voltage Vref according to the control signal CS3, and supplies the generated reference voltage Vref to the display unit 10.

The display control circuit 100 controls the scanning line drive circuit 110 and the data line drive circuit 120 based on a control signal CS0 and video data V0 which are supplied from the external of the organic EL display device 1. More specifically, the display control circuit 100 outputs a control signal CS1 to the scanning line drive circuit 110, and outputs a control signal CS2 and video data V1 to the data line drive circuit 120. In addition, the display control circuit 100 receives measurement data MD (details will be shown later) from the data line drive circuit 120. Data sending and receiving between the display control circuit 100 and the data line drive circuit 120 are performed using a communication bus 90.

The scanning line drive circuit 110 drives the scanning lines G1 to Gn, and the data line drive circuit 120 drives the data lines S1 to Sm. More specifically, the scanning line drive circuit 110 selects the scanning lines G1 to Gn in turn according to the control signal CS1, and applies a selection voltage (high-level voltage) to the selected scanning line and applies a non-selection voltage (low-level voltage) to other scanning lines. The data line drive circuit 120 includes an interface circuit 121, a drive signal generating circuit 122, and m voltage output/current measurement circuits 123. The data line drive circuit 120 applies data voltages according to the video data V1 to the data lines S1 to Sm, according to the control signal CS2.

The video data V1 is obtained by performing a correction process on the video data V0. The DRAM 140 stores, for each pixel circuit 11, two types of correction data (gain correction data and threshold voltage correction data) which are used to correct the video data V0. The display control circuit 100 obtains the video data V1 by correcting the video data V0 using the correction data stored in the DRAM 140. In addition, the display control circuit 100 updates the correction data stored in the DRAM 140, based on the measurement data MD received from the data line drive circuit 120. The display control circuit 100 reads the correction data stored in the DRAM 140 and writes the correction data to the flash memory 150 at power off. The display control circuit 100 reads the correction data stored in the flash memory 150 and writes the correction data to the DRAM 140 at power on. Note that the DRAM 140 and the flash memory 150 may be included in the display control circuit 100.

Figure 2:
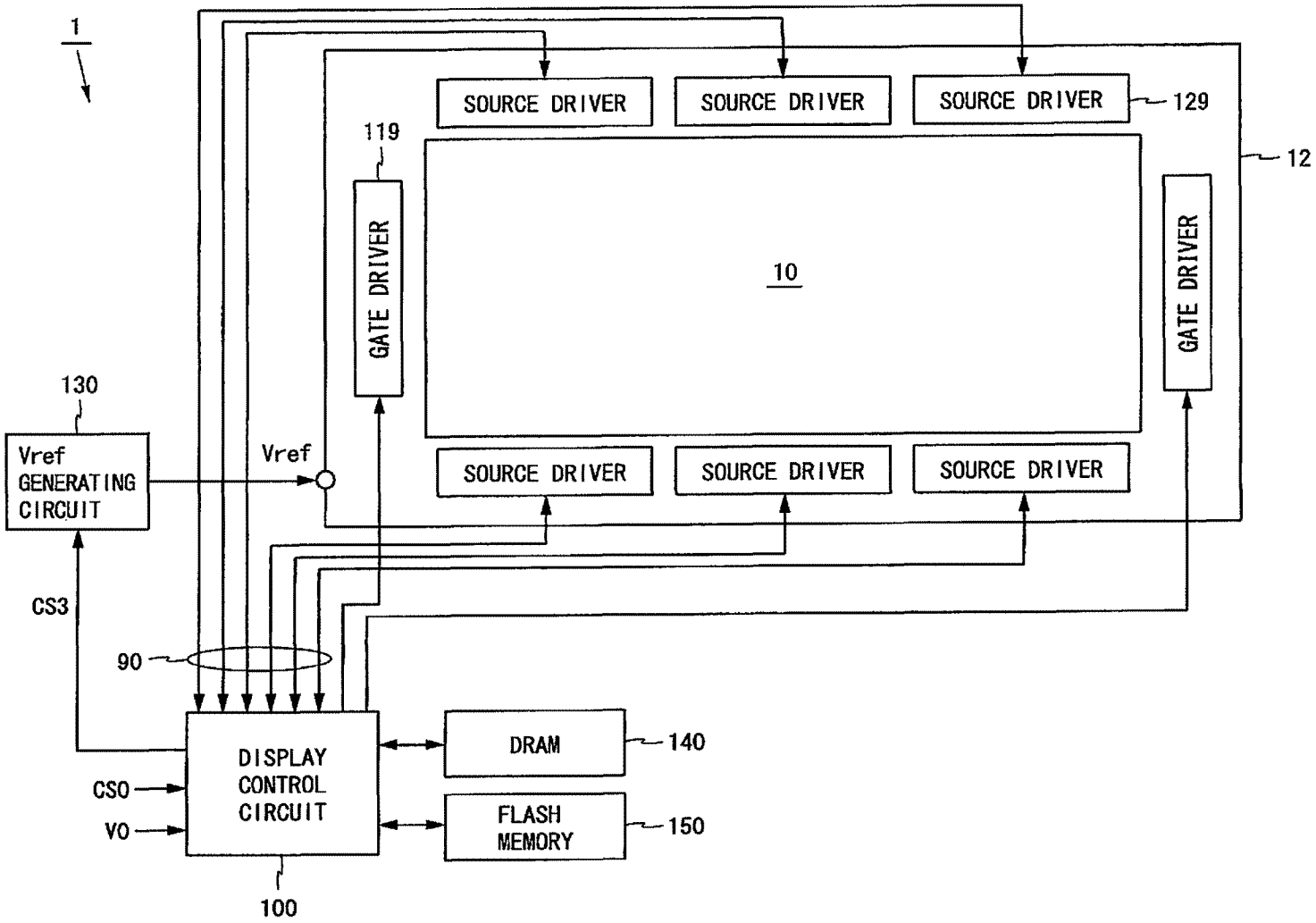
FIG. 2 is a diagram showing an example of an implementation style of the organic EL display device shown in FIG. 1.

FIG. 2 is a diagram showing an example of an implementation style of the organic EL display device 1. As shown in FIG. 2, the display unit 10 is formed on a display panel 12, and gate drivers 119 and source drivers 129 are arranged on the display panel 12. The gate drivers 119 function as the scanning line drive circuit 110, and the source drivers 129 function as the data line drive circuit 120. In the example shown in FIG. 2, two gate drivers 119 and six source drivers 129 are disposed on the display panel 12. One gate driver 119 is arranged along the left side of the display panel 12, and the other gate driver 119 is arranged along the right side of the display panel 12. Three source drivers 129 are arranged along the upper side of the display panel 12, and other three source drivers 129 are arranged along the lower side of the display panel 12. Note that the number of gate drivers 119 included in the scanning line drive circuit 110, the number of source drivers 129 included in the data line drive circuit 120, the arrangement positions of the gate drivers 119, and the arrangement positions of the source drivers 129 may be arbitrary. Note also that all or part of the scanning line drive circuit 110 and the data line drive circuit 120 may be integrally formed with the display panel 12.

Figure 3:
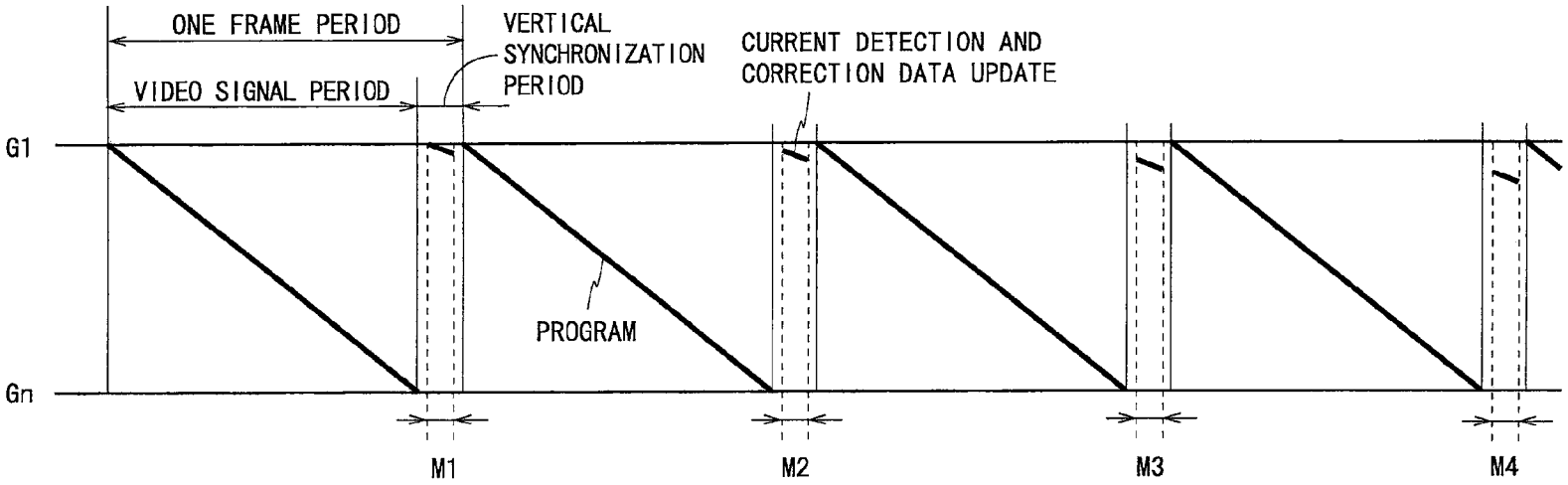
FIG. 3 is a timing chart showing the operation of the organic EL display device shown in FIG. 1.

FIG. 3 is a timing chart showing the operation of the organic EL display device 1. In the organic EL display device 1, one frame period is divided into a video signal period and a vertical synchronization period. During the video signal period, the scanning lines G1 to Gn are selected one by one in turn for every horizontal period (1H period), and during each horizontal period, m data voltages according to video data V1 are written to m pixel circuits 11, respectively (described as "program" in FIG. 3). During the vertical synchronization period, k scanning lines (k is an integer greater than or equal to 1 and less than n) are selected in turn from among the scanning lines G1 to Gn, and currents having passed through drive transistors (hereinafter, referred to as drive currents) are outputted to the data lines S1 to Sm, respectively, from m pixel circuits 11 connected to the selected scanning lines. The data line drive circuit 120 has the function of detecting the m drive currents outputted to the data lines S1 to Sm. The display control circuit 100 updates the correction data stored in the DRAM 140, based on the results of the detection by the data line drive circuit 120 (described as "current detection and correction data update" in FIG. 3).

The k scanning lines selected during the vertical synchronization period are switched every frame period. For example, when scanning lines G1 to Gk are selected during a vertical synchronization period (M1 shown in FIG. 3) of an N-th frame period, scanning lines Gk+1 to G2*k* are selected during a vertical synchronization period (M2 shown in FIG. 3) of an (N+1)th frame period, and scanning lines G2*k*+1 to G3*k* are selected during a vertical synchronization period (M3 shown in FIG. 3) of an (N+2)th frame period. During each frame period, drive currents that are outputted external to (m×k) pixel circuits 11 connected to the k selected scanning lines are detected.

Figure 4:
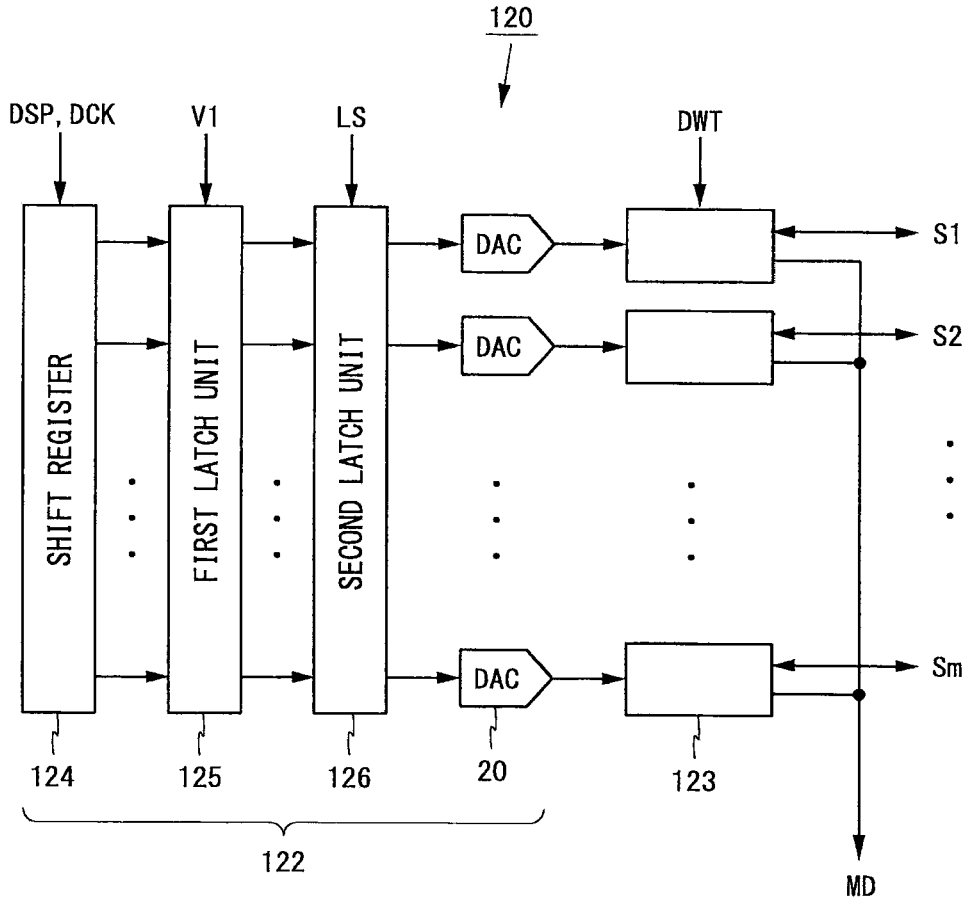
FIG. 4 is a block diagram showing details of a data line drive circuit shown in FIG. 1.

FIG. 4 is a block diagram showing details of the data line drive circuit 120. As described above, the data line drive circuit 120 includes the interface circuit 121 (not shown), the drive signal generating circuit 122, and the m voltage output/current measurement circuits 123. The interface circuit 121 sends and receives data to/from the display control circuit 100. The drive signal generating circuit 122 includes a shift register 124, a first latch unit 125, a second latch unit 126, and m D/A converters 20. The shift register 124 is an m-stage shift register, and each of the first and second latch units 125 and 126 includes m latch circuits (not shown).

The control signal CS2 supplied to the data line drive circuit 120 from the display control circuit 100 includes a data start pulse DSP, a data clock DCK, a latch strobe signal LS, and an input/output control signal DWT. The shift register 124 shifts the data start pulse DSP in turn in synchronization with the data clock DCK. Outputs from the respective stages of the shift register 124 become a high level once in every horizontal period in turn. The first latch unit 125 stores video data V1 for one row (m pieces of video data) in turn in synchronization with output signals from the shift register 124. The second latch unit 126 holds the m pieces of video data stored in the first latch unit 125, in synchronization with the latch strobe signal LS. Each D/A converter 20 is provided for any one of the m latch circuits included in the second latch unit 126. Each D/A converter 20 outputs, as a data voltage, a voltage according to video data held in a corresponding latch circuit.

Each voltage output/current measurement circuit 123 is connected to any one of the data lines S1 to Sm. The voltage output/current measurement circuit 123 functions as either a voltage output circuit or a current measurement circuit, according to the input/output control signal DWT. More specifically, when the input/output control signal DWT is at a high level, the voltage output/current measurement circuit 123 applies a data voltage outputted from a corresponding D/A converter 20, to a corresponding data line Si (functions as a voltage output circuit). When the input/output control signal DWT is at a low level, the voltage output/current measurement circuit 123 measures a drive current having flowed through the data line Si from a pixel circuit PX(i, j), and outputs measurement data MD representing the result of the measurement (functions as a current measurement circuit).

Figure 5:
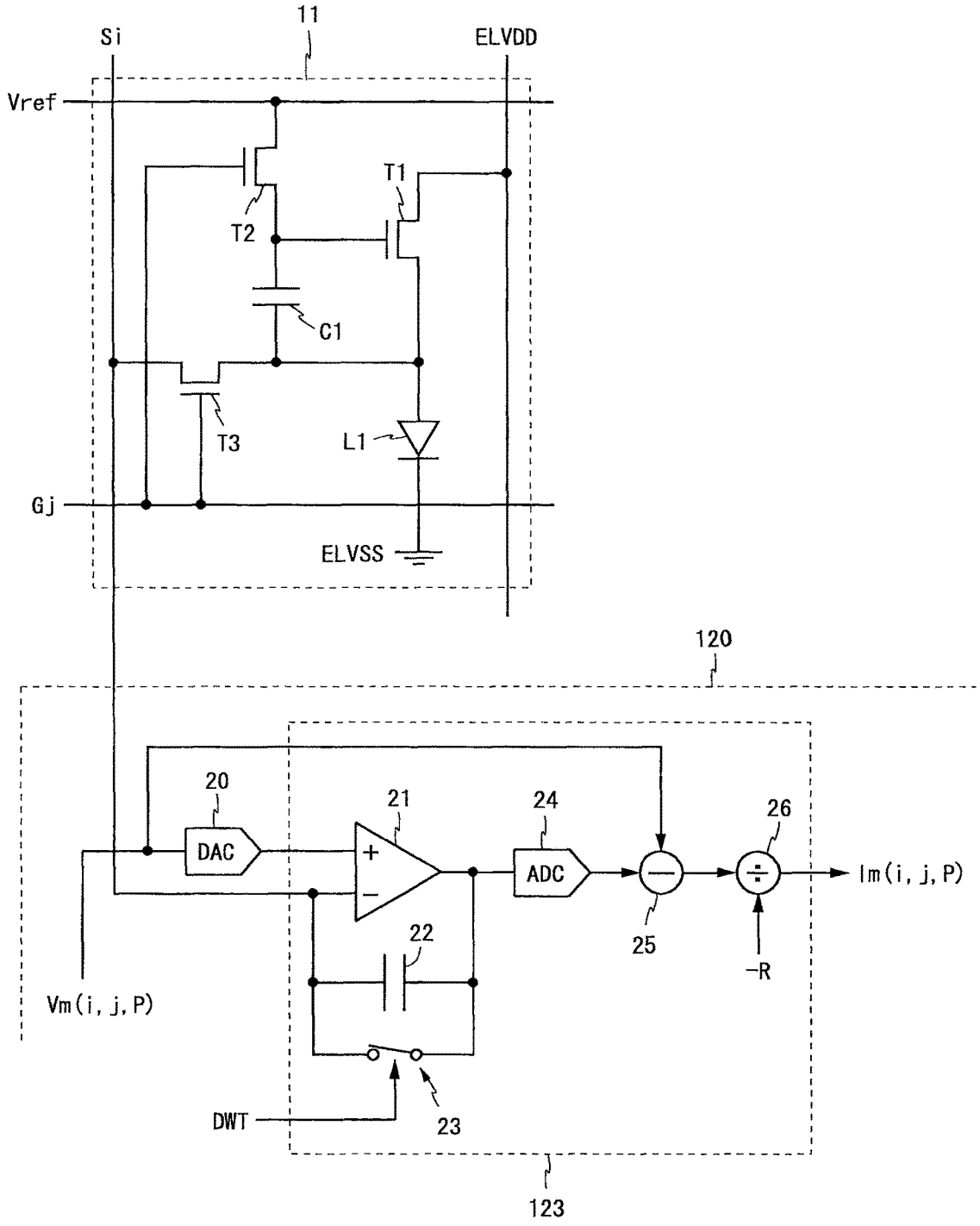
FIG. 5 is a circuit diagram of a pixel circuit and a voltage output/current measurement circuit which are included in the organic EL display device shown in FIG. 1.

FIG. 5 is a circuit diagram of the pixel circuit 11 and the voltage output/current measurement circuit 123. FIG. 5 depicts a pixel circuit PX(i, j), a D/A converter 20 provided for a data line Si, and a voltage output/current measurement circuit 123 provided for the data line Si.

The pixel circuit 11 includes an organic EL element L1, three transistors T1 to T3, and a capacitor C1. The transistors T1 to T3 are all of an n-channel type. The transistors T1 to T3 are, for example, oxide TFTs in which a semiconductor layer includes an oxide semiconductor of indium gallium zinc oxide or the like. The transistors T1 to T3 function as a drive transistor, a reference voltage application transistor, and an input/output transistor, respectively, and the capacitor C1 functions as a capacitive element.

The transistor T1 is connected in series with the organic EL element L1 and provided between a high-level power supply line that supplies the high-level power supply voltage ELVDD and a low-level power supply line that supplies the low-level power supply voltage ELVSS. A drain terminal of the transistor T1 is connected to the high-level power supply line, and a source terminal of the transistor T1 is connected to an anode terminal of the organic EL element L1. A cathode terminal of the organic EL element L1 is connected to the low-level power supply line. The transistor T2 is provided between a reference voltage line that supplies the reference voltage Vref and a gate terminal of the transistor T1. The transistor T3 is provided between the data line Si and the source terminal of the transistor T1. Gate terminals of the transistors T2 and T3 are connected to a scanning line Gj. The capacitor C1 is provided between the gate terminal and source terminal of the transistor T1.

The voltage output/current measurement circuit 123 includes an operational amplifier 21, a capacitor 22, a switch 23, an A/D converter 24, a subtractor 25, and a divider 26. An inverting input terminal of the operational amplifier 21 is connected to the data line Si, and a non-inverting input terminal of the operational amplifier 21 is connected to an output terminal of the D/A converter 20. A data voltage according to video data V1 is provided to the non-inverting input terminal of the operational amplifier 21. The capacitor 22 is provided between the inverting input terminal and output terminal of the operational amplifier 21. The switch 23 is provided between the inverting input terminal and output terminal of the operational amplifier 21 and in parallel to the capacitor 22. The capacitor 22 functions as a current-voltage conversion element, and the switch 23 functions as a function selection switch.

When the input/output control signal DWT is at a high level, the switch 23 is turned on and the output terminal and inverting input terminal of the operational amplifier 21 are short-circuited. At this time, the operational amplifier 21 functions as a buffer amplifier, and provides a data voltage outputted from the D/A converter 20, to the data line Si at a low output impedance. Note that at this time it is preferred to control not to input the data voltage to the D/A converter 20, using the input/output control signal DWT.

When the input/output control signal DWT is at a low level, the switch 23 is turned off and the output terminal and inverting input terminal of the operational amplifier 21 are connected to each other via the capacitor 22. At this time, the operational amplifier 21 and the capacitor 22 function as an integrating amplifier. When a data voltage provided to the non-inverting input terminal of the operational amplifier 21 is Vm(i, j, P), a voltage at the inverting input terminal of the operational amplifier 21 is also Vm(i, j, P) by a virtual short circuit. When a drive current flowing through the data line Si from the pixel circuit PX(i, j) at this time is Im(i, j, P), an output voltage from the operational amplifier 21 is {Vm(i, j, P)−R×Im(i, j, P)}. Note that when the length of a period during which the input/output control signal DWT is at the low level is Tm and the capacitance value of the capacitor 22 is Cm, R=Tm/Cm.

The A/D converter 24, the subtractor 25, and the divider 26 function as a current calculating unit that determines the amount of current flowing through the data line Si, based on an output voltage from the operational amplifier 21. The A/D converter 24 converts the output voltage from the operational amplifier 21 into a digital value. The subtractor 25 subtracts video data (digital value) inputted to the D/A converter 20, from the digital value outputted from the A/D converter 24. The divider 26 divides an output from the subtractor 25 by (−R). The output from the subtractor 25 is {−R×Im(i, j, P)}, and an output from the divider 26 is Im(i, j, P).

In this manner, the voltage output/current measurement circuit 123 measures a drive current flowing through the data line Si, and outputs measurement data MD representing the amount of the drive current. Note that the voltage output/current measurement circuit 123 may include a resistive element as a current-voltage conversion element. In this case, R is the resistance value of the resistive element.

Video data V1 corresponding to a data voltage Vm(i, j, P) may be hereinafter represented as Vm(i, j, P) using the same symbol, and measurement data MD representing the value of a drive current Im(i, j, P) may be hereinafter represented as Im(i, j, P) using the same symbol. In addition, a signal on a scanning line Gj is referred to as scanning signal Gj.

Figure 6:
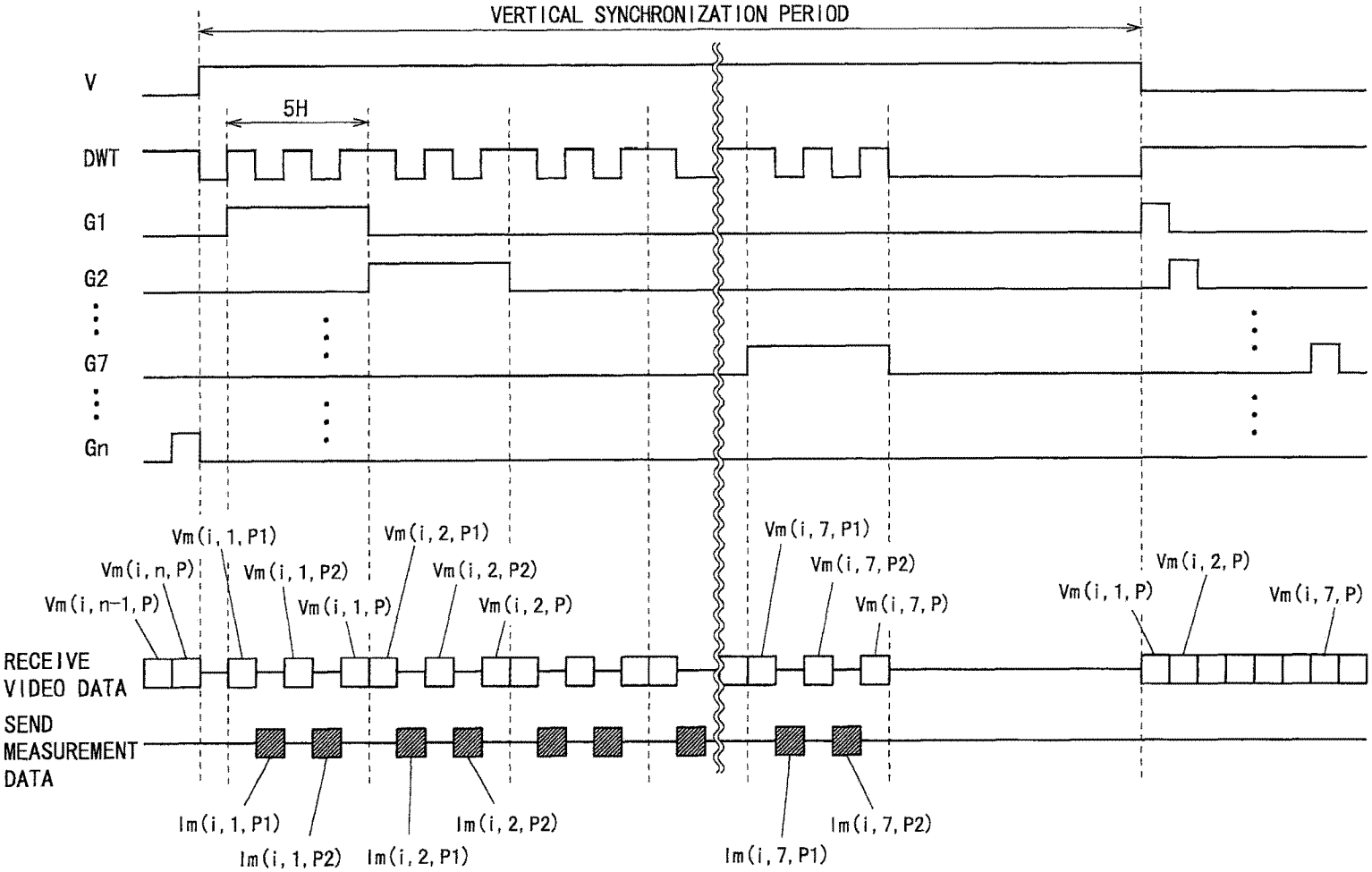
FIG. 6 is a timing chart showing changes in signals during one frame period in the organic EL display device shown in FIG. 1.

FIG. 6 is a timing chart showing changes in signals during one frame period in the organic EL display device 1. In the following description, it is assumed that k=7, i.e., seven scanning lines are selected during one vertical synchronization period. A period type signal V shown in FIG. 6 becomes a low level during a video signal period, and becomes a high level during a vertical synchronization period.

Figure 7:
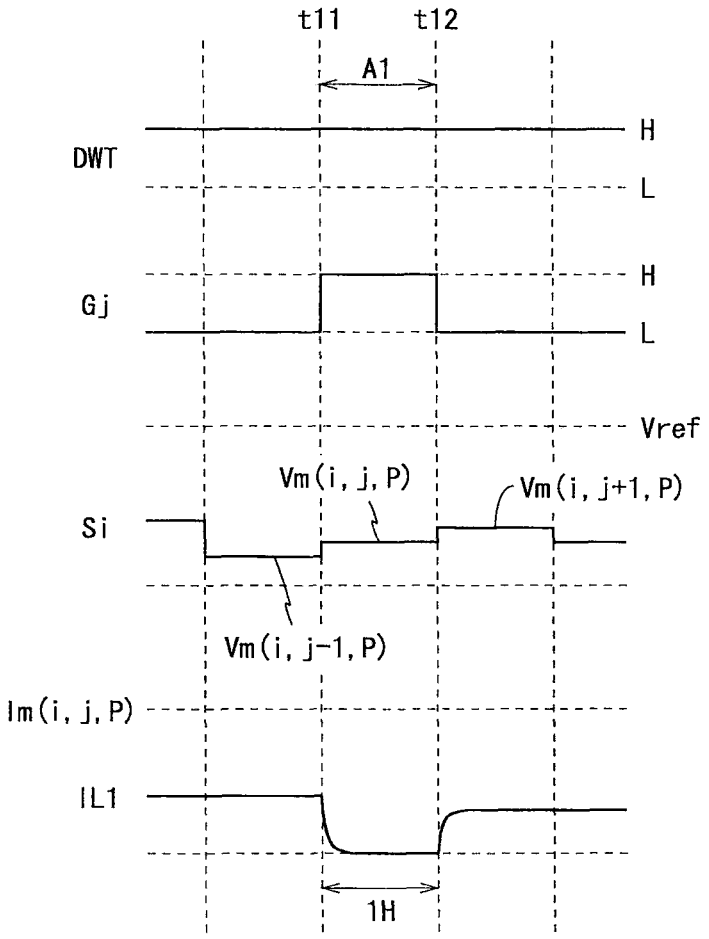
FIG. 7 is a timing chart showing changes in signals during a video signal period in the organic EL display device shown in FIG. 1.

FIG. 7 is a timing chart showing changes in signals during a video signal period in the organic EL display device 1. As shown in FIG. 7, during the video signal period, the input/output control signal DWT is always at the high level. During time t11 to t12 (hereinafter, referred to as program period A1), the process of writing a data voltage Vm(i, j, P) to the pixel circuit PX(i, j) is performed. Note that the data voltage Vm(i, j, P) is a voltage obtained by performing threshold voltage compensation and gain compensation of the drive transistor T1 in the pixel circuit PX(i, j) on a voltage corresponding to a gradation value P.

Prior to time t11, the scanning signal Gj is at a low level. At this time, the transistors T2 and T3 are in an off state, and a drive current according to a voltage held in the capacitor C1 flows through the transistor T1 and the organic EL element L1. The organic EL element L1 emits light at a luminance according to the drive current flowing through at this time.

Figure 8:
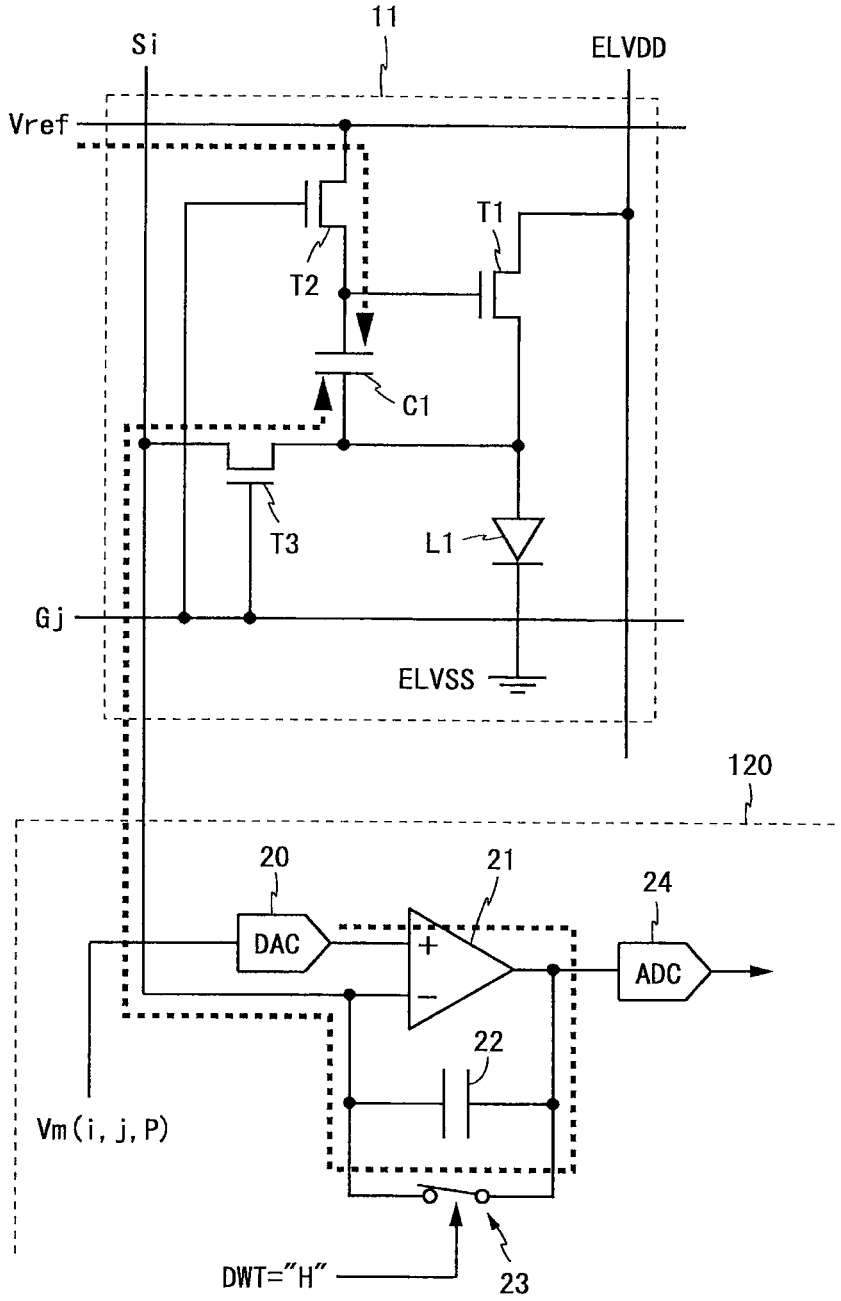
FIG. 8 is a diagram showing the flow of a current during a program period in the organic EL display device shown in FIG. 1.

At time t11, the scanning signal Gj changes to a high level. Accordingly, the transistors T2 and T3 are turned on. During the program period A1, by the action of the operational amplifier 21, the data voltage Vm(i, j, P) is applied to the data line Si. Hence, as shown in FIG. 8, the data voltage Vm(i, j, P) is provided to one end (lower terminal) of the capacitor C1 via the data line Si and the transistor T3, and the reference voltage Vref is provided to the other end (upper terminal) of the capacitor C1 via the transistor T2. Therefore, during the program period A1, the capacitor C1 is charged to a voltage Vgs shown in the following equation (1):

$$Vgs=V\text{ref}-Vm(i,j,P) \tag{1}$$

Note that when the light-emission threshold voltage of the organic EL element L1 is Vth_L1, the data voltage Vm(i, j, P) is determined so as to satisfy the following equation (2):

$$Vm(i,j,P)<ELVSS+Vth_L1 \tag{2}$$

By providing the data voltage Vm(i, j, P) satisfying the equation (2) to the anode terminal of the organic EL element L1, the light emission of the organic EL element L1 during the program period A1 can be prevented.

Figure 9:
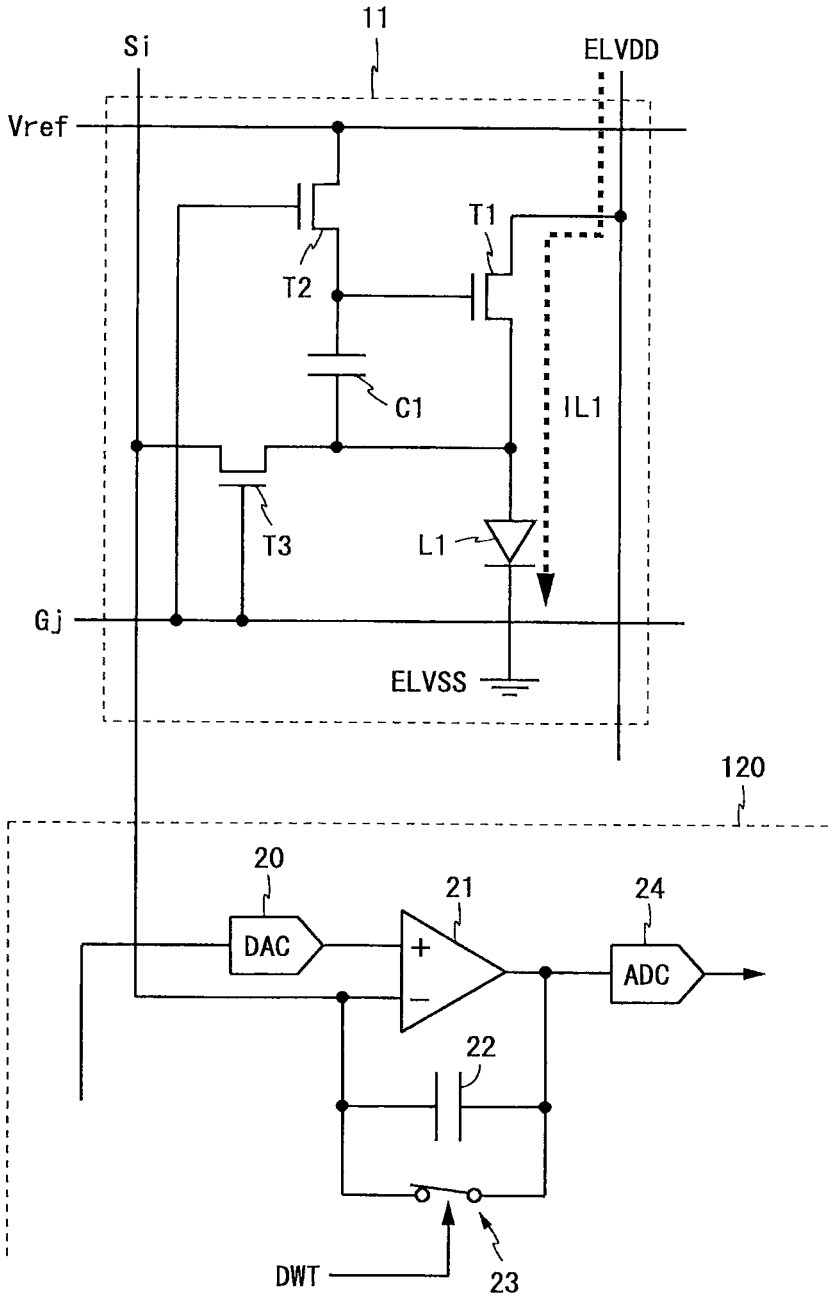
FIG. 9 is a diagram showing the flow of a current during a light emission period in the organic EL display device shown in FIG. 1.

At time t12, the scanning signal Gj changes to the low level. Accordingly, the transistors T2 and T3 are turned off, and the voltage Vgs shown in the equation (1) is held in the capacitor C1. After time t12, the source terminal of the transistor T1 is electrically disconnected from the data line Si. Therefore, after time t12, a drive current IL1 having passed through the transistor T1 flows through the organic EL element L1, and the organic EL element L1 emits light at a luminance according to the drive current IL1 (see FIG. 9). Since the transistor T1 operates in a saturation region, the drive current IL1 is given by the following equation (3). The gain p of the transistor T1 included in the equation (3) is given by the following equation (4):

$$\begin{aligned} IL1 &= (\beta/2)\times(Vgs-Vt)^2 \\ &= (\beta/2)\times\{Vref-Vm(i,j,P)-Vt\}^2 \end{aligned} \tag{3}$$

$$\beta=\mu\times(W/L)\times Cox \tag{4}$$

Note that in the equation (3) and equation (4), Vt, μ, W, L, and Cox represent the threshold voltage, mobility, gate width, gate length, and gate insulating film capacitance per unit area of the transistor T1, respectively.

Figure 10:
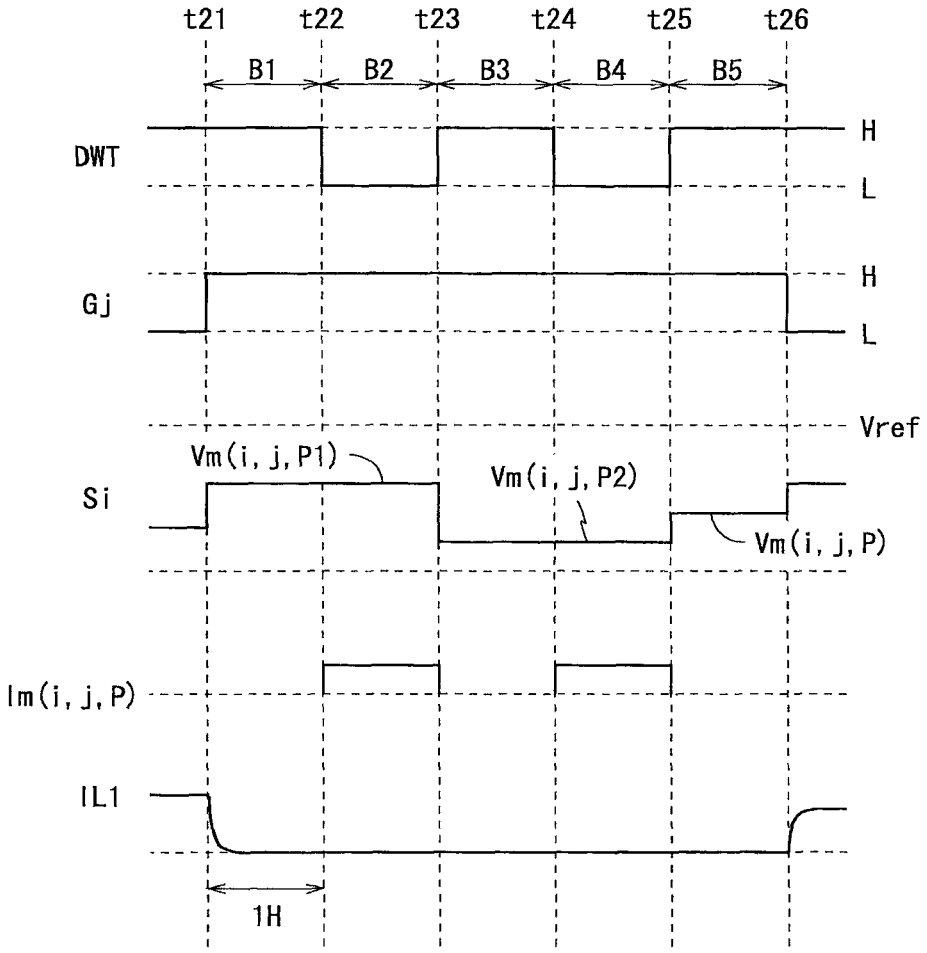
FIG. 10 is a timing chart showing changes in signals during a vertical synchronization period in the organic EL display device shown in FIG. 1.

FIG. 10 is a timing chart showing changes in signals during a vertical synchronization period in the organic EL display device 1. Processes for the pixel circuit PX(i, j) will be described below. As shown in FIG. 10, the scanning signal Gj becomes the high level over five horizontal periods, and during each horizontal period the following processes are performed. During time t21 to t22 (hereinafter, referred to as first program period B1), the process of writing a data voltage corresponding to a first gradation value P1 is performed. During time t22 to t23 (hereinafter, referred to as first measurement period B2), the process of measuring a drive current obtained at this time is performed. During time t23 to t24 (hereinafter, referred to as second program period B3), the process of writing a data voltage corresponding to a second gradation value P2 is performed. During time t24 to t25 (hereinafter, referred to as second measurement period B4), the process of measuring a drive current obtained at this time is performed. During time t25 to t26 (hereinafter, referred to as third program period B5), the process of writing a data voltage Vm(i, j, P) corresponding to a gradation value P is performed.

The first gradation value P1 and the second gradation value P2 are determined so as to satisfy P1<P2 within the range of gradation values that video data V0 can take. For example, when the range of gradation values that video data V0 can take is 0 to 255, the first gradation value P1 is determined to be 80 and the second gradation value P2 is determined to be 160.

The data voltage corresponding to the first gradation value P1 is hereinafter referred to as first measurement voltage Vm(i, j, P1), the drive current obtained when the first measurement voltage Vm(i, j, P1) is written is hereinafter referred to as first drive current Im(i, j, P1), the data voltage corresponding to the second gradation value P2 is hereinafter referred to as second measurement voltage Vm(i, j, P2), and the drive current obtained when the second measurement voltage Vm(i, j, P2) is written is hereinafter referred to as second drive current Im(i, j, P2). In addition, measurement data corresponding to the first drive current Im(i, j, P1) is referred to as first measurement data and represented as Im(i, j, P1) using the same symbol. Measurement data corresponding to the second drive current Im(i, j, P2) is referred to as second measurement data and represented as Im(i, j, P2) using the same symbol.

As shown in FIG. 10, during time t21 to t26, the scanning signal Gj is at the high level. The input/output control signal DWT is at the high level during the first to third program periods B1, B3, and B5, and is at the low level during the first and second measurement periods B2 and B4. Hence, during the first to third program periods B1, B3, and B5, the switch 23 is turned on and the operational amplifier 21 functions as a buffer amplifier. During the first and second measurement periods B2 and B4, the switch 23 is turned off and the operational amplifier 21 and the capacitor 22 function as an integrating amplifier.

Prior to time t21, the scanning signal Gj is at the low level. The operation of the pixel circuit PX(i, j) prior to time t21 is the same as that prior to time t11 shown in FIG. 7. At time t21, the scanning signal Gj changes to the high level. Accordingly, the transistors T2 and T3 are turned on. During the first program period B1, the first measurement voltage Vm(i, j, P1) is inputted to the non-inverting input terminal of the operational amplifier 21. In addition, during the first program period B1, the switch 23 is turned on and the operational amplifier 21 functions as a buffer amplifier. Hence, during the first program period B1, the first measurement voltage Vm(i, j, P1) is applied to the data line Si. Therefore, during the first program period B1, the capacitor C1 is charged to a voltage Vgs shown in the following equation (5):

$$Vgs=V\text{ref}-Vm(i,j,P1) \tag{5}$$

At time t22, the input/output control signal DWT changes to the low level. Accordingly, the switch 23 is turned off and the operational amplifier 21 and the capacitor 22 function as an integrating amplifier. During the first measurement period B2, too, the first measurement voltage Vm(i, j, P1) is inputted to the non-inverting input terminal of the operational amplifier 21. Hence, a voltage at the inverting input terminal of the operational amplifier 21 is also Vm(i, j, P1) by a virtual short circuit.

Figure 11:
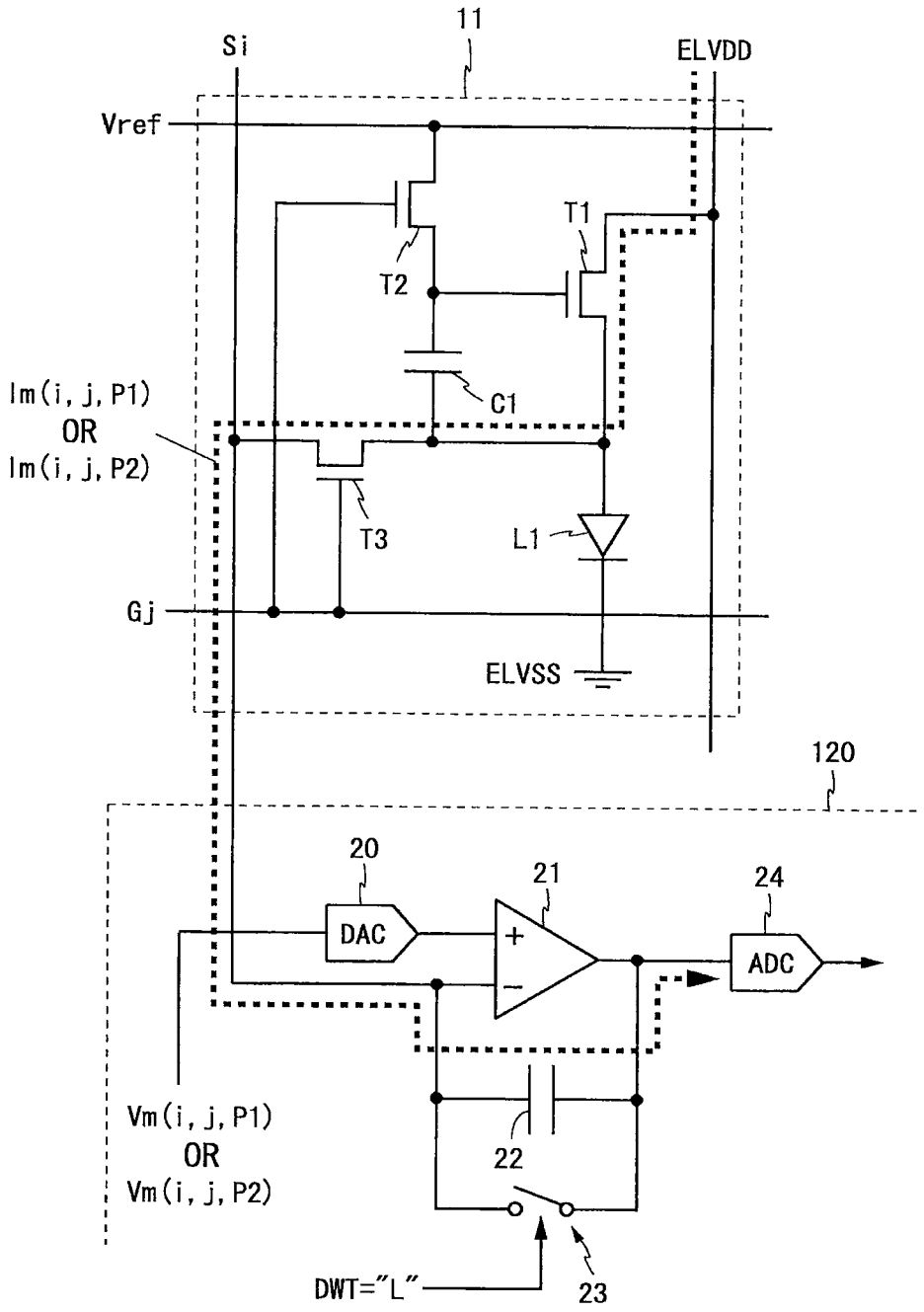
FIG. 11 is a diagram showing the flow of a current during a measurement period in the organic EL display device shown in FIG. 1.

During the first measurement period B2, a current path that passes through the transistor T3 being in an on state is formed. Since the equation (2) also holds for the first gradation value P1, a current does not flow through the organic EL element L1 during the first measurement period B2. Therefore, the first drive current Im(i, j, P1) having passed through the transistor T1 flows through the data line Si (see FIG. 11). The voltage output/current measurement circuit 123 measures the first drive current Im(i, j, P1) having flowed through the data line Si from the pixel circuit PX(i, j), and outputs first measurement data Im(i, j, P1) representing the value of the first drive current.

The operation of the pixel circuit PX(i, j) and the data line drive circuit 120 during the second program period B3 is similar to that performed during the first program period B1. The operation of the pixel circuit PX(i, j) and the data line drive circuit 120 during the second measurement period B4 is similar to that performed during the first measurement period B2. Note, however, that during the second program period B3, the second measurement voltage Vm(i, j, P2) is written to the pixel circuit PX(i, j), and during the second measurement period B4, the second drive current Im(i, j, P2) is measured and second measurement data Im(i, j, P2) representing the value of the second drive current is outputted.

The operation of the pixel circuit PX(i, j) and the data line drive circuit 120 during the third program period B5 is similar to that performed during the program period A1 (FIG. 7). Note, however, that the data voltage Vm(i, j, P) written during the third program period B5 is a voltage obtained by updating correction data using the first measurement data Im(i, j, P1) obtained during the first measurement period B2 and the second measurement data Im(i, j, P2) obtained during the second measurement period B4, and performing threshold voltage compensation and gain compensation using the updated correction data. At time t26, the scanning signal Gj changes to the low level. The operation of the pixel circuit PX(i, j) after time t26 is the same as that performed after time t12 shown in FIG. 7.

During one vertical synchronization period, k scanning lines are selected in turn, and the above-described five processes (the processes performed during the periods B1 to B5) are performed in turn for the selected scanning lines. By this, during one vertical synchronization period, first measurement data Im(i, j, P1) and second measurement data Im(i, j, P2) can be obtained for (m×k) pixel circuits 11 connected to the k scanning lines. Therefore, during (n/k) frame periods, first measurement data Im(i, j, P1) and second measurement data Im(i, j, P2) can be obtained for all pixel circuits 11 included in the display unit 10. For example, when the display panel 12 is of an FHD (Full High Definition) system, the total number of scanning lines is 1125 and the number of valid scanning lines is 1080. When k=7, during 155 (=1080/7) frame periods, first measurement data Im(i, j, P1) and second measurement data Im(i, j, P2) can be obtained for all pixel circuits 11 included in the display unit 10.

Figure 12:
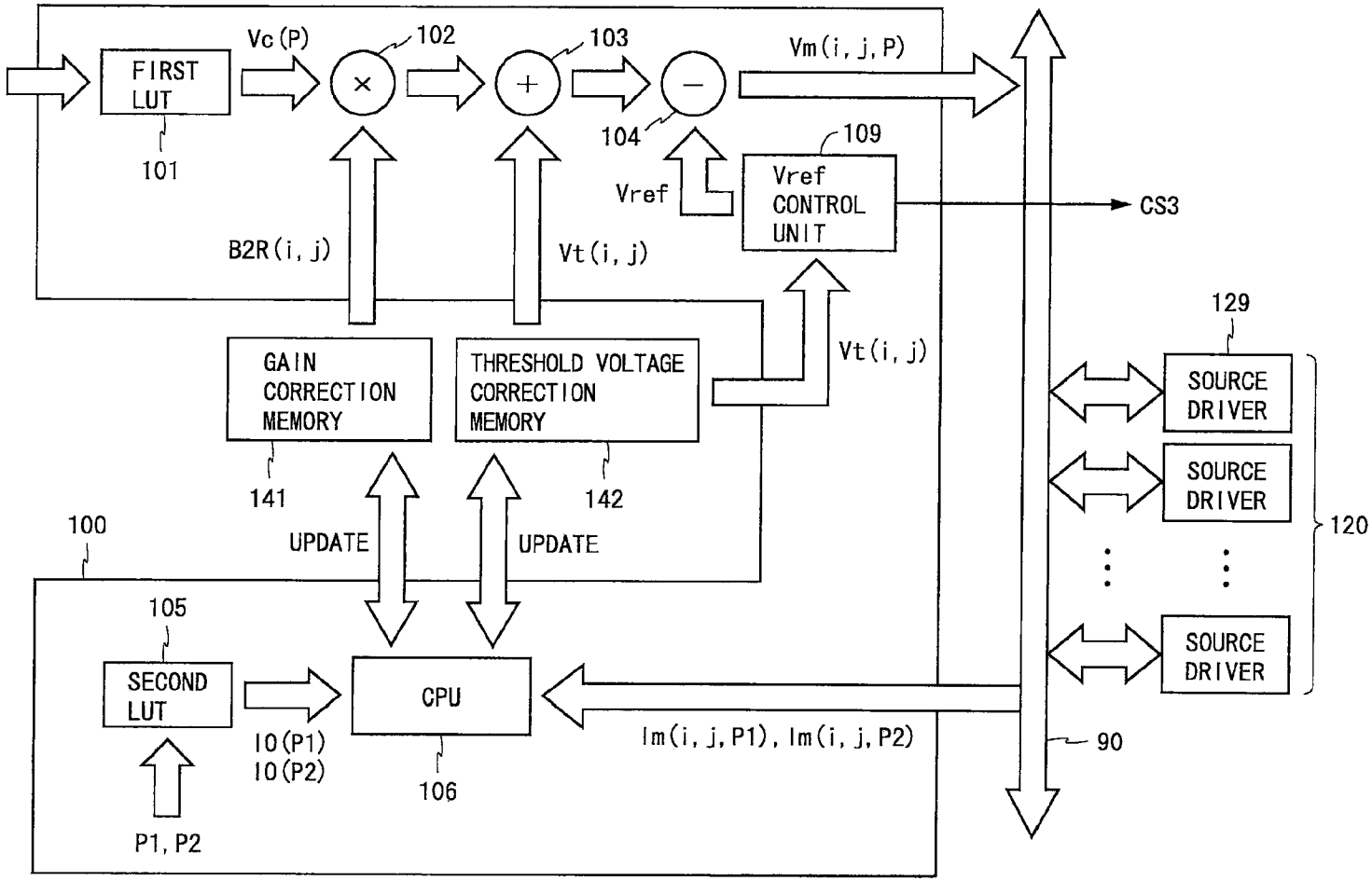
FIG. 12 is a block diagram showing a correction process of the organic EL display device shown in FIG. 1.

FIG. 12 is a block diagram showing a correction process of the organic EL display device 1. The communication bus 90 shown in FIG. 12 is either two unidirectional communication buses or one bidirectional communication bus. The type of the communication bus 90 may be arbitrary. For the communication bus 90, for example, LVDS (Low Voltage Differential Signaling), MIPI (Mobile Industry Processor Interface), e-DP (Embedded Display Port), or the like, is used.

The display control circuit 100 uses a part of a storage area of the DRAM 140 as a gain correction memory 141, and uses another part of the storage area of the DRAM 140 as a threshold voltage correction memory 142. The gain correction memory 141 stores data used to perform gain compensation of the drive transistor in the pixel circuit 11 (hereinafter, referred to as gain correction data). The threshold voltage correction memory 142 stores data representing the value of a threshold voltage of the drive transistor in the pixel circuit 11 (hereinafter, referred to as threshold voltage correction data). The threshold voltage correction memory 142 functions as a storage unit that stores, for each pixel circuit, data according to a threshold voltage of a drive transistor.

For the respective (m×n) pixel circuits 11, the gain correction memory 141 stores (m×n) pieces of gain correction data and the threshold voltage correction memory 142 stores (m×n) pieces of threshold voltage correction data. Gain correction data for the pixel circuit PX(i, j) is hereinafter represented as B2R(i, j), and threshold voltage correction data for the pixel circuit PX(i, j) is hereinafter represented as Vt(i, j). In an initial state, pieces of gain correction data B2R(i, j) are all set to 1, and pieces of threshold voltage correction data Vt(i, j) are all set to the same value.

The display control circuit 100 includes a first LUT (Look Up Table) 101, a multiplier 102, an adder 103, a subtractor 104, a second LUT 105, a CPU 106, and a Vref control unit 109. Note that a logic circuit may be used instead of the CPU 106, and the CPU 106 may have the function of the Vref control unit 109.

The first LUT 101 stores the gradation values of video data V0 and voltage values in association with each other. When the gradation value of the video data V0 is P, the first LUT 101 outputs a voltage value Vc(P) associated with the gradation value P. The multiplier 102 multiplies the voltage value Vc(P) outputted from the first LUT 101 by gain correction data B2R(i, j) read from the gain correction memory 141. The adder 103 adds an output from the multiplier 102 to threshold voltage correction data Vt(i, j) read from the threshold voltage correction memory 142. The subtractor 104 subtracts an output from the adder 103 from the value of the reference voltage Vref determined by the Vref control unit 109, and outputs the obtained value as video data Vm(i, j, P). The video data Vm(i, j, P) is given by the following equation (6):

$$Vm(i,j,P)=V\mathrm{ref}-Vc(P)\times B2R(i,j)-Vt(i,j) \tag{6}$$

By substituting the equation (6) into the equation (3), the following equation (7) is derived:

$$IL1=(\beta/2)\times\{Vc(P)\times B2R(i,j)+Vt(i,j)-Vt\}^2 \tag{7}$$

Therefore, by changing the gain correction data B2R(i, j) and the threshold voltage correction data Vt(i, j) according to the state of the transistor T1, both threshold voltage compensation and gain compensation can be performed on a per pixel circuit 11 basis.

The video data Vm(i, j, P) is, for example, temporarily held in a buffer memory (not shown) and then sent to the data line drive circuit 120 via the communication bus 90, based on the control of the CPU 106.

The first LUT 101 performs the following conversion on the gradation value P. It is assumed that a current flowing through the organic EL element L1 when the organic EL element emits light at its maximum luminance is Iw, and the gate-source voltage Vgs of the transistor T1 at that time is given by the following equation (8):

$$Vgs=Vw+Vth \tag{8}$$

In this case, the first LUT 101 performs, for example, conversion shown in the following equation (9):

$$Vc(P)=Vw\times P^{1.1} \quad (9)$$

When the voltage Vc(P) shown in the equation (9) is used, a drive current IL1(P) corresponding to the gradation value P is given by the following equation (10). Note that it is assumed that B2R(i, j)=1 and Vt(i, j)=Vt.

$$IL1(P)=(\beta/2)\times Vw^2\times P^{2.2} \quad (10)$$

Therefore, the drive current IL1 has the characteristic "γ=2.2" with respect to the gradation value P. Since the light-emission luminance of the organic EL element L1 is proportional to the drive current IL1, the light-emission luminance of the organic EL element L1 also has the characteristic "γ=2.2" with respect to the gradation value P.

In an ideal case in which the output current of the transistor T1 has a square-law characteristic with respect to an input voltage, the equation (10) holds. However, in practice, in a region where an output current is small, the output current deviates from the square-law characteristic. Hence, it is more preferred that the first LUT 101 perform conversion shown in the following equation (11) using a value Vn(P) that changes nonlinearly according to the gradation value P, instead of the conversion shown in the equation (9). By this, the conversion accuracy of the first LUT 101 can be improved.

$$Vc(P)=Vw\times Vn(P) \quad (11)$$

The second LUT 105 converts the first gradation value P1 into first ideal characteristic data IO(P1) shown in the following equation (12), and converts the second gradation value P2 into second ideal characteristic data IO(P2) shown in the following equation (13):

$$IO(P1)=Iw\times P1^{2.2} \quad (12)$$

$$IO(P2)=Iw\times P2^{2.2} \quad (13)$$

The CPU 106 receives first measurement data Im(i, j, P1) and second measurement data Im(i, j, P2) from the data line drive circuit 120. When the CPU 106 receives the first measurement data Im(i, j, P1), the CPU 106 reads the first ideal characteristic data IO(P1) corresponding to the first gradation value P1 from the second LUT 105, and updates threshold voltage correction data Vt(i, j) stored in the threshold voltage correction memory 142, according to the result of comparison between the first ideal characteristic data IO(P1) and the first measurement data Im(i, j, P1). The CPU 106 adds ΔV to the threshold voltage correction data Vt(i, j) when the following equation (14) holds, and subtracts ΔV from the threshold voltage correction data Vt(i, j) when the following equation (15) holds, and does not update the threshold voltage correction data Vt(i, j) when the following equation (16) holds. Note that ΔV is a predetermined fixed value.

$$IO(P1)-Im(i,j,P1)>0 \quad (14)$$

$$IO(P1)-Im(i,j,P1)<0 \quad (15)$$

$$IO(P1)-Im(i,j,P1)=0 \quad (16)$$

When the CPU 106 receives the second measurement data Im(i, j, P2), the CPU 106 reads the second ideal characteristic data IO(P2) corresponding to the second gradation value P2 from the second LUT 105, and updates gain correction data B2R(i, j) stored in the gain correction memory 141, according to the result of comparison between the second ideal characteristic data IO(P2) and the second measurement data Im(i, j, P2). The CPU 106 adds ΔB to the gain correction data B2R(i, j) when the following equation (17) holds, and subtracts ΔB from the gain correction data B2R(i, j) when the following equation (18) holds, and does not update the gain correction data B2R(i, j) when the following equation (19) holds. Note that ΔB is a predetermined fixed value.

$$IO(P2)-Im(i,j,P2)>0 \quad (17)$$

$$IO(P2)-Im(i,j,P2)<0 \quad (18)$$

$$IO(P2)-Im(i,j,P2)=0 \quad (19)$$

When the first measurement voltage Vm(i, j, P1) is applied to the gate terminal of the transistor T1, the gate-source voltage Vgs of the transistor T1 is relatively small. Hence, the first measurement data Im(i, j, P1) greatly changes according to a shift in the threshold voltage Vt. On the other hand, when the second measurement voltage Vm(i, j, P2) is applied to the gate terminal of the transistor T1, the gate-source voltage Vgs of the transistor T1 is relatively large. Hence, while the second measurement data Im(i, j, P2) is not likely to change according to a shift in the threshold voltage Vt, the second measurement data Im(i, j, P2) greatly changes by a shift in the gain β. Hence, the organic EL display device 1 uses the first measurement data Im(i, j, P1) as a criterion as to whether to update the threshold voltage correction data Vt(i, j), and uses the second measurement data Im(i, j, P2) as a criterion as to whether to update the gain correction data B2R(i, j).

Figure 13:
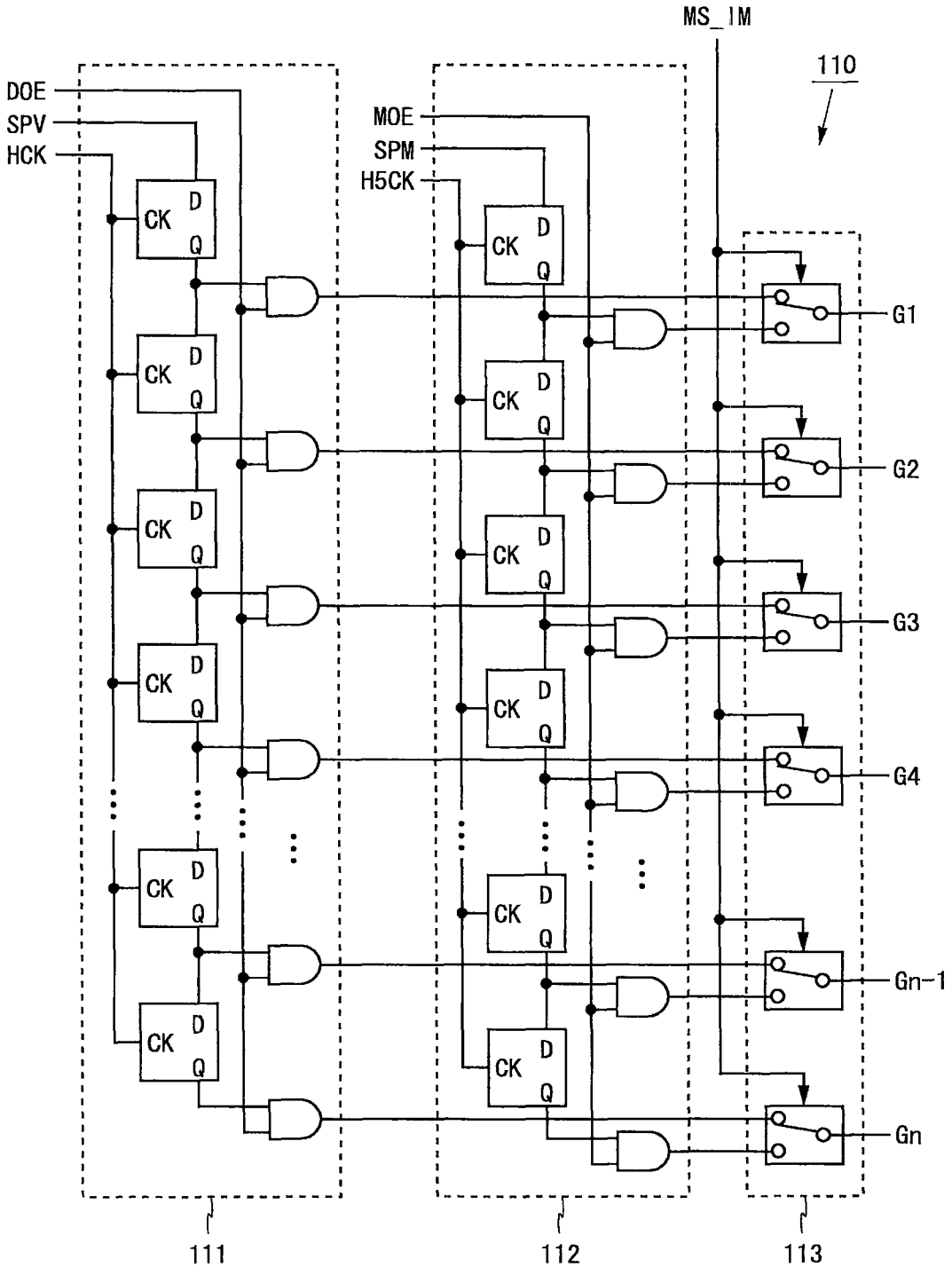
FIG. 13 is a circuit diagram of a scanning line drive circuit shown in FIG. 1.

FIG. 13 is a circuit diagram of the scanning line drive circuit 110. The scanning line drive circuit 110 includes two shift registers 111 and 112 and a selector unit 113. The shift register 111 includes n D flip-flops and n AND circuits. The n D flip-flops are connected in series with each other, and a first start pulse SPV is inputted to a D terminal of the D flip-flop in the first stage. The shift register 111 operates according to a first clock HCK having a cycle of one horizontal period. Each AND circuit outputs a logical product of an output from a corresponding stage of the shift register 111 and a first enable signal DOE. The shift register 111 generates scanning signals for the video signal period.

The shift register 112 includes n D flip-flops and n AND circuits. The n D flip-flops are connected in series with each other, and a second start pulse SPM is inputted to a D terminal of the D flip-flop in the first stage. The shift register 112 operates according to a second clock H5CK having a cycle of five horizontal periods. Each AND circuit outputs a logical product of an output from a corresponding stage of the shift register 112 and a second enable signal MOE. The shift register 112 generates scanning signals for the vertical synchronization period.

The selector unit 113 includes n selectors. Each selector selects an output from the shift register 111 when a selector control signal MS_IM is at a low level, and selects an output from the shift register 112 when the selector control signal MS_IM is at a high level. Therefore, the selector unit 113 selects the outputs from the shift register 111 during the video signal period, and selects the outputs from the shift register 112 during the vertical synchronization period. Outputs from the selector unit 113 are provided to the scanning lines G1 to Gn.

Figure 14:
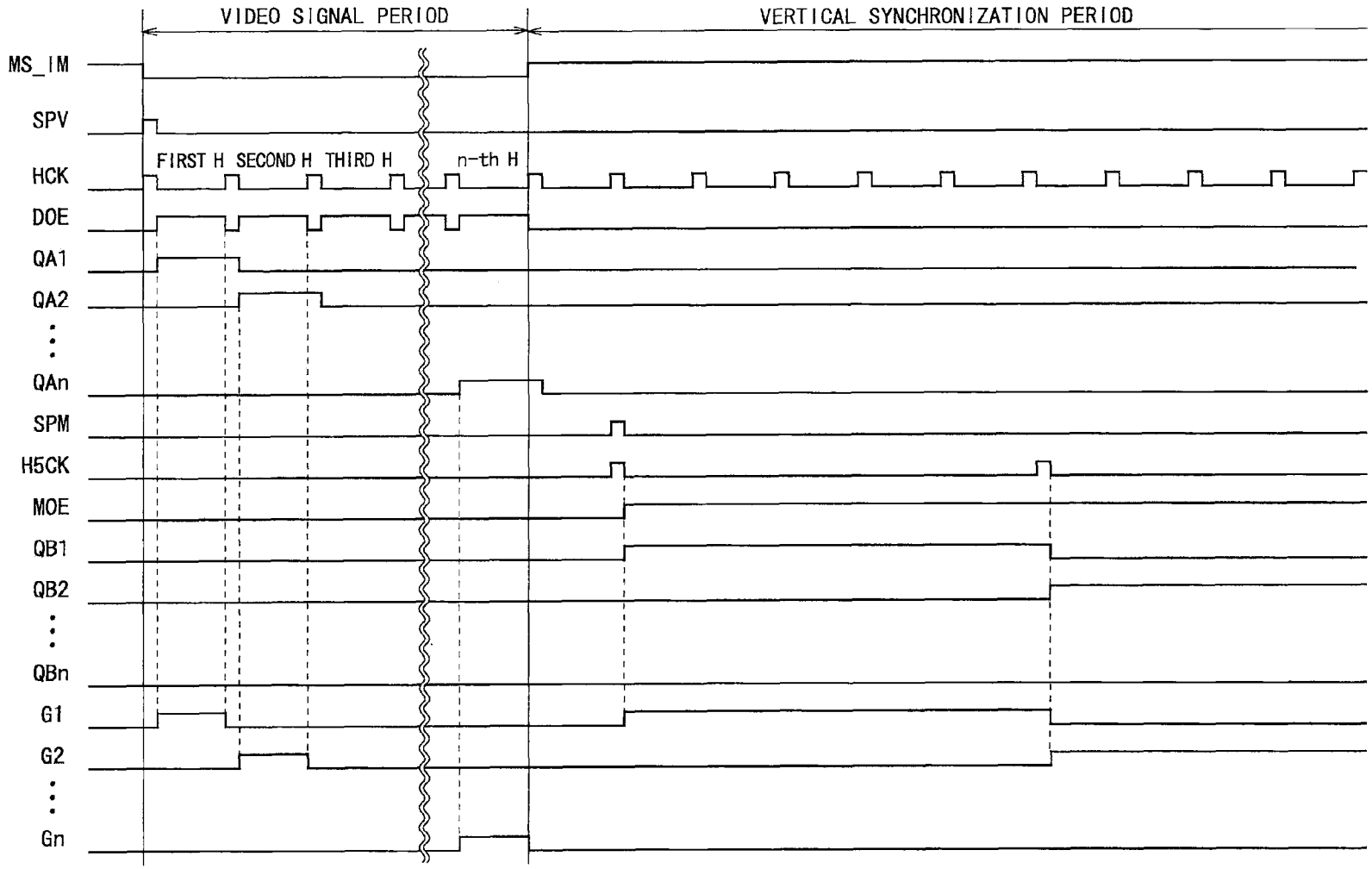
FIG. 14 is a timing chart of the scanning line drive circuit shown in FIG. 13.

FIG. 14 is a timing chart of the scanning line drive circuit 110. In FIG. 14, QA1 to QAn indicate outputs from the n D flip-flops included in the shift register 111, and QB1 to QBn indicate outputs from the n D flip-flops included in the shift register 112. The first clock HCK becomes the high level once in every horizontal period during the video signal period. The second clock H5CK becomes the high level once in every five horizontal periods, k times in total, during the vertical synchronization period. The first enable signal DOE is at an opposite level to that of the first clock HCK during the video signal period, and is always at a low level during the vertical synchronization period. The second enable signal MOE is always at the low level during the video signal period, and changes to the high level at the fall of the first pulse of the second clock H5CK and changes to the low level after a lapse of five horizontal periods from the fall of a k-th pulse of the second clock H5CK during the vertical synchronization period.

In this manner, the organic EL display device 1 performs both of the threshold voltage compensation and gain compensation of a drive transistor on a per pixel circuit 11 basis.

Control of the reference voltage Vref of the organic EL display device 1 will be described below. As shown in FIGS. 1 and 12, the display control circuit 100 includes the Vref control unit 109. The Vref control unit 109 reads (m×n) pieces of threshold voltage correction data Vt(j) from the threshold voltage correction memory 142, and determines a mean value of the read data. By this, a mean value VM of the threshold voltages of the drive transistors is calculated.

The Vref control unit 109 determines a level of the reference voltage Vref based on the mean value VM. For example, the Vref control unit 109 increases the level of the reference voltage Vref when the mean value VM is large, and decreases the level of the reference voltage Vref when the mean value VM is small. The Vref control unit 109 may increase the level of the reference voltage Vref from the previous one by an amount corresponding to an increase in the mean value VM, and decrease the level of the reference voltage Vref from the previous one by an amount corresponding to a decrease in the mean value VM of the threshold voltages. The display control circuit 100 outputs the control signal CS3 indicating the level of the reference voltage Vref determined by the Vref control unit 109, to the Vref generating circuit 130. The Vref generating circuit 130 supplies the reference voltage Vref according to the control signal CS3, to the display unit 10. As such, the display control circuit 100 determines the mean value VM of the threshold voltages of all drive transistors included in the display unit 10, based on the data stored in the threshold voltage correction memory 142, and controls the reference voltage Vref based on the determined mean value VM.

The display control circuit 100 may determine a statistical value other than a mean value (e.g., median, mode, maximum value, or minimum value) for the threshold voltages of the drive transistors, based on the data stored in the threshold voltage correction memory 142, and control the reference voltage Vref based on the determined statistical value. In addition, the display control circuit 100 may determine a statistical value for some drive transistors included in the display unit 10 based on the data stored in the threshold voltage correction memory 142, and control the reference voltage Vref based on the determined statistical value.

The display control circuit 100 controls the reference voltage Vref at a predetermined time interval during the operation of the organic EL display device 1. The display control circuit 100 may control the reference voltage Vref only in the process of power on or may control the reference voltage Vref only in the process of power off. In the latter case, the display control circuit 100 writes, to the flash memory 150, a level of the reference voltage Vref determined in the process of power off, and reads the level of the reference voltage Vref from the flash memory 150 in the process of power on and uses the level for control of the reference voltage Vref.

As such, the organic EL display device 1 includes the display control circuit 100 that controls the reference voltage Vref. Therefore, even when the threshold voltage of the drive transistor T1 in the pixel circuit 11 is changed, a change in the amount of drive current flowing through the drive transistor T1 is suppressed, enabling to detect the drive current with a high accuracy. In addition, a change in the end-to-end voltage of the organic EL element L1 during the first and second measurement periods B2 and B4 is suppressed. Therefore, an unwanted current is prevented from flowing through the organic EL element L1, enabling to detect the drive current with a high accuracy.

As shown above, in the organic EL display device 1 according to the present embodiment, the pixel circuit 11 includes an electro-optical element (organic EL element L1); and a drive transistor T1 provided in series with the electro-optical element. Upon current detection (first and second measurement periods B2 and B4), the data line drive circuit 120 provides, between the control terminal (gate terminal) and first conduction terminal (source terminal) of the drive transistor T1, a voltage (voltages {Vref-Vm(i, j, P1)} and {Vref-Vm(i, j, P2)}) which is according to a detection voltage (first and second measurement voltages Vm(i, j, P1) and Vm(i, j, P2)) and to a reference voltage Vref, and detects a drive current (first and second drive currents Im(i, j, P1) and Im(i, j, P2)) having passed through the drive transistor T1 and outputted external to the pixel circuit 11. The display control circuit 100 controls the reference voltage Vref. Therefore, according to the organic EL display device 1 according to the present embodiment, by suitably controlling the reference voltage Vref, even when the threshold voltage of the drive transistor T1 is changed, a change in the amount of drive current flowing through the drive transistor T1 is suppressed, enabling to detect the drive current with a high accuracy. In addition, upon current detection, a change in the end-to-end voltage of the electro-optical element is suppressed to prevent an unwanted current from flowing through the electro-optical element. By this, the drive current can be detected with a high accuracy.

In addition, the organic EL display device 1 includes a storage unit (threshold voltage correction memory 142) that stores, for each pixel circuit 11, data according to a threshold voltage of the drive transistor T1 (threshold voltage correction data Vt(i, j)), and the display control circuit 100 determines a statistical value (e.g., mean value VM) of the threshold voltages of the drive transistors T1 based on the data stored in the storage unit, and controls the reference voltage Vref based on the determined statistical value. Therefore, by suitably controlling the reference voltage Vref by controlling the reference voltage Vref based on the statistical value of the threshold voltages of the drive transistors T1, the drive current can be detected with a high accuracy.

In addition, the display control circuit 100 updates the data stored in the storage unit, based on the results of detection by the data line drive circuit 120. Therefore, data according to the threshold voltage of the drive transistor T1 can be obtained based on the result of detection of the drive current. In addition, the display control circuit 100 performs a correction process for compensating for the threshold voltage and gain of the drive transistor T1 (the process shown in FIG. 12) on video data V0, using the data stored in the storage unit. Therefore, by compensating for the threshold voltage and gain of the drive transistor T1 on a per pixel circuit 11 basis, the image quality of a display image can be improved.

In addition, the display unit 10 includes reference voltage lines that supply the reference voltage Vref to the pixel circuits 11, and upon current detection, the data line drive circuit 120 detects a drive current flowing through a data line Si from the pixel circuit 11. Therefore, in the display device that supplies the reference voltage Vref to the pixel circuits 11, by suitably controlling the reference voltage Vref by providing the detection voltage to the data line Si, the drive current flowing through the data line Si can be detected with a high accuracy. In addition, by detecting the drive current using the data line Si, the number of wiring lines can be reduced.

In addition, the pixel circuit 11 includes a reference voltage application transistor T2 that is provided between a reference voltage line which supplies the reference voltage Vref and the control terminal of the drive transistor T1 and that has a control terminal (gate terminal) connected to a scanning line Gj; an input/output transistor T3 provided between the data line Si and the first conduction terminal of the drive transistor T1 and having a control terminal (gate terminal) connected to the scanning line Gj; and a capacitive element C1 provided between the control terminal and first conduction terminal of the drive transistor T1. Therefore, by controlling the reference voltage Vref in the pixel circuit 11 that has the capacitive element C1 between the control terminal and first conduction terminal of the drive transistor T1 and that is used by applying a voltage on the data line Si and the reference voltage Vref to both ends of the capacitive element C1, the drive current can be detected with a high accuracy. In addition, by using an oxide TFT (e.g., a TFT in which a semiconductor layer includes indium gallium zinc oxide) as the drive transistor T1, the drive current is increased and accordingly write time can be reduced and the luminance of a screen can be increased.

Two types of variants of the organic EL display device 1 according to the first embodiment will be described below. In an organic EL display device according to a first variant, the threshold voltage correction memory 142 stores data representing a difference between the statistical value (e.g., mean value VM) of the threshold voltages of the drive transistors T1 and the reference voltage Vref. According to the organic EL display device according to the first variant, by storing data representing the difference between the statistical value of the threshold voltages of the drive transistors T1 and the reference voltage Vref, the number of bits of data to be stored is reduced and thus the capacity of the storage unit can be reduced.

For example, it is assumed that the maximum value of the amount of variations in threshold voltage in an initial state is Vdis, the maximum value of the amount of change in threshold voltage caused by deterioration over time is Vsft_max, and the minimum value of the amount of change in threshold voltage caused by deterioration over time is Vsft_min. The organic EL display device 1 according to the first embodiment needs to determine the number of bits of data stored in the threshold voltage correction memory 142, taking into account that the threshold voltage deviates from the center value in the initial state by (Vdis+Vsht_max) at the maximum. On the other hand, the organic EL display device according to the first variant only needs to determine the number of bits of data stored in the threshold voltage correction memory 142, taking into account that the threshold voltage deviates from the center value in the initial state by (Vdis+Vsht_max−Vsht_min) at the maximum. The number of bits of data is smaller for the latter one than the former one. Therefore, according to the organic EL display device according to the first variant, the capacity of the threshold voltage correction memory 142 can be reduced.

An organic EL display device according to a second variant includes a threshold voltage correction memory that stores threshold voltage correction data, and performs only threshold voltage compensation of the drive transistor. According to the organic EL display device according to the second variant, by compensating for the threshold voltage of the drive transistor on a per pixel circuit basis, the image quality of a display image can be improved.

Second Embodiment

Figure 15:
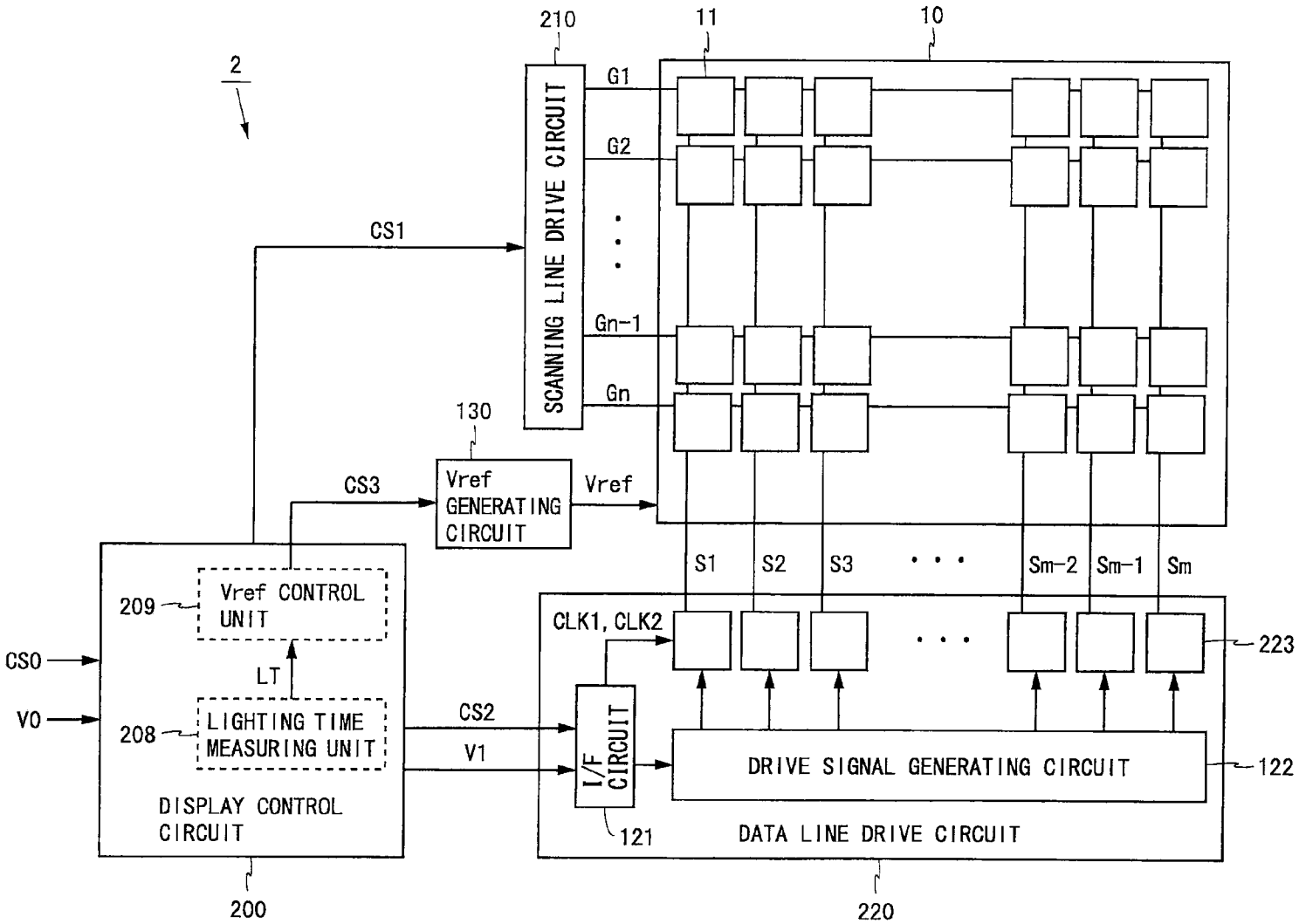
FIG. 15 is a block diagram showing a configuration of an organic EL display device according to a second embodiment of the present invention.

FIG. 15 is a block diagram showing a configuration of an organic EL display device according to a second embodiment of the present invention. An organic EL display device 2 shown in FIG. 15 includes a display unit 10, a display control circuit 200, a scanning line drive circuit 210, a data line drive circuit 220, and a Vref generating circuit 130. In the following, of the components of embodiments, the same components as those of the previously described embodiment are denoted by the same reference characters and description thereof is omitted.

As with the display control circuit 100 according to the first embodiment, the display control circuit 200 controls the scanning line drive circuit 210 and the data line drive circuit 220. In the organic EL display device 2, video data V1 may be the same as video data V0 or may be one obtained by performing a correction process, etc., on video data V0. The scanning line drive circuit 210 drives scanning lines G1 to Gn at different timing than the scanning line drive circuit 110 according to the first embodiment. The data line drive circuit 220 includes an interface circuit 121, a drive signal generating circuit 122, and m detection/correction output circuits 223, and drives data lines S1 to Sm.

A control signal CS2 which is supplied to the data line drive circuit 220 from the display control circuit 200 includes clocks CLK1 and CLK2. The detection/correction output circuits 223 operate according to the clocks CLK1 and CLK2. Each detection/correction output circuit 223 converts, into a voltage, a drive current flowing through a corresponding data line Si from a pixel circuit PX(i, j) and applies, to the data line Si, a voltage which is based on a voltage according to video data V1 and on the voltage obtained by the current-voltage conversion. In the present embodiment, a voltage outputted from a D/A converter 20 is referred to as data voltage Vdata.

Figure 16:
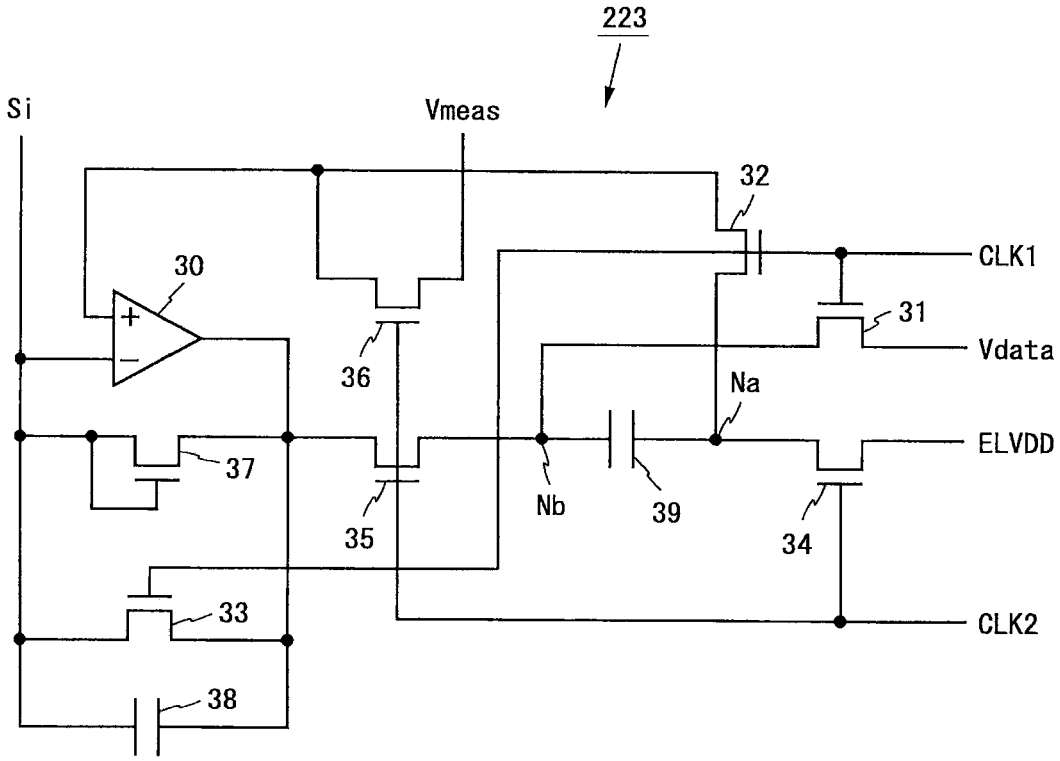
FIG. 16 is a circuit diagram of a detection/correction output circuit included in the organic EL display device shown in FIG. 15.

FIG. 16 is a circuit diagram of the detection/correction output circuit 223. FIG. 16 depicts a detection/correction output circuit 223 provided for a data line Si. The detection/correction output circuit 223 includes an operational amplifier 30, seven transistors 31 to 37, and two capacitors 38 and 39. The transistors 31 to 37 are all of an n-channel type. Note that instead of the n-channel transistors, p-channel transistors may be used or other switching elements may be used. In FIG. 16, the right terminal of the capacitor 39 is referred to as node Na, and the left terminal of the capacitor 39 is referred to as node Nb.

An inverting input terminal of the operational amplifier 30 is connected to the data line Si. One conduction terminal and a gate terminal of the transistor 37 are connected to the inverting input terminal of the operational amplifier 30, and the other conduction terminal of the transistor 37 is connected to an output terminal of the operational amplifier 30. The transistor 37 functions as a diode element. The transistor 33 is provided between the inverting input terminal and output terminal of the operational amplifier 30 and in parallel to the transistor 37. The clock CLK1 is provided to a gate terminal of the transistor 33. The transistor 37 functions as a current-voltage conversion element, and the transistor 33 functions as a function selection switch. The capacitor 38 is provided between the inverting input terminal and output terminal of the operational amplifier 30 and in parallel to the transistors 33 and 37. The capacitor 38 has the function of stabilizing the negative feedback of the operational amplifier 30.

One conduction terminal of the transistor 31 is connected to the node Nb, and a data voltage Vdata (an output voltage from a D/A converter 20) is provided to the other conduction terminal of the transistor 31. One conduction terminal of the transistor 32 is connected to the node Na, and the other conduction terminal of the transistor 32 is connected to a non-inverting input terminal of the operational amplifier 30. One conduction terminal of the transistor 34 is connected to the node Na, and a high-level power supply voltage ELVDD is provided to the other conduction terminal of the transistor 34. The transistor 35 is provided between the node Nb and the output terminal of the operational amplifier 30. One conduction terminal of the transistor 36 is connected to the non-inverting input terminal of the operational amplifier 30, and a measurement voltage Vmeas which is supplied from a power supply circuit (not shown) is provided to the other conduction terminal of the transistor 36. The clock CLK1 is provided to gate terminals of the transistors 31 and 32, and the clock CLK2 is provided to gate terminals of the transistors 34 to 36. The transistors 31, 32, and 34 to 36 function as a switching unit.

Figure 17:
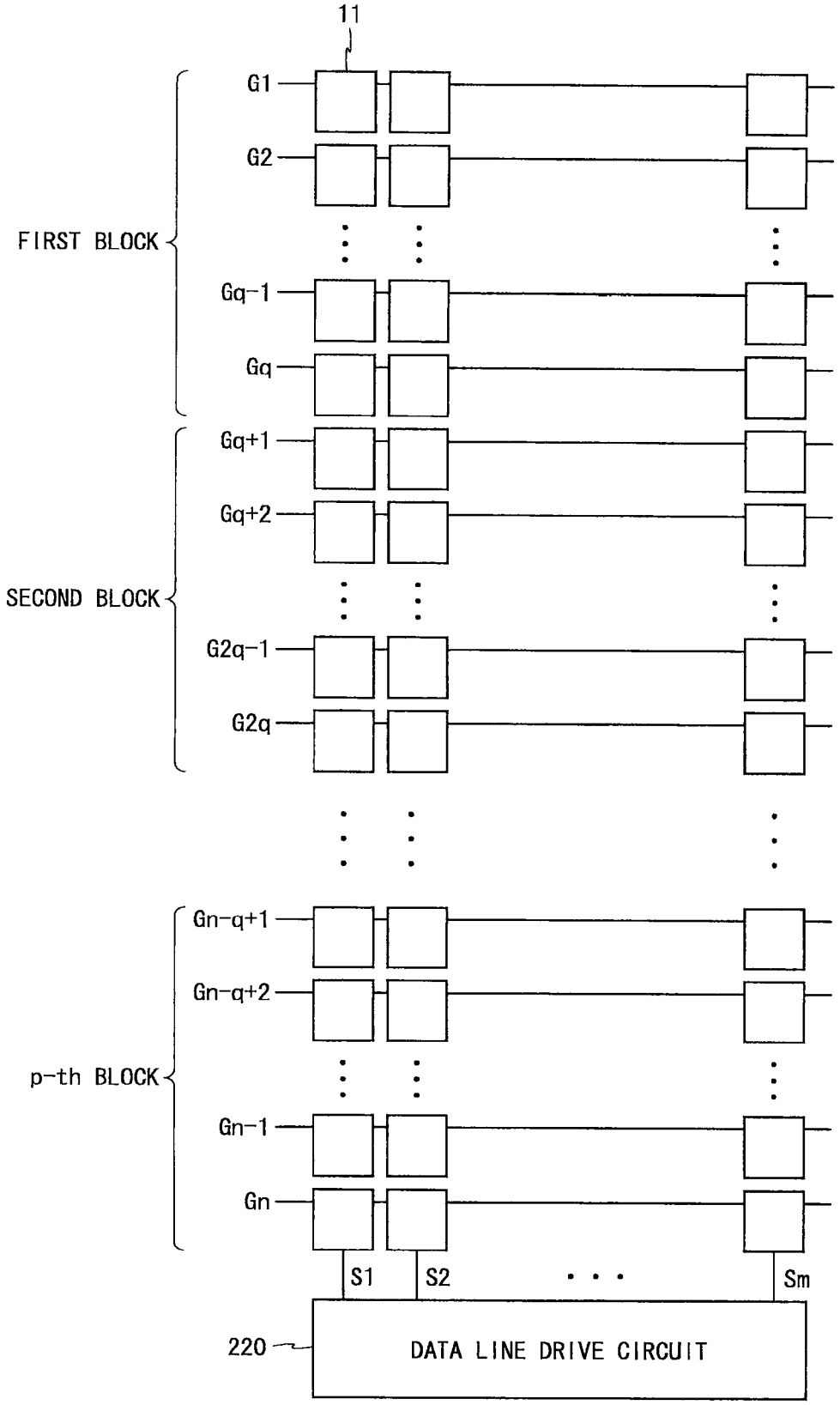
FIG. 17 is a diagram showing block division in the organic EL display device shown in FIG. 15.

In the organic EL display device 2, the scanning lines G1 to Gn are divided into one or more blocks, and drive currents are detected on a block-by-block basis. In the following, it is assumed that p is a divisor of n other than n, and q=n/p. FIG. 17 is a diagram showing block division in the organic EL display device 2. As shown in FIG. 17, the scanning lines G1 to Gn are divided into p blocks, each including q scanning lines. A first block includes scanning lines G1 to Gq, a second block includes scanning lines Gq+1 to G2*q*, and a p-th block includes scanning lines Gn−q+1 to Gn. Note that the number of blocks p may be 1 and the number of scanning lines included in each block may vary between the blocks.

In the organic EL display device 2, p block selection periods are set in one frame period, and a common selection period and a scanning period are set in each block selection period. For each block, the scanning line drive circuit 210 selects q scanning lines in the block collectively during the common selection period, and selects the q scanning lines in the block in turn during the scanning period. The scanning line drive circuit 210 switches which block to select, for every block selection period. For each block, the data line drive circuit 220 converts currents flowing through the data lines Si into voltages during the common selection period, and applies voltages which are based on data voltages Vdata and on the voltages obtained during the common selection period, to the data lines Si during the scanning period.

Figure 18:
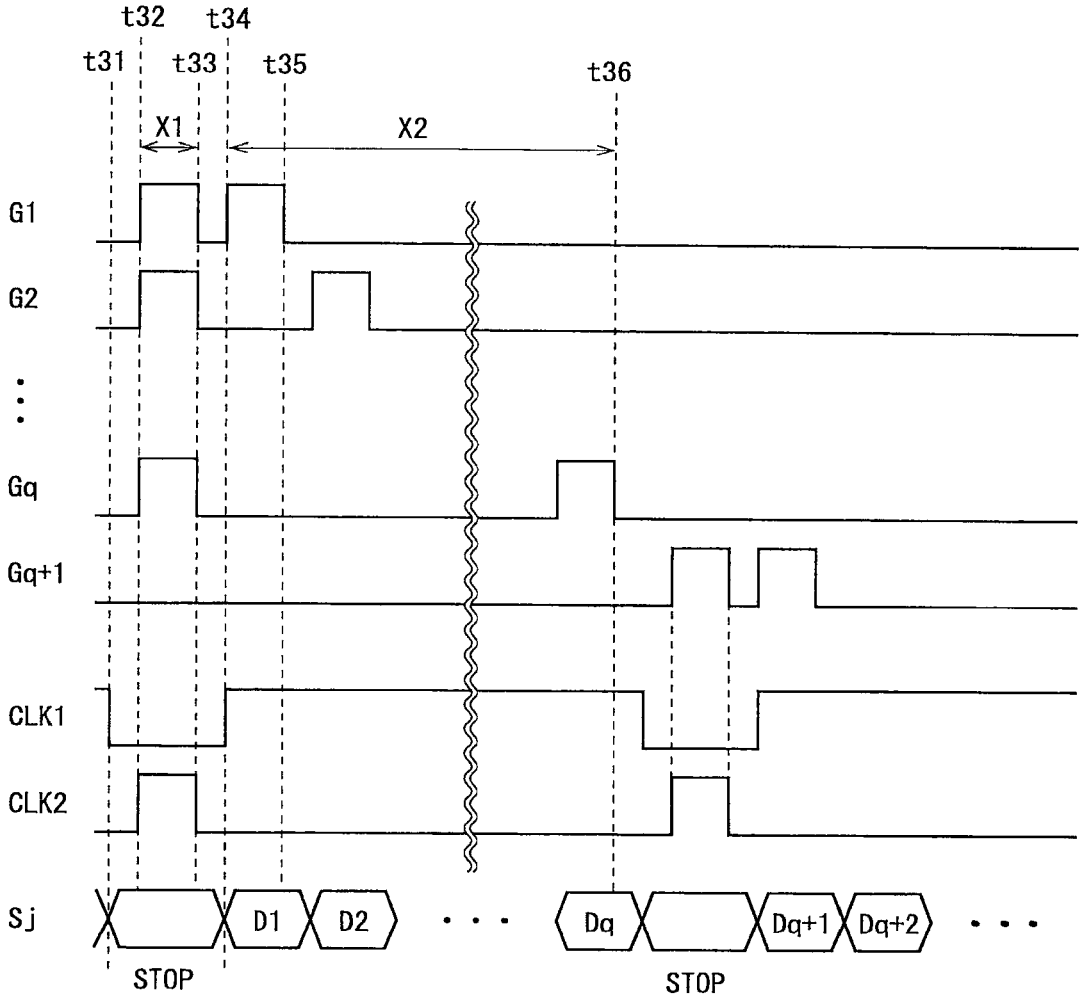
FIG. 18 is a timing chart showing changes in signals in the organic EL display device shown in FIG. 15.

FIG. 18 is a timing chart showing changes in signals in the organic EL display device 2. In FIG. 18, time t32 to t36 is a first-block selection period, time t32 to t33 is a common selection period X1, and time t34 to t36 is a scanning period X2. In FIG. 18, Dj indicates a corrected data voltage to be written to a pixel circuit PX(i, j). The q pixel circuits 11 arranged in the first to q-th rows and in an i-th column are hereinafter collectively referred to as pixel circuits PX(i, 1:q).

Prior to time t31, scanning signals G1 to Gq and the clock CLK2 are at a low level, and the clock CLK1 is at a high level. At this time, in each of the pixel circuits PX(i, 1:q), transistors T2 and T3 are in an off state, and a drive current according to a voltage held in a capacitor C1 flows through a transistor T1 and an organic EL element L1. The organic EL element L1 emits light at a luminance according to the drive current flowing through at this time. At time t31, the clock CLK1 changes to the low level. Accordingly, transistors 31 to 33 are turned off.

At time t32, the scanning signals G1 to Gq change to the high level. Accordingly, the transistors T2 and T3 in each of the pixel circuits PX(i, 1:q) are turned on. In addition, at time t32, the clock CLK2 changes to the high level. Accordingly, the transistors 34 to 36 are turned on. Hence, the high-level power supply voltage ELVDD is provided to the node Na, the output terminal of an operational amplifier 30 is connected to the node Nb, and the measurement voltage Vmeas is provided to the non-inverting input terminal of the operational amplifier 30. Therefore, the data line Si which is connected to the inverting input terminal of the operational amplifier 30 is charged to the measurement voltage Vmeas by a virtual short circuit. Hence, similarly in FIG. 8, in each of the pixel circuits PX(i, 1:q), the measurement voltage Vmeas is provided to one end (lower terminal) of the capacitor C1 via the transistor T3, and the reference voltage Vref is provided to the other end (upper terminal) of the capacitor C1 via the transistor T2. Therefore, during the common selection period X1, the capacitor C1 in each of the pixel circuits PX(i, 1:q) is charged to a voltage Vgsa shown in the following equation (20):

$$Vgsa = Vref - Vmeas \tag{20}$$

Note that when the light-emission threshold voltage of the organic EL element L1 is Vth_L1, the measurement voltage Vmeas is determined so as to satisfy the following equation (21):

$$Vmeas < ELVSS + Vth_L1 \tag{21}$$

At this time, the transistor 33 is in an off state, and thus, the operational amplifier 30 and the transistor 37 function as a transimpedance circuit. More specifically, during the common selection period X1, a drive current according to the voltage Vgsa shown in the equation (20) flows through the data line Si from each of the q pixel circuits PX(i, 1:q). The drive currents having flowed through the data line Si from the q pixel circuits PX(i, 1:q) all flow through the transistor 37, and the transistor 37 converts the drive currents into a voltage. The voltage obtained at this time is an output voltage from the operational amplifier 30.

Here, it is assumed that the threshold voltage of the transistor T1 is Vtha, the gain of the transistor T1 is βa, the threshold voltage of the transistor 37 is Vthb, the gain of the transistor 37 is βb, and the gate-source voltage of the transistor 37 during the common selection period X1 is Vgsb. A current Ia flowing through the transistor T1 during the common selection period X1 is given by the following equation (22), and a current Ib flowing through the transistor 37 during the common selection period X1 is given by the following equation (23):

$$Ia = (\beta a/2) \times (Vgsa - Vtha)^2 \tag{22}$$

$$Ib = (\beta b/2) \times (Vgsb - Vthb)^2 \tag{23}$$

Assuming that the currents Ia in the pixel circuits PX(i, 1:q) are equal to each other, q×Ia=Ib holds. In addition, it is assumed that the gain βb is q times the gain βa (q×βa=βb). At this time, the voltage Vgsb is given by the following equation (24), and an output voltage Vout from the operational amplifier 30 is given by the following equation (25):

$$Vgsb = Vgsa - Vtha + Vthb = Vref - Vmeas - Vtha + Vthb \quad (24)$$

$$Vout = Vmeas - Vgsb = 2Vmeas - Vref + Vtha - Vthb \quad (25)$$

Furthermore, it is assumed that the threshold voltage Vthb does not have variations or deterioration over time. Since all terms included in the equation (25) except for Vtha are constants, the output voltage Vout from the operational amplifier 30 changes according only to the threshold voltage Vtha of the transistor T1. The output voltage Vout from the operational amplifier 30 is provided to the node Nb, and the high-level power supply voltage ELVDD is provided to the node Na via the transistor 34. Therefore, during the common selection period X1, the capacitor 39 is charged to a voltage Vd shown in the following equation (26):

$$Vd = Vout - ELVDD = 2Vmeas - Vref - ELVDD + Vtha - Vthb \quad (26)$$

At time t33, the scanning signals G1 to Gq and the clock CLK2 change to the low level. Accordingly, in each of the pixel circuits PX(i, 1:q), the transistors T2 and T3 are turned off and the voltage Vgsa shown in the equation (20) is held in the capacitor C1. In the detection/correction output circuit 223, the transistors 34 to 36 are turned off, and the voltage Vd shown in the equation (26) is held in the capacitor 39.

At time t34, the clock CLK1 changes to the high level. Accordingly, the transistors 31 to 33 are turned on. After time t34, the operational amplifier 30 functions as a buffer amplifier, and the data voltage Vdata is provided to the node Nb via the transistor 31. Therefore, a corrected data voltage Vcd shown in the following equation (27) is provided to the data line Si from the operational amplifier 30.

$$Vcd = Vdata - Vd = Vdata - 2Vmeas + Vref + ELVDD - Vtha + Vthb \quad (27)$$

In addition, at time t34, the scanning signal G1 changes to the high level. Accordingly, the transistors T2 and T3 in a pixel circuit PX(i, 1) are turned on. Hence, the voltage Vcd shown in the equation (27) is provided to one end (lower terminal in the drawing) of the capacitor C1 via the transistor T3, and the reference voltage Vref is provided to the other end (upper terminal in the drawing) of the capacitor C1 via the transistor T2. Therefore, during time t34 to t35, the capacitor C1 is charged to a voltage Vgs shown in the following equation (28):

$$Vgs = Vref - Vcd = -Vdata + 2Vmeas - ELVDD + Vtha - Vthb \quad (28)$$

At time t35, the scanning signal G1 changes to the low level. Accordingly, the transistors T2 and T3 in the pixel circuit PX(i, 1) are turned off. After time t35, in the pixel circuit PX(i, 1), the voltage Vgs shown in the equation (28) is held in the capacitor C1, a current IL1 shown in the following equation (29) flows through the transistor T1 and the organic EL element L1, and the organic EL element L1 emits light at a luminance according to the current IL1.

$$IL1 = (\beta a/2) \times (Vgs - Vtha)^2 = (\beta a/2) \times (-Vdata + 2Vmeas - ELVDD - Vthb)^2 \quad (29)$$

In the equation (29), all terms except for (−Vdata) are constants, and thus, the current IL1 shown in the equation (29) does not depend on the threshold voltage Vtha of the transistor T1. Therefore, according to the organic EL display device 2, threshold voltage compensation of the transistor T1 can be performed.

During time t35 to t36, the scanning signals G2 to Gq become the high level in turn. By this, corrected data voltages are written in turn to the pixel circuits 11 arranged in the second to q-th rows. In this manner, the organic EL display device 2 performs threshold voltage compensation of the drive transistors T1. Note that, in the above description, the scanning line drive circuit 210 selects all scanning lines in a block collectively during the common selection period, but may select some scanning lines in the block collectively during the common selection period.

Control of the reference voltage Vref of the organic EL display device 2 will be described below. As shown in FIG. 15, the display control circuit 200 includes a lighting time measuring unit 208 and a Vref control unit 209. The lighting time measuring unit 208 measures the operating time of the organic EL display device 2 (i.e., the cumulative lighting time of the organic EL elements L1), and outputs the measured cumulative lighting time LT. The Vref control unit 209 determines a level of the reference voltage Vref based on the cumulative lighting time LT measured by the lighting time measuring unit 208. For example, the Vref control unit 209 sets a higher reference voltage Vref for longer cumulative lighting time LT. The display control circuit 200 outputs, to the Vref generating circuit 130, a control signal CS3 indicating the level of the reference voltage Vref which is determined by the Vref control unit 209.

As shown above, the organic EL display device 2 according to the present embodiment includes the display control circuit 200 that measures cumulative lighting time LT and controls the reference voltage Vref based on the measured cumulative lighting time LT. In addition, the characteristics of the drive transistor T1 change according to the cumulative lighting time LT. Therefore, according to the organic EL display device 2 according to the present embodiment, by suitably controlling the reference voltage Vref based on the cumulative lighting time LT, even when the threshold voltage of the drive transistor T1 is changed, a change in the amount of drive current flowing through the drive transistor T1 is suppressed, enabling to detect the drive current with a high accuracy. In addition, upon current detection (common selection period X1), a change in the end-to-end voltage of an electro-optical element (organic EL element L1) is suppressed to prevent an unwanted current from flowing through the electro-optical element. By this, the drive current can be detected with a high accuracy.

In addition, in the organic EL display device 2, the scanning lines G1 to Gn are divided into one or more blocks. For each block, the scanning line drive circuit 210 selects all or some of the scanning lines in the block collectively during a first period (common selection period), and selects all scanning lines in the block in turn during a second period (scanning period). For each block, the data line drive circuit 220 converts currents outputted external to the pixel circuits 11 into voltages during the first period, and applies voltages which are based on voltages Vdata according to video data and on the voltages obtained during the first period, to the data lines Si during the second period. By thus detecting currents outputted external to the pixel circuits 11, on a block-by-block basis, the time required for current detection can be reduced.

Two types of variants of the organic EL display device 2 according to the second embodiment will be described below. An organic EL display device according to a first variant changes a block division method between frame periods. In the organic EL display device according to the first variant, the scanning lines G1 to Gn are divided into p blocks by the method shown in FIG. 17 during an N-th frame period, and are divided into (p+1) blocks by a method shown in FIG. 19 during an (N+1)th frame period. In the block division shown in FIG. 19, a first block includes scanning lines G1 to Gq/2, a second block includes scanning lines Gq/2+1 to G3*q*/2, and a (p+1)th block includes scanning lines Gn−q/2+1 to Gn. In the organic EL display device according to the first variant, a frame period where block division is performed by the method shown in FIG. 17 and a frame period where block division is performed by the method shown in FIG. 19 appear alternately.

If the same block division is performed at all times when the in-block mean value of the threshold voltages of the drive transistors T1 differs between blocks, a luminance boundary caused by the difference between in-block mean values may appear on a display screen. According to the organic EL display device according to the first variant, by changing the block division method between frame periods, the appearance of the luminance boundary on a display screen can be prevented.

Figure 19:
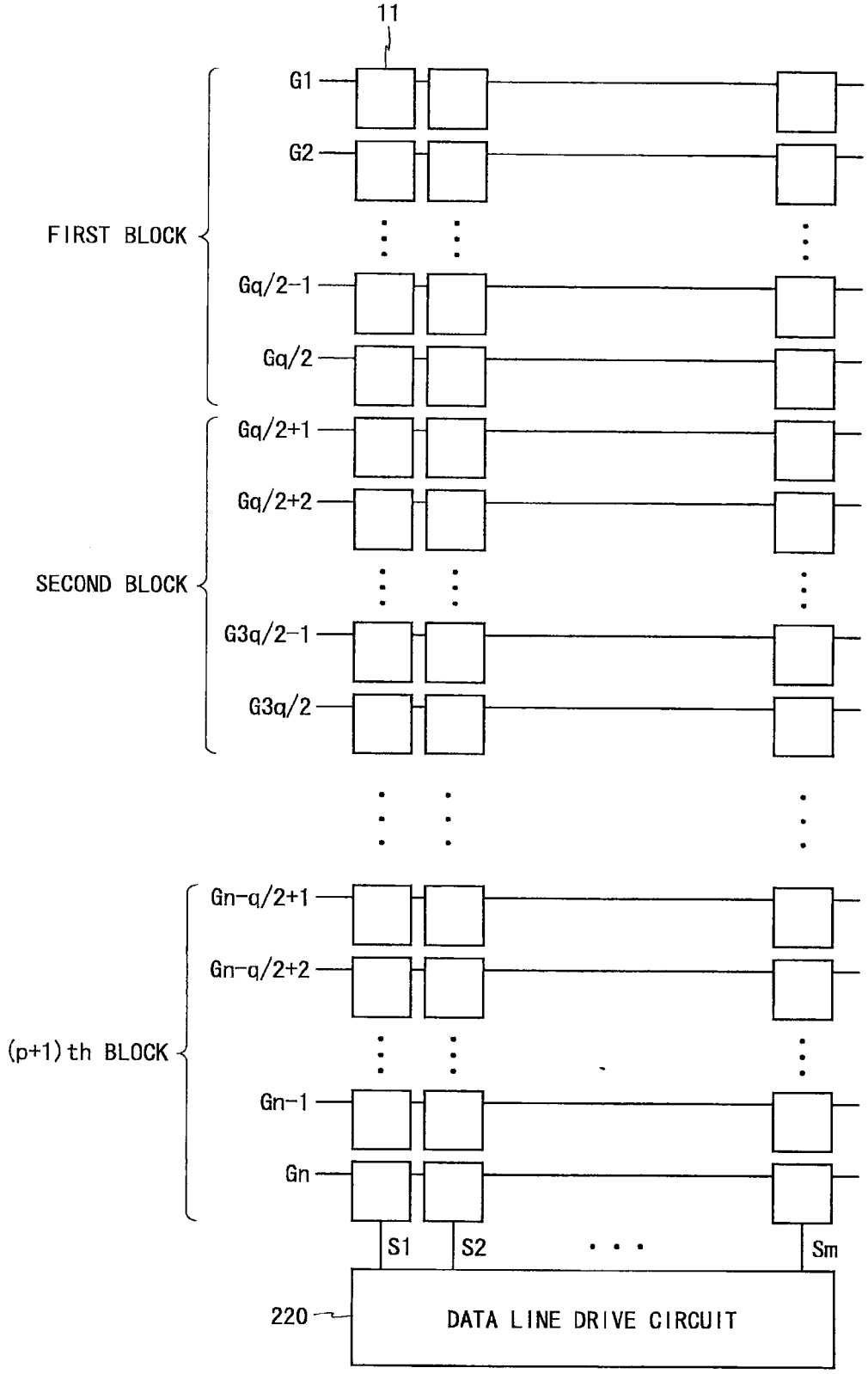
FIG. 19 is a diagram showing block division in an organic EL display device according to a first variant of the second embodiment of the present invention.

Note that the organic EL display device according to the first variant may change the block division method in three or more ways, or may change the block division method for every plurality of frame periods, or may perform block division other than those shown in FIGS. 17 and 19.

Figure 20:
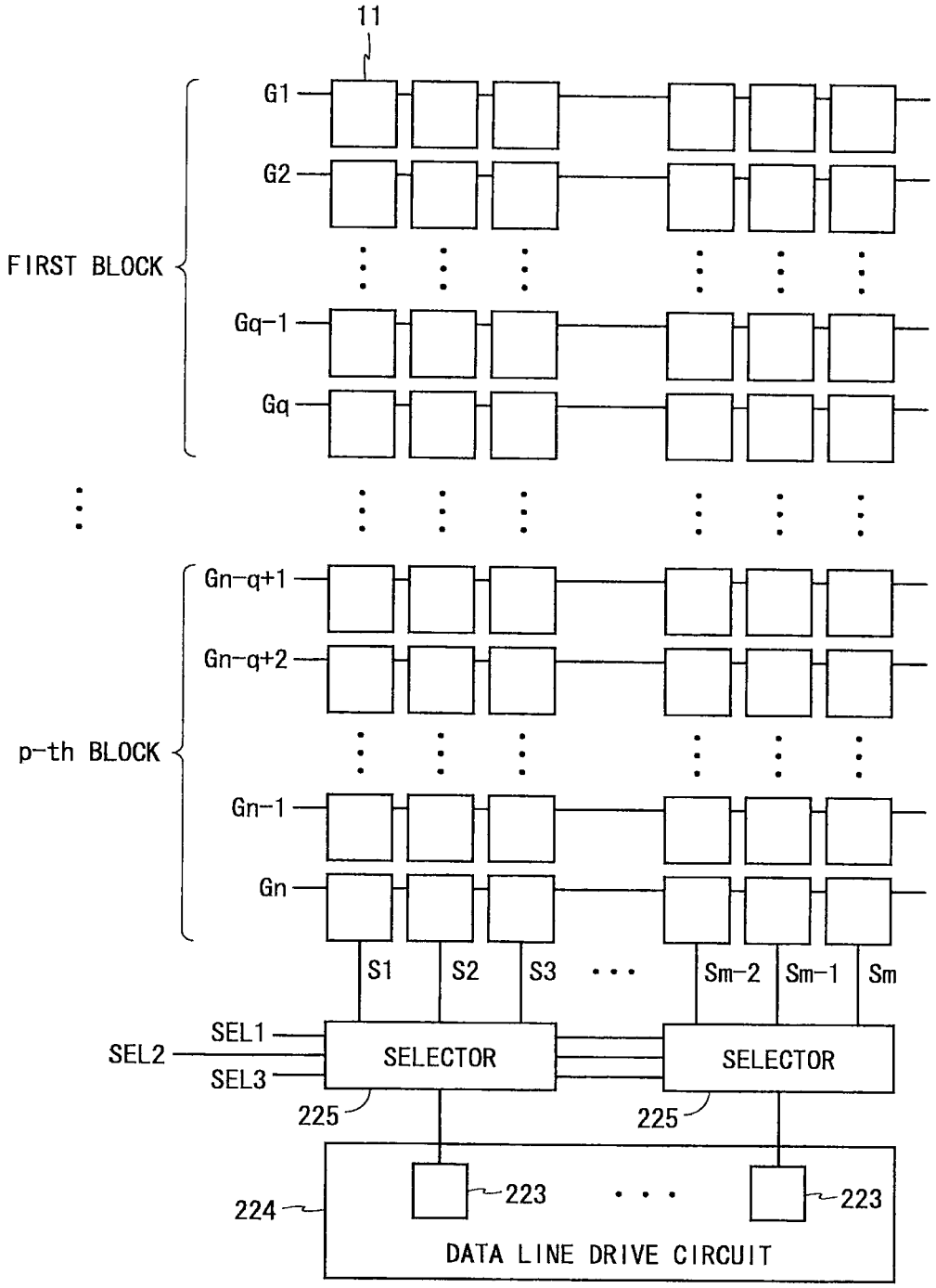
FIG. 20 is a diagram showing a connection style between a data line drive circuit and data lines in an organic EL display device according to a second variant of the second embodiment of the present invention.

FIG. 20 is a diagram showing a connection style between a data line drive circuit and data lines of an organic EL display device according to a second variant. The organic EL display device according to the second variant includes a data line drive circuit 224 shown in FIG. 20. The data line drive circuit 224 includes (m/x) detection/correction output circuits 223 which are provided for m data lines. In addition, the organic EL display device according to the second variant includes (m/x) selectors 225. Note that x is an integer greater than or equal to 2 and less than m. In the following description, x=3.

Each detection/correction output circuit 223 is connected to three data lines via the selector 225. The selector 225 operates according to selection control signals SEL1 to SEL3 outputted from a display control circuit (not shown). When the selection control signal SEL1 is at a high level, the detection/correction output circuit 223 and a first data line are electrically connected to each other. When the selection control signal SEL2 is at the high level, the detection/correction output circuit 223 and a second data line are electrically connected to each other. When the selection control signal SEL3 is at the high level, the detection/correction output circuit 223 and a third data line are electrically connected to each other.

Figure 21:
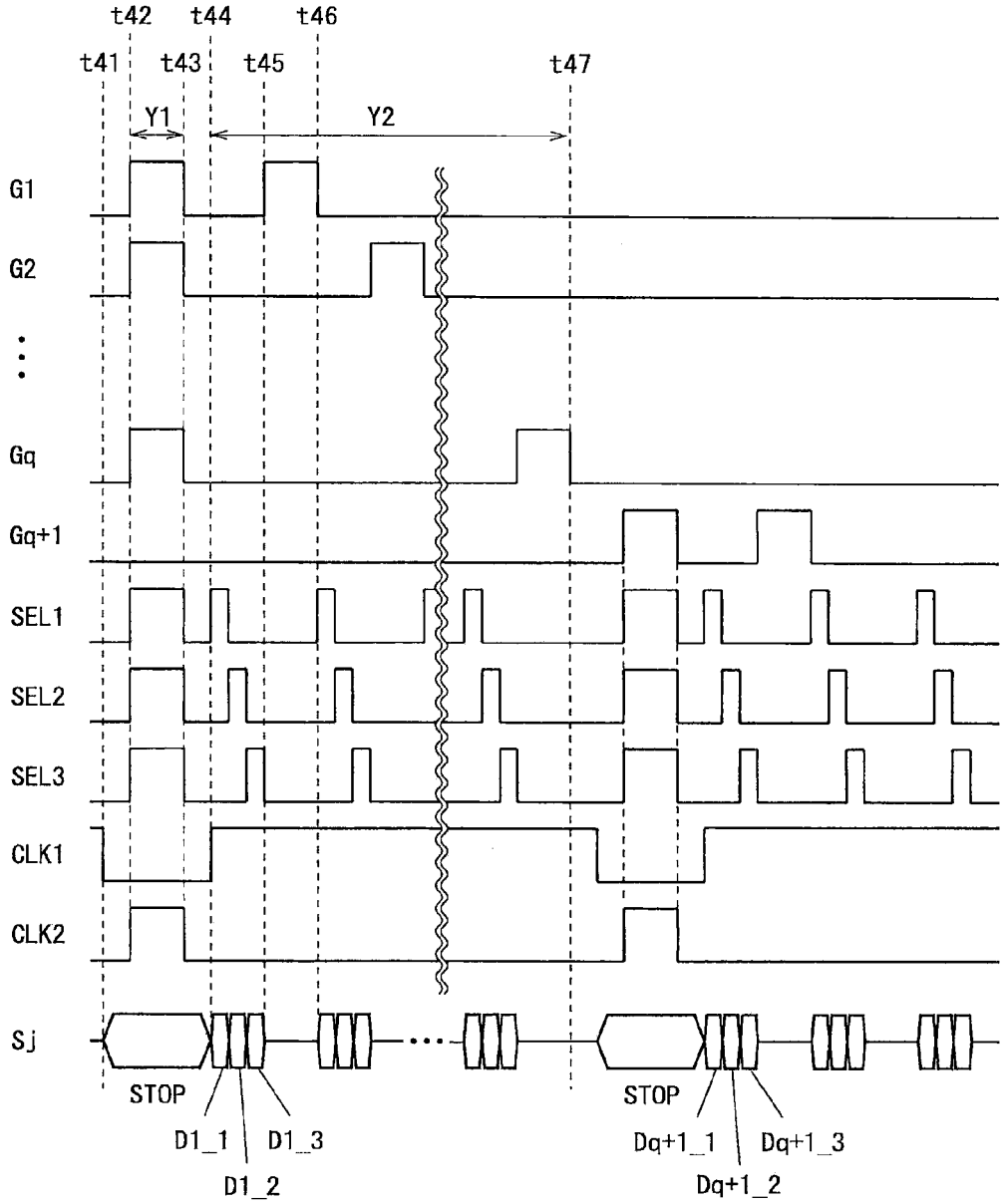
FIG. 21 is a timing chart showing changes in signals in the organic EL display device according to the second variant of the second embodiment of the present invention.

FIG. 21 is a timing chart showing changes in signals in the organic EL display device according to the second variant. In FIG. 21, time t42 to t47 is a first-block selection period, time t42 to t43 is a common selection period Y1, and time t44 to t47 is a scanning period Y2.

During the common selection period Y1, the selection control signals SEL1 to SEL3 are at the high level. Hence, during the common selection period Y1, the process for the common selection period X1 in the organic EL display device 2 according to the second embodiment (the process performed on q pixel circuits arranged side by side in a column) is performed on 3*q* pixel circuits 11 arranged side by side in three columns. Therefore, the capacitor 39 is charged to a voltage according to the threshold voltages of the drive transistors in the 3*q* pixel circuits 11.

During time t44 to t45, the selection control signals SEL1 to SEL3 become the high level in turn. When the selection control signal SEL1 is at the high level, the detection/correction output circuit 223 is connected to a data line S1, and the data line S1 is charged to a corrected data voltage D1_1. When the selection control signal SEL2 is at the high level, the detection/correction output circuit 223 is connected to a data line S2, and the data line S2 is charged to a corrected data voltage D1_2. When the selection control signal SEL3 is at the high level, the detection/correction output circuit 223 is connected to a data line S3, and the data line S3 is charged to a corrected data voltage D1_3.

According to the organic EL display device according to the second variant, by providing the detection/correction output circuits 223, each provided for a plurality of data lines, the circuit size of the data line drive circuit 224 can be reduced.

Third Embodiment

Figure 22:
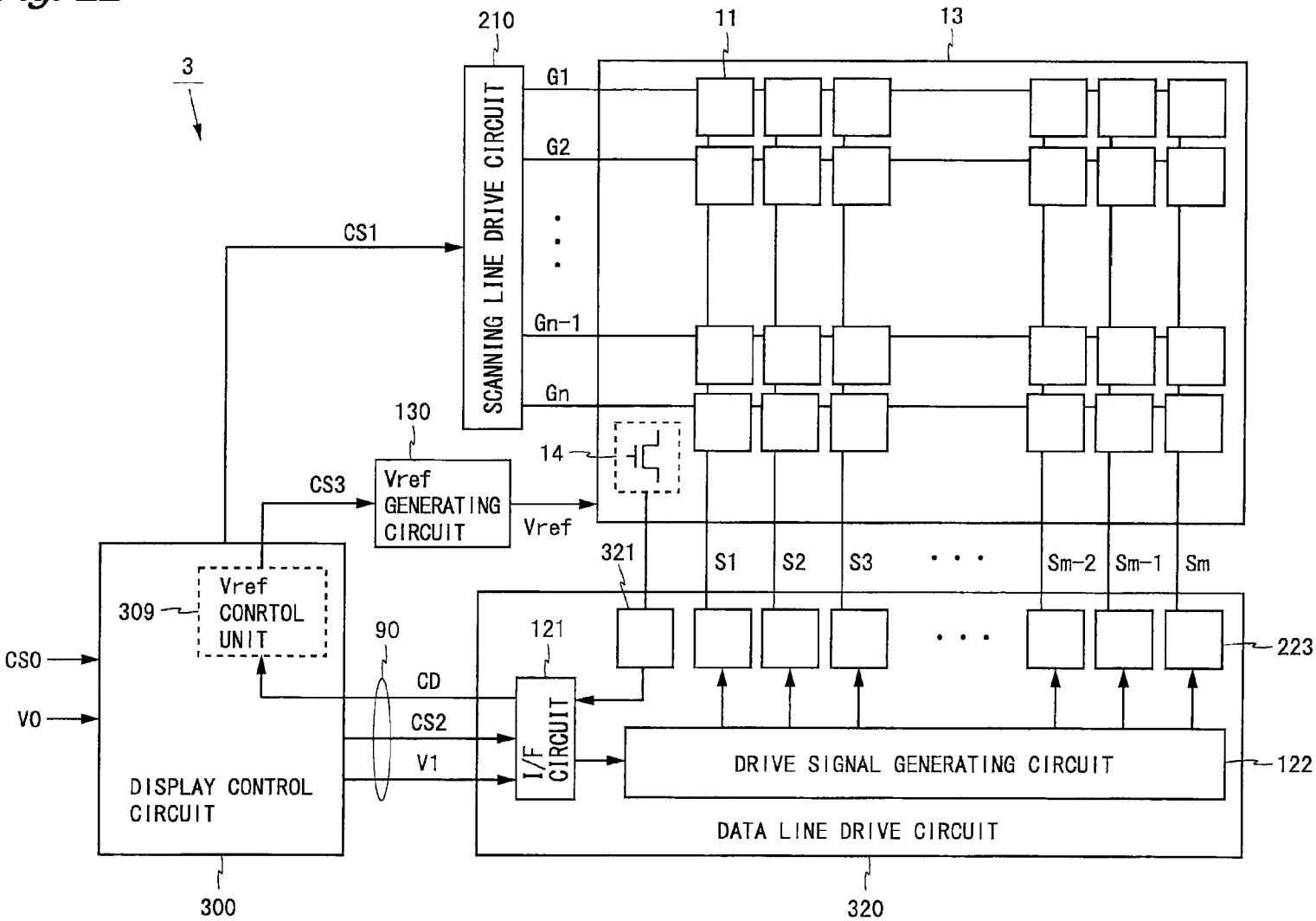
FIG. 22 is a block diagram showing a configuration of an organic EL display device according to a third embodiment of the present invention.

FIG. 22 is a block diagram showing a configuration of an organic EL display device according to a third embodiment of the present invention. An organic EL display device 3 shown in FIG. 22 includes a display unit 13, a display control circuit 300, a scanning line drive circuit 210, a data line drive circuit 320, and a Vref generating circuit 130.

The display unit 13 is such that a characteristic detection transistor 14 is added to the display unit 10 according to the first embodiment. The data line drive circuit 320 is such that a characteristic detection circuit 321 is added to the data line drive circuit 220 according to the second embodiment. The characteristic detection circuit 321 is connected to the characteristic detection transistor 14 and detects a characteristic (e.g., threshold voltage) of the characteristic detection transistor 14. The data line drive circuit 320 outputs, to the display control circuit 300, characteristic data CD representing the characteristic of the characteristic detection transistor 14 which is detected by the characteristic detection circuit 321.

The display control circuit 300 includes a Vref control unit 309. The Vref control unit 309 determines a level of a reference voltage Vref based on the characteristic data CD. For example, the Vref control unit 309 increases the level of the reference voltage Vref when the threshold voltage of the characteristic detection transistor 14 is high, and decreases the level of the reference voltage Vref when the threshold voltage of the characteristic detection transistor 14 is low. The display control circuit 300 outputs, to the Vref generating circuit 130, a control signal CS3 indicating the level of the reference voltage Vref which is determined by the Vref control unit 309.

As shown above, the display unit 13 of the organic EL display device 3 according to the present embodiment includes the characteristic detection transistor 14. In addition, the organic EL display device 3 includes the display control circuit 300 that controls the reference voltage Vref based on the characteristic of the characteristic detection transistor 14. Therefore, according to the organic EL display device 3 according to the present embodiment, by suitably controlling the reference voltage Vref based on the characteristic of the characteristic detection transistor 14, even when the threshold voltage of the drive transistor T1 is changed, a change in the amount of drive current flowing through the drive transistor T1 is suppressed, enabling to detect the drive current with a high accuracy. In addition, upon current detection (common selection period X1), a change in the end-to-end voltage of an electro-optical element (organic EL element L1) is suppressed to prevent an unwanted current from flowing through the electro-optical element. By this, the drive current can be detected with a high accuracy.

Fourth Embodiment

Figure 23:
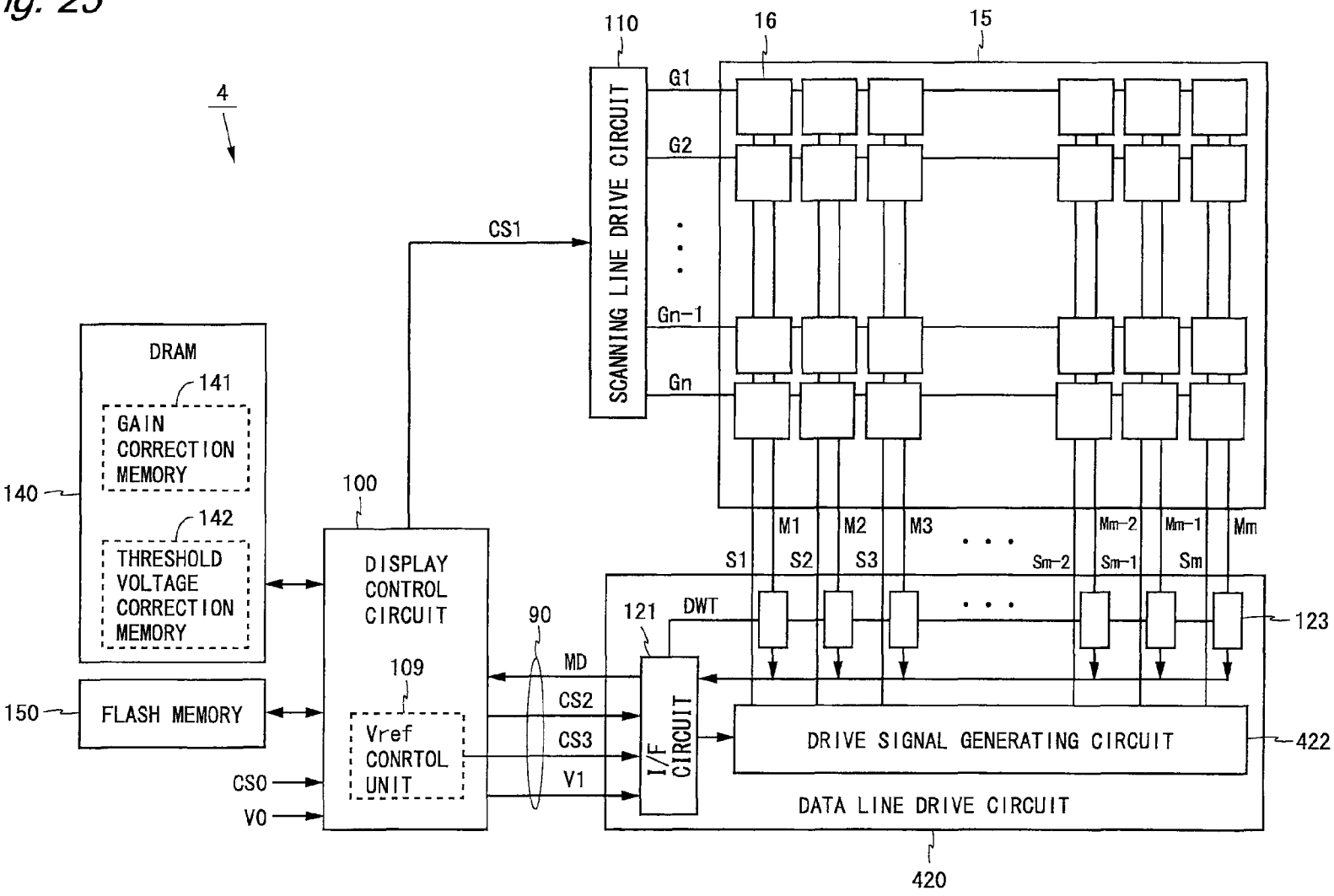
FIG. 23 is a block diagram showing a configuration of an organic EL display device according to a fourth embodiment of the present invention.

FIG. 23 is a block diagram showing a configuration of an organic EL display device according to a fourth embodiment of the present invention. An organic EL display device 4 shown in FIG. 23 includes a display unit 15, a display control circuit 100, a scanning line drive circuit 110, a data line drive circuit 420, a DRAM 140, and a flash memory 150.

The display unit 15 includes n scanning lines G1 to Gn, m data lines S1 to Sm, m monitoring lines M1 to Mm, and (m×n) pixel circuits 16. The data lines S1 to Sm, the scanning lines G1 to Gn, and the (m×n) pixel circuits 16 are arranged in a similar manner to the display unit 10 according to the first embodiment. The monitoring lines M1 to Mm are arranged in parallel to the data lines S1 to Sm. To supply a high-level power supply voltage ELVDD and a low-level power supply voltage ELVSS to the pixel circuits 16, the display unit 15 is provided with high-level power supply lines and low-level power supply lines (both of which are not shown). The display unit 15 does not have reference voltage lines. In the organic EL display device 4, the display control circuit 100 outputs a control signal CS3 to the data line drive circuit 420 using a communication bus 90.

Figure 24:
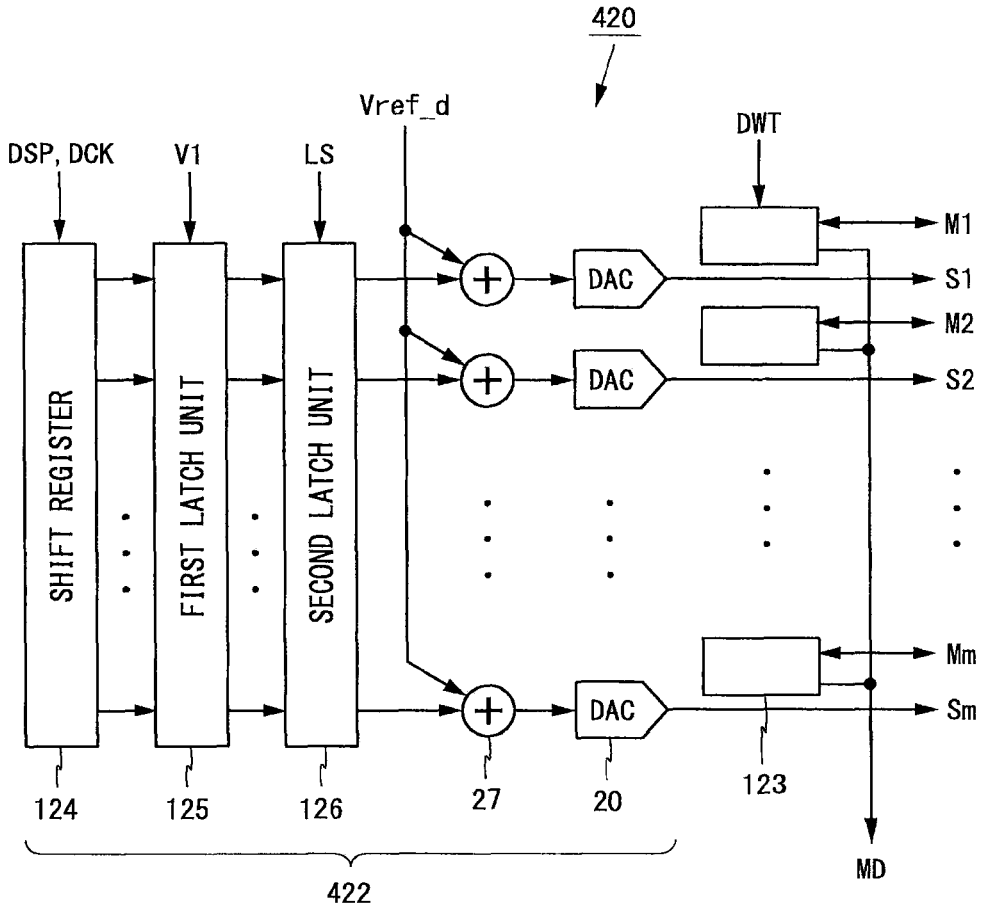
FIG. 24 is a block diagram showing details of a data line drive circuit shown in FIG. 23.

FIG. 24 is a block diagram showing details of the data line drive circuit 420. The data line drive circuit 420 includes an interface circuit 121 (not shown), a drive signal generating circuit 422, and m voltage output/current measurement circuits 123. The data line drive circuit 420 drives the data lines S1 to Sm and detects drive currents having flowed through the monitoring lines M1 to Mm from the pixel circuits 16.

The drive signal generating circuit 422 is such that m adders 27 are added to the drive signal generating circuit 122 according to the first embodiment. Each adder 27 is provided for any one of m latch circuits included in a second latch unit 126 and any one of m D/A converters 20. The data line drive circuit 420 obtains reference voltage data Vref_d representing the value of a reference voltage Vref, based on the control signal CS3. Each adder 27 adds video data held in a corresponding latch circuit to the reference voltage data Vref_d. Each D/A converter 20 outputs a voltage according to the value determined by a corresponding adder 27. From the D/A converter 20 is outputted a voltage {Vm(i, j, P)+Vref} obtained by adding the reference voltage to the data voltage.

Each voltage output/current measurement circuit 123 is connected to any one of the monitoring lines M1 to Mm. When an input/output control signal DWT is at a high level, each voltage output/current measurement circuit 123 fixedly applies the low-level power supply voltage ELVSS to a corresponding monitoring line Mi. When the input/output control signal DWT is at a low level, the voltage output/current measurement circuit 123 measures a drive current having flowed through the monitoring line Mi from a pixel circuit PX(i, j), and outputs measurement data MD representing the result of the measurement.

Figure 25:
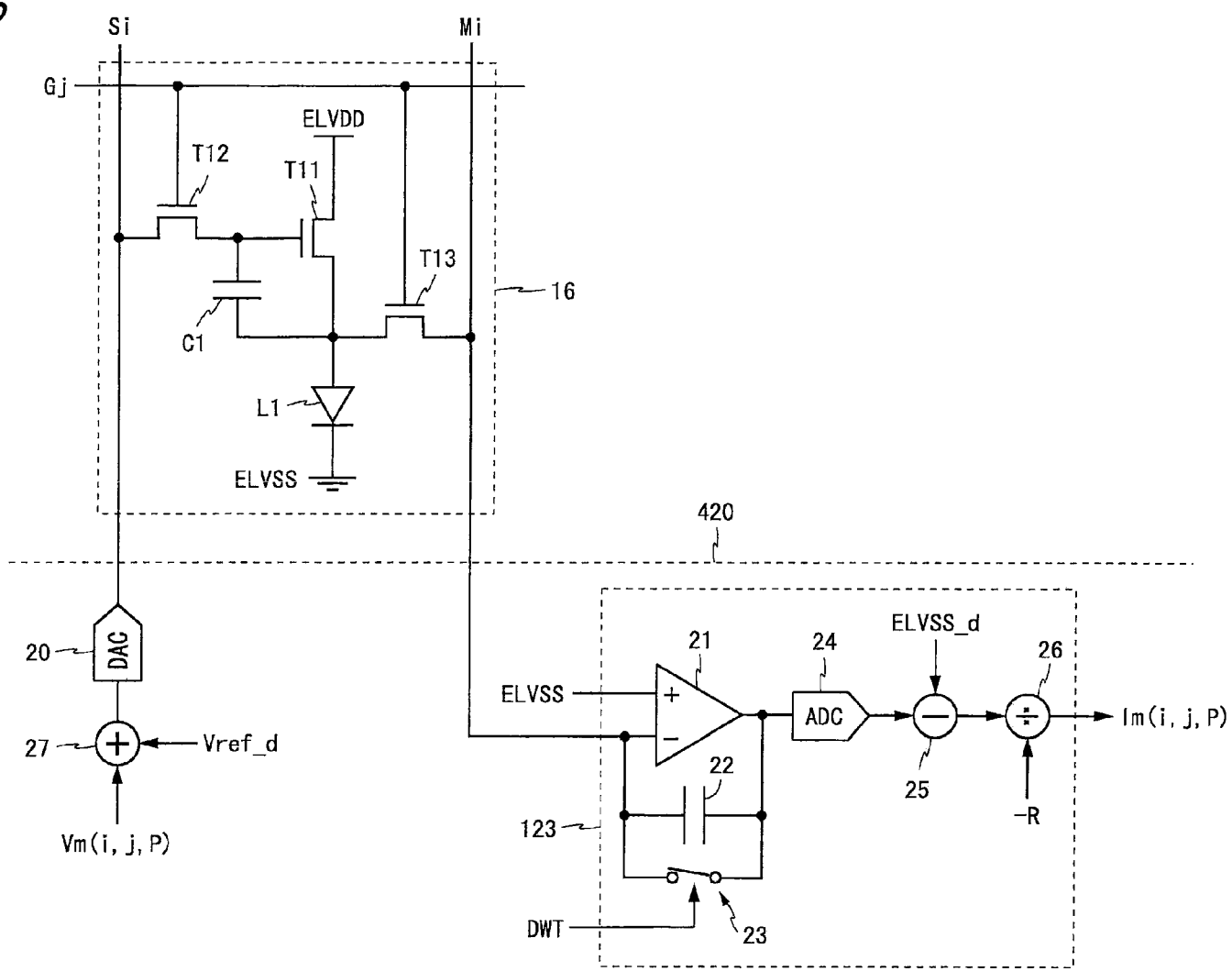
FIG. 25 is a circuit diagram of a pixel circuit and a voltage output/current measurement circuit which are included in the organic EL display device shown in FIG. 23.

FIG. 25 is a circuit diagram of the pixel circuit 16 and the voltage output/current measurement circuit 123. FIG. 25 depicts a pixel circuit PX(i, j), an adder 27 provided for a data line Si, a D/A converter 20 provided for the data line Si, and a voltage output/current measurement circuit 123 provided for a monitoring line Mi.

The pixel circuit 16 includes an organic EL element L1, three transistors T11 to T13, and a capacitor C1. The transistors T11 to T13 are all of an n-channel type. The transistors T11 to T13 are, for example, oxide TFTs in which a semiconductor layer includes an oxide semiconductor of indium gallium zinc oxide, or the like. The transistors T11 to T13 function as a drive transistor, an input transistor, and an output transistor, respectively, and the capacitor C1 functions as a capacitive element.

The transistor T11 is connected in series with the organic EL element L1 and provided between a high-level power supply line that supplies the high-level power supply voltage ELVDD and a low-level power supply line that supplies the low-level power supply voltage ELVSS. A drain terminal of the transistor T11 is connected to the high-level power supply line, and a source terminal of the transistor T11 is connected to an anode terminal of the organic EL element L1. A cathode terminal of the organic EL element L1 is connected to the low-level power supply line. The transistor T12 is provided between the data line Si and a gate terminal of the transistor T11. The transistor T13 is provided between the monitoring line Mi and the source terminal of the transistor T11. Gate terminals of the transistors T12 and T13 are connected to a scanning line Gj. The capacitor C1 is provided between the gate terminal and source terminal of the transistor T11.

The voltage output/current measurement circuit 123 is connected in a different manner than in the first embodiment. In the present embodiment, an inverting input terminal of an operational amplifier 21 is connected to the monitoring line Mi, and the low-level power supply voltage ELVSS is fixedly provided to a non-inverting input terminal of the operational amplifier 21. A digital value ELVSS_d corresponding to the low-level power supply voltage ELVSS is fixedly provided to one terminal of a subtractor 25. The subtractor 25 subtracts the digital value ELVSS_d from a digital value outputted from an A/D converter 24. Note that when the low-level power supply voltage ELVSS is zero, the subtractor 25 may be removed.

When an input/output control signal DWT is at a high level, a switch 23 is turned on. At this time, the operational amplifier 21 functions as a buffer amplifier, and provides the low-level power supply voltage ELVSS to the monitoring line Mi at a low output impedance. When the input/output control signal DWT is at a low level, the switch 23 is turned off and the operational amplifier 21 and a capacitor 22 function as an integrating amplifier. An output from a divider 26 at this time is Im(i, j, P) representing the value of a drive current passing through the transistor T11 and flowing through the monitoring line Mi.

The pixel circuit 16 and the voltage output/current measurement circuit 123 operate at the same timing as in the first embodiment (see FIGS. 6, 7, and 10). The input/output control signal DWT and the scanning signals G1 to Gn change at the timing shown in FIG. 6. During a video signal period (FIG. 7), since the input/output control signal DWT is always at the high level, the voltage output/current measurement circuit 123 provides the low-level power supply voltage ELVSS to the monitoring line Mi. During a program period A1, the scanning signal Gj becomes the high level and a voltage {Vm(i, j, P)+Vref} is applied to the data line Si. Hence, during the program period A1, the transistors T12 and T13 are turned on and the capacitor C1 is charged to a voltage {Vm(i, j, P)+Vref−ELVSS}. When the program period A1 ends and the scanning signal Gj becomes the low level, the transistors T12 and T13 are turned off and the voltage {Vm(i, j, P)+Vref−ELVSS} is held in the capacitor C1. Thereafter, the organic EL element L1 emits light at a luminance according to the voltage held in the capacitor C1.

During a vertical synchronization period (FIG. 10), the scanning signal Gj becomes the high level over five horizontal periods, and the input/output control signal DWT becomes the high level during first to third program periods B1, B3, and B5, and becomes the low level during first and second measurement periods B2 and B4. Hence, the operational amplifier 21 functions as a buffer amplifier during the first to third program periods B1, B3, and B5, and the operational amplifier 21 and the capacitor 22 function as an integrating amplifier during the first and second measurement periods B2 and B4. During the first program period B1, a voltage {Vm(i, j, P1)+Vref} obtained by adding the reference voltage to a data voltage corresponding to a first gradation value P1 is applied to the data line Si, and the capacitor C1 is charged to a voltage {Vm(i, j, P1)+Vref−ELVSS}. During the first measurement period B2, a drive current having passed through the transistor T11 flows through the monitoring line Mi. The voltage output/current measurement circuit 123 measures the drive current having flowed through the monitoring line Mi from the pixel circuit PX(i, j), and outputs first measurement data Im(i, j, P1) representing the value of the drive current. During the second and third program periods B3 and B5, a process similar to that for the first program period B1 is performed, and during the second measurement period B4, a process similar to that for the first measurement period B2 is performed.

As in the first embodiment, the display control circuit 100 performs the correction process shown in FIG. 12. A Vref control unit 109 determines a statistical value (e.g., mean value VM) of the threshold voltages of the drive transistors T11 based on data stored in a threshold voltage correction memory 142, and controls the reference voltage Vref based on the determined statistical value. In the organic EL display device 4, too, by controlling the reference voltage Vref, similar effects as those in the first embodiment can be obtained.

As shown above, in the organic EL display device 4 according to the present embodiment, the pixel circuit 16 includes an electro-optical element (organic EL element L1); and a drive transistor T11 provided in series with the electro-optical element. Upon current detection (first and second measurement periods B2 and B4), the data line drive circuit 420 provides, between the control terminal (gate terminal) and first conduction terminal (source terminal) of the drive transistor T11, a voltage (voltages {Vm(i, j, P1)+Vref−ELVSS} and {Vm(i, j, P2)+Vref−ELVSS}) which are according to a detection voltage (first and second measurement voltages Vm(i, j, P1) and Vm(i, j, P2)) and to a reference voltage Vref, and detects a drive current (first and second drive currents Im(i, j, P1) and Im(i, j, P2)) having passed through the drive transistor T11 and outputted external to the pixel circuit 16. The display control circuit 100 controls the reference voltage Vref. Therefore, according to the organic EL display device 4 according to the present embodiment, by suitably controlling the reference voltage Vref, even when the threshold voltage of the drive transistor T11 is changed, a change in the amount of drive current flowing through the drive transistor T11 is suppressed, enabling to detect the drive current with a high accuracy. In addition, upon current detection, a change in the end-to-end voltage of the electro-optical element is suppressed to prevent an unwanted current from flowing through the electro-optical element. By this, the drive current can be detected with a high accuracy.

In addition, the display unit 15 includes a plurality of monitoring lines M1 to Mm, and upon current detection, the data line drive circuit 420 provides, to a data line Si, a voltage (voltages {Vm(i, j, P1)+Vref} and {Vm(i, j, P2)+Vref}) obtained by adding the reference voltage Vref to the detection voltage, and detects a drive current having flowed through a monitoring line Mi from the pixel circuit 16. Therefore, in the display device having the monitoring lines M1 to Mm separately from the data lines S1 to Sm, by suitably controlling the reference voltage Vref by providing a voltage obtained by adding the reference voltage to the detection voltage to the data line Si, the drive current flowing through a monitoring line Mi can be detected with a high accuracy.

In addition, the pixel circuit 16 includes an input transistor T12 provided between the data line Si and the control terminal of the drive transistor T11 and having a control terminal (gate terminal) connected to a scanning line Gj; an output transistor T13 provided between the monitoring line Mi and the first conduction terminal of the drive transistor T11 and having a control terminal (gate terminal) connected to the scanning line Gj; and a capacitive element C1 provided between the control terminal and first conduction terminal of the drive transistor T11. Therefore, by controlling the reference voltage Vref in the pixel circuit 16 that has the capacitive element C1 between the control terminal and first conduction terminal of the drive transistor T11 and that is used by applying a voltage on the data line Si to one end of the capacitive element C1, the drive current can be detected with a high accuracy.

Fifth Embodiment

Figure 26:
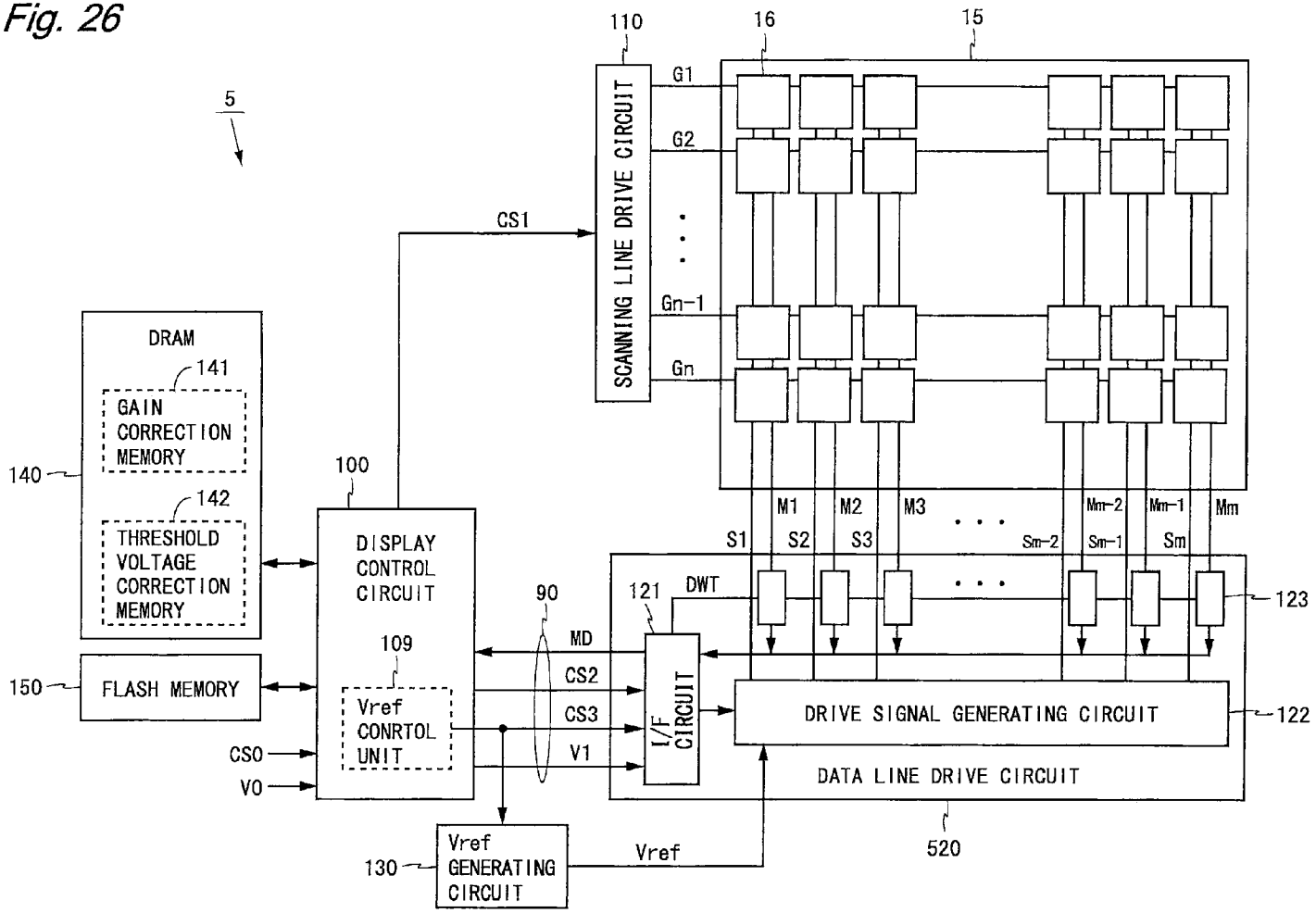
FIG. 26 is a block diagram showing a configuration of an organic EL display device according to a fifth embodiment of the present invention.

FIG. 26 is a block diagram showing a configuration of an organic EL display device according to a fifth embodiment of the present invention. An organic EL display device 5 shown in FIG. 26 includes a display unit 15, a display control circuit 100, a scanning line drive circuit 110, a data line drive circuit 520, a Vref generating circuit 130, a DRAM 140, and a flash memory 150.

In the organic EL display device 5, the display control circuit 100 outputs a control signal CS3 to the data line drive circuit 520 using a communication bus 90, and outputs the control signal CS3 to the Vref generating circuit 130. The Vref generating circuit 130 generates a reference voltage Vref based on the control signal CS3, and supplies the generated reference voltage Vref to the data line drive circuit 520. When the light-emission threshold voltage of an organic EL element L1 is Vth_L1, the reference voltage Vref is determined so as to satisfy the following equation (30):

$$Vref<ELVSS+Vth_L1 \quad (30)$$

Figure 27:
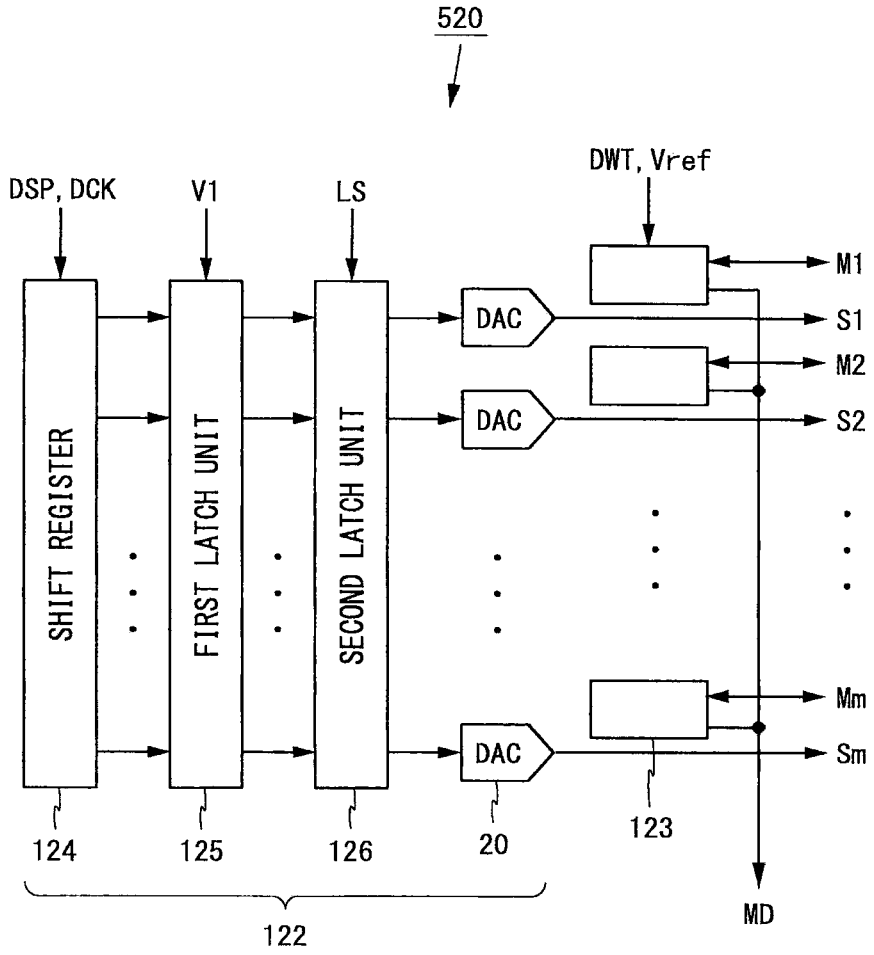
FIG. 27 is a block diagram showing details of a data line drive circuit shown in FIG. 26.

FIG. 27 is a block diagram showing details of the data line drive circuit 520. The data line drive circuit 520 includes an interface circuit 121 (not shown), a drive signal generating circuit 122, and m voltage output/current measurement circuits 123. The data line drive circuit 520 drives data lines S1 to Sm and detects drive currents having flowed through monitoring lines M1 to Mm from pixel circuits 16.

Each voltage output/current measurement circuit 123 is connected to any one of the monitoring lines M1 to Mm. When an input/output control signal DWT is at a high level, each voltage output/current measurement circuit 123 applies, to a corresponding monitoring line Mi, a reference voltage Vref supplied from the Vref generating circuit 130. When the input/output control signal DWT is at a low level, the voltage output/current measurement circuit 123 measures a drive current having flowed through the monitoring line Mi from a pixel circuit PX(i, j), and outputs measurement data MD representing the result of the measurement.

Figure 28:
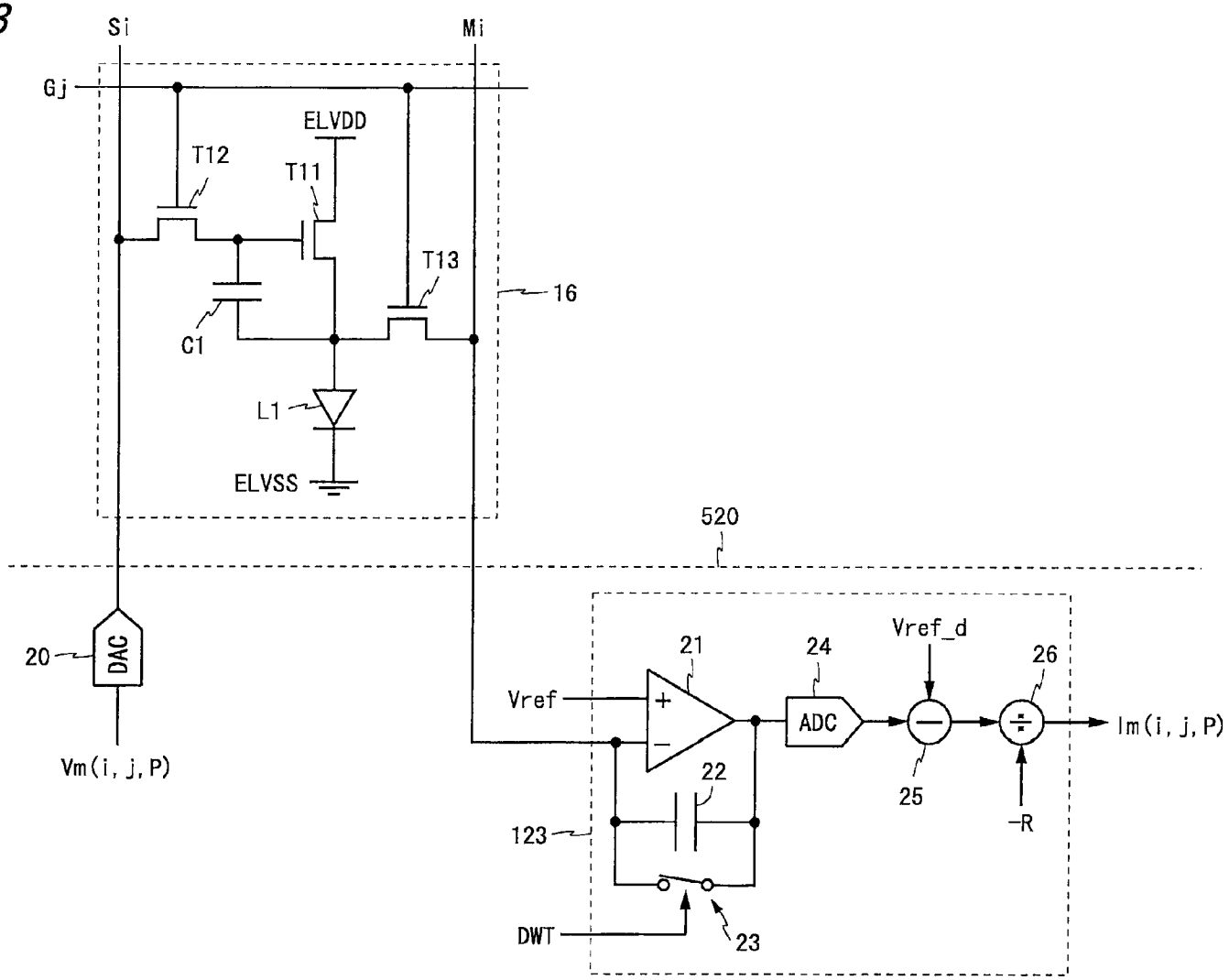
FIG. 28 is a circuit diagram of a pixel circuit and a voltage output/current measurement circuit which are included in the organic EL display device shown in FIG. 26.

FIG. 28 is a circuit diagram of the pixel circuit 16 and the voltage output/current measurement circuit 123. FIG. 28 depicts a pixel circuit PX(i, j), a D/A converter 20 provided for a data line Si, and a voltage output/current measurement circuit 123 provided for a monitoring line Mi.

The voltage output/current measurement circuit 123 is connected in a different manner than in the first and fourth embodiments. In the present embodiment, an inverting input terminal of an operational amplifier 21 is connected to the monitoring line Mi, and a reference voltage Vref is provided to a non-inverting input terminal of the operational amplifier 21. The data line drive circuit 520 obtains reference voltage data Vref_d representing the value of the reference voltage Vref, based on the control signal CS3. A digital value Vref_d is provided to one terminal of a subtractor 25. The subtractor 25 subtracts the digital value Vref_d from a digital value outputted from an A/D converter 24.

When the input/output control signal DWT is at a high level, a switch 23 is turned on. At this time, the operational amplifier 21 functions as a buffer amplifier, and provides the reference voltage Vref to the monitoring line Mi at a low output impedance. When the input/output control signal DWT is at a low level, the switch 23 is turned off and the operational amplifier 21 and a capacitor 22 function as an integrating amplifier. An output from a divider 26 at this time is Im(i, j, P) representing the value of a drive current passing through a transistor T11 and flowing through the monitoring line Mi.

The pixel circuit 16 and the data line drive circuit 520 operate at the same timing as in the first and fourth embodiments (see FIGS. 6, 7, and 10). The input/output control signal DWT and scanning signals G1 to Gn change at the timing shown in FIG. 6. During a video signal period (FIG. 7), since the input/output control signal DWT is always at the high level, the voltage output/current measurement circuit 123 provides the reference voltage Vref to the monitoring line Mi. During a program period A1, a scanning signal Gj becomes the high level and a voltage Vm(i, j, P) is applied to the data line Si. Hence, during the program period A1, transistors T12 and T13 are turned on and a capacitor C1 is charged to a voltage {Vm(i, j, P)−Vref}. When the program period A1 ends and the scanning signal Gj becomes the low level, the transistors T12 and T13 are turned off and the voltage {Vm(i, j, P)−Vref} is held in the capacitor C1. Thereafter, an organic EL element L1 emits light at a luminance according to the voltage held in the capacitor C1.

During a vertical synchronization period (FIG. 10), the operational amplifier 21 functions as a buffer amplifier during the first to third program periods B1, B3, and B5, and the operational amplifier 21 and the capacitor 22 function as an integrating amplifier during the first and second measurement periods B2 and B4. During the first program period B1, a data voltage Vm(i, j, P1) corresponding to a first gradation value P1 is applied to the data line Si, the reference voltage Vref is applied to the monitoring line Mi, and the capacitor C1 is charged to a voltage {Vm(i, j, P1)−Vref}. During the first measurement period B2, a drive current having passed through the transistor T11 flows through the monitoring line Mi. The voltage output/current measurement circuit 123 measures the drive current having flowed through the monitoring line Mi from the pixel circuit PX(i, j), and outputs first measurement data Im(i, j, P1) representing the value of the drive current. During the second and third program periods B3 and B5, a process similar to that for the first program period B1 is performed, and during the second measurement period B4, a process similar to that for the first measurement period B2 is performed.

As in the first embodiment, the display control circuit 100 performs the correction process shown in FIG. 12. A Vref control unit 109 determines a statistical value (e.g., mean value VM) of the threshold voltages of the drive transistors T11 based on data stored in a threshold voltage correction memory 142, and controls the reference voltage Vref based on the determined statistical value. In the organic EL display device 5, too, by controlling the reference voltage Vref, similar effects as those in the first embodiment can be obtained.

As shown above, in the organic EL display device 5 according to the present embodiment, the pixel circuit 16 includes an electro-optical element (organic EL element L1); and a drive transistor T11 provided in series with the electro-optical element. Upon current detection (first and second measurement periods B2 and B4), the data line drive circuit 520 provides, between the control terminal (gate terminal) and first conduction terminal (source terminal) of the drive transistor T11, a voltage (voltages {Vm(i, j, P1)−Vref} and {Vm(i, j, P2)−Vref}) which is according to a detection voltage (first and second measurement voltages Vm(i, j, P1) and Vm(i, j, P2)) and to a reference voltage Vref, and detects a drive current (first and second drive currents Im(i, j, P1) and Im(i, j, P2)) having passed through the drive transistor T11 and outputted external to the pixel circuit 16. The display control circuit 100 controls the reference voltage Vref. Therefore, according to the organic EL display device 5 according to the present embodiment, by suitably controlling the reference voltage Vref, even when the threshold voltage of the drive transistor T11 is changed, a change in the amount of drive current flowing through the drive transistor T11 is suppressed, enabling to detect the drive current with a high accuracy. In addition, upon current detection, a change in the end-to-end voltage of the electro-optical element is suppressed to prevent an unwanted current from flowing through the electro-optical element. By this, the drive current can be detected with a high accuracy.

In addition, the display unit 15 includes a plurality of monitoring lines M1 to Mm, and upon current detection, the data line drive circuit 520 provides a detection voltage to a data line Si and provides the reference voltage Vref to a monitoring line Mi, and detects a drive current having flowed through the monitoring line Mi from the pixel circuit 16. Therefore, in the display device having the monitoring lines M1 to Mm separately from the data lines S1 to Sm, by suitably controlling the reference voltage Vref by providing a detection voltage to the data line Si and providing the reference voltage Vref to the monitoring line Mi, a drive current flowing through the monitoring line Mi can be detected with a high accuracy.

In addition, the pixel circuit 16 further includes an input transistor T12 provided between the data line Si and the control terminal of the drive transistor T11 and having a control terminal (gate terminal) connected to a scanning line Gj; an output transistor T13 provided between the monitoring line Mi and the first conduction terminal of the drive transistor T11 and having a control terminal (gate terminal) connected to the scanning line Gj; and a capacitive element C1 provided between the control terminal and first conduction terminal of the drive transistor. Therefore, by controlling the reference voltage Vref in the pixel circuit 16 that has the capacitive element C1 between the control terminal and first conduction terminal of the drive transistor T11 and that is used by applying a voltage on the data line Si and the reference voltage Vref to both ends of the capacitive element C1, respectively, the drive current can be detected with a high accuracy.

Note that although in the above description the display units 10 and 13 include the pixel circuits 11 (FIG. 5) and the display unit 15 includes the pixel circuits 16 (FIG. 25), the display units of the organic EL display devices of the present invention may include other pixel circuits. For example, the display unit may include (m×n) pixel circuits shown below, together with n light-emission control lines E1 to En.

Figure 29:
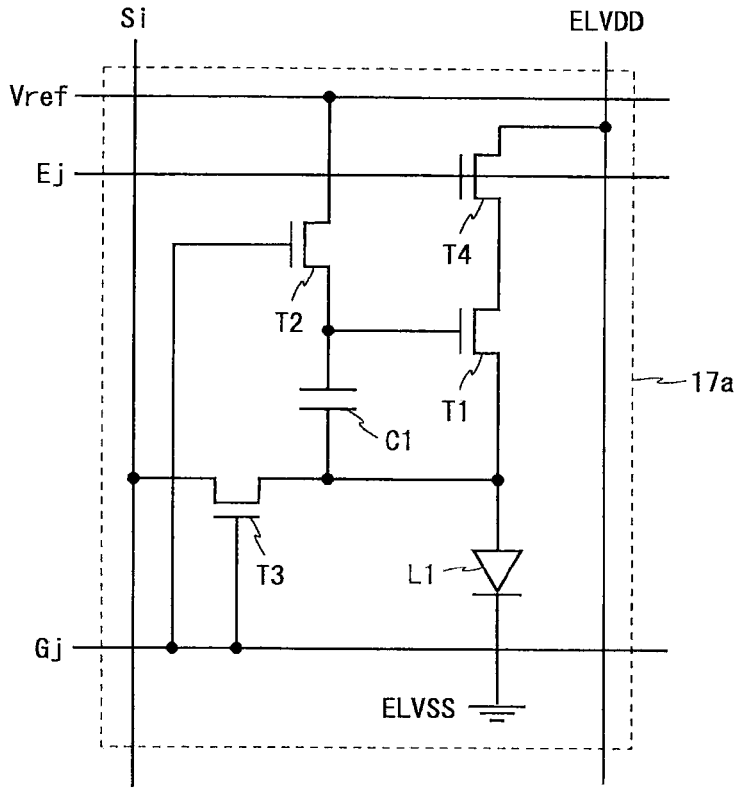
FIG. 29 is a circuit diagram of a pixel circuit included in an organic EL display device according to a variant of the embodiments of the present invention.
Figure 30:
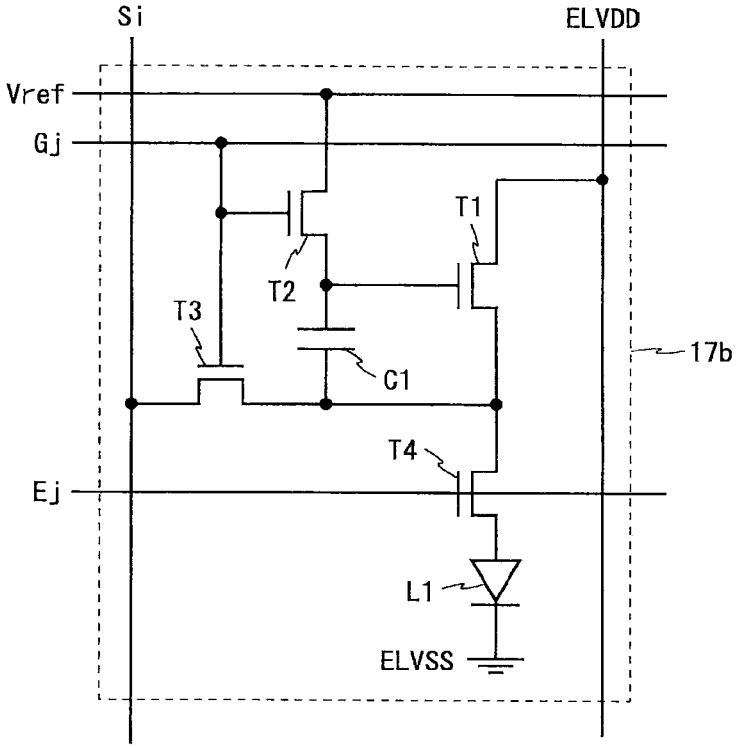
FIG. 30 is a circuit diagram of a pixel circuit included in an organic EL display device according to a variant of the embodiments of the present invention.

Pixel circuits 17*a* and 17*b* shown in FIGS. 29 and 30 are such that an n-channel transistor T4 is added to the pixel circuit 11. In the pixel circuit 17*a*, a drain terminal of the transistor T4 is connected to a high-level power supply line, a source terminal of the transistor T4 is connected to a drain terminal of a transistor T1, and a gate terminal of the transistor T4 is connected to a light-emission control line Ej. In the pixel circuit 17*b*, a drain terminal of the transistor T4 is connected to a source terminal of a transistor T1, a source terminal of the transistor T4 is connected to an anode terminal of an organic EL element L1, and a gate terminal of the transistor T4 is connected to a light-emission control line Ej.

Figure 31:
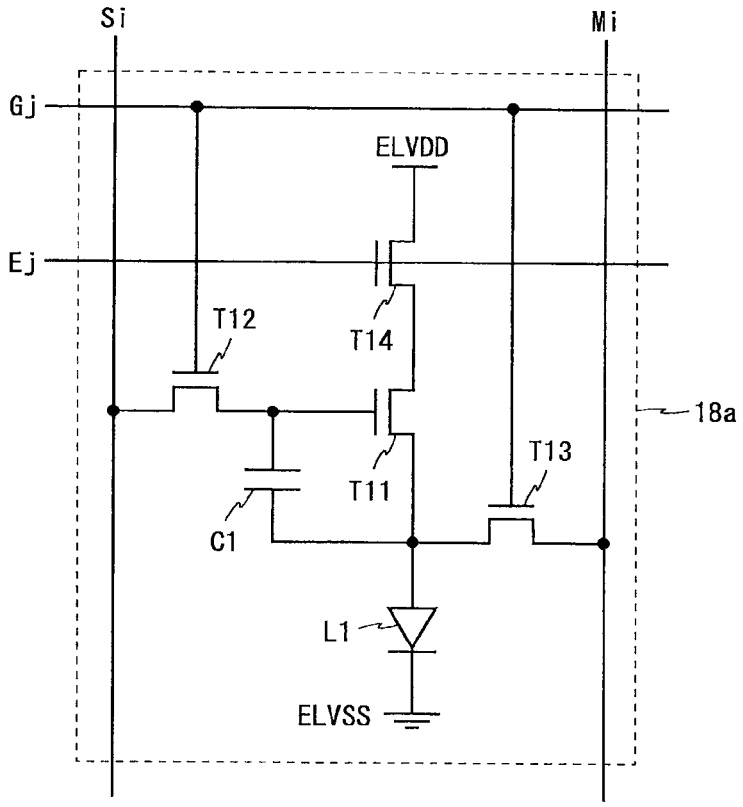
FIG. 31 is a circuit diagram of a pixel circuit included in an organic EL display device according to a variant of the embodiments of the present invention.
Figure 32:
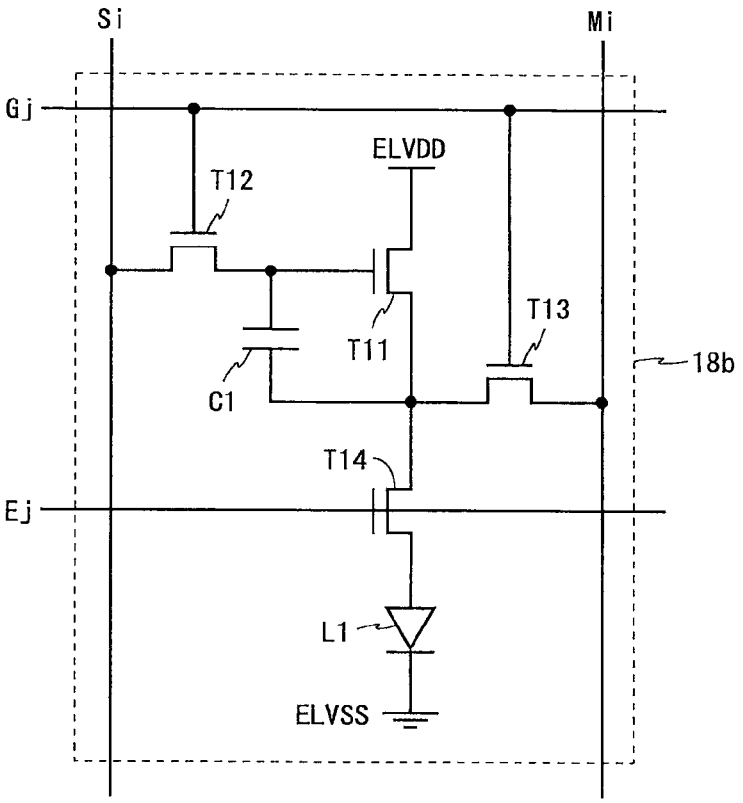
FIG. 32 is a circuit diagram of a pixel circuit included in an organic EL display device according to a variant of the embodiments of the present invention.
Figure 33:
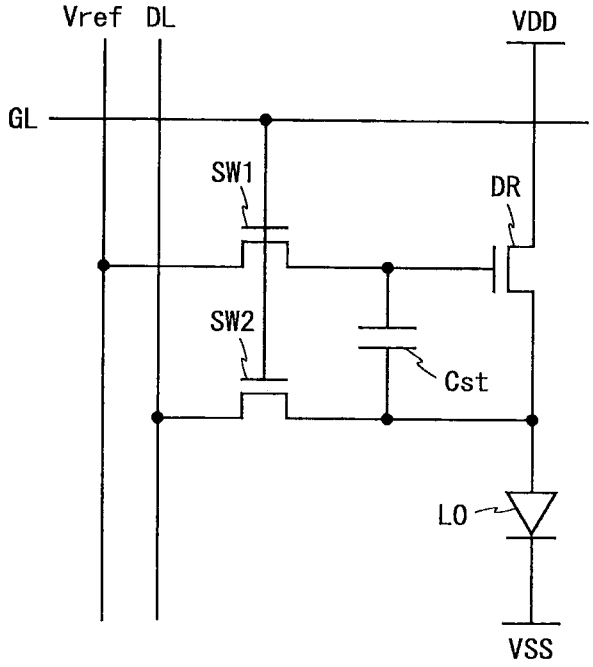
FIG. 33 is a circuit diagram of a pixel circuit included in a conventional organic EL display device.

Pixel circuits 18*a* and 18*b* shown in FIGS. 31 and 32 are such that an n-channel transistor T14 is added to the pixel circuit 16. In the pixel circuit 18*a*, a drain terminal of the transistor T14 is connected to a high-level power supply line, a source terminal of the transistor T14 is connected to a drain terminal of a transistor T11, and a gate terminal of the transistor T14 is connected to a light-emission control line Ej. In the pixel circuit 18*b*, a drain terminal of the transistor T14 is connected to a source terminal of a transistor T11, a source terminal of the transistor T14 is connected to an anode terminal of an organic EL element L1, and a gate terminal of the transistor T14 is connected to a light-emission control line Ej.

During a light emission period of the organic EL element L1, a signal on the light-emission control line Ej is controlled to a high level and the transistors T4 and T14 are turned on. During a non-light emission period of the organic EL element L1, the signal on the light-emission control line Ej is controlled to a low level and the transistors T4 and T14 are turned off. As such, the pixel circuits 17*a*, 17*b*, 18*a*, and 18*b* include the light-emission control transistor T4 (or T14) provided in series with an electro-optical element (organic EL element L1) and the drive transistor T1 (or T11), and having a control terminal (gate terminal) connected to the light-emission control line Ej. According to an organic EL display device having pixel circuits each including a light-emission control transistor, by controlling the light-emission control transistor to prevent an unwanted current from flowing through an electro-optical element, the drive current can be detected with a high accuracy.

An oxide semiconductor layer included in an oxide TFT will be described below. The oxide semiconductor layer is, for example, an In—Ga—Zn—O based semiconductor layer. The oxide semiconductor layer includes, for example, an In—Ga—Zn—O based semiconductor. The In—Ga—Zn—O based semiconductor is a ternary oxide of In (indium), Ga (gallium), and Zn (zinc). The proportions (composition ratio) of In, Ga, and Zn are not particularly limited and may be, for example, In:Ga:Zn=2:2:1, In:Ga:Zn=1:1:1, or In:Ga:Zn=1:1:2.

A TFT having an In—Ga—Zn—O based semiconductor layer has high mobility (higher by a factor of 20 or more compared to an amorphous silicon TFT) and low leakage current (less than 1/100 compared to an amorphous silicon TFT), and thus is suitably used as a drive TFT and a switching TFT in a pixel circuit. By using a TFT having an In—Ga—Zn—O based semiconductor layer, the power consumption of a display device can be significantly reduced.

The In—Ga—Zn—O based semiconductor may be amorphous, or may include a crystalline region and have crystallinity. For a crystalline In—Ga—Zn—O based semiconductor, a crystalline In—Ga—Zn—O based semiconductor in which the c-axis is aligned roughly vertically to a layer surface is preferred. A crystal structure of such an In—Ga—Zn—O based semiconductor is disclosed in, for example, Japanese Laid-Open Patent Publication No. 2012-134475.

Instead of an In—Ga—Zn—O based semiconductor, the oxide semiconductor layer may include other oxide semiconductors. For example, the oxide semiconductor layer may include a Zn—O based semiconductor (ZnO), an In—Zn—O based semiconductor (IZO (registered trademark)), a Zn—Ti—O based semiconductor (ZTO), a Cd—Ge—O based semiconductor, a Cd—Pb—O based semiconductor, CdO (cadmium oxide), an Mg—Zn—O based semiconductor, an In—Sn—Zn—O based semiconductor (e.g., $In_2O_3$—$SnO_2$—ZnO), an In—Ga—Sn—O based semiconductor, or the like.

As described above, according to the display devices of the present invention, when a voltage which is according to a detection voltage and a reference voltage is provided between the control terminal and first conduction terminal of a drive transistor, and a drive current having passed through the drive transistor and outputted external to a pixel circuit is detected, by controlling the reference voltage, even when a threshold voltage of the drive transistor is changed, the drive current can be detected with a high accuracy.

INDUSTRIAL APPLICABILITY

The display devices of the present invention have a feature that even when a threshold voltage of a drive transistor is changed, a drive current can be detected with a high accuracy. Thus, the display devices can be used as various types of active matrix-type display devices having pixel circuits each including an electro-optical element, such as organic EL display devices.

DESCRIPTION OF REFERENCE CHARACTERS

L1: ORGANIC EL ELEMENT
T1 to T4, T11 to T14, and 31 to 37: TRANSISTOR
C1, 22, and 38 to 39: CAPACITOR
1 to 5: ORGANIC EL DISPLAY DEVICE
10, 13, and 15: DISPLAY UNIT
11 and 16 to 18: PIXEL CIRCUIT
12: DISPLAY PANEL
14: CHARACTERISTIC DETECTION TRANSISTOR
21 and 30: OPERATIONAL AMPLIFIER
23: SWITCH
100, 200, and 300: DISPLAY CONTROL CIRCUIT
109, 209, and 309: Vref CONTROL UNIT
110 and 210: SCANNING LINE DRIVE CIRCUIT
120, 220, 224, 320, 420, and 520: DATA LINE DRIVE CIRCUIT
123: VOLTAGE OUTPUT/CURRENT MEASUREMENT CIRCUIT
130: Vref GENERATING CIRCUIT
142: THRESHOLD VOLTAGE CORRECTION MEMORY
208: LIGHTING TIME MEASURING UNIT
223: DETECTION/CORRECTION OUTPUT CIRCUIT
321: CHARACTERISTIC DETECTION CIRCUIT

The invention claimed is:

1. An active matrix-type display device comprising:

a display unit including a plurality of scanning lines, a plurality of data lines, a plurality of pixel circuits provided at respective intersections of the scanning lines and the data lines, and reference voltage lines configured to supply a reference voltage to the pixel circuits;

a scanning line drive circuit configured to drive the scanning lines;

a data line drive circuit configured to drive the data lines; and a display control circuit, wherein each of the pixel circuits includes an electro-optical element, a drive transistor provided in series with the electro-optical element, a reference voltage application transistor provided between a corresponding reference voltage line and the control terminal of the drive transistor, and having a control terminal connected to a corresponding scanning line, an input/output transistor provided between a corresponding data line and the first conduction terminal of the drive transistor, and having a control terminal connected to the scanning line, and a capacitive element provided between the control terminal and first conduction terminal of the drive transistor, upon current detection, the data line drive circuit is configured to provide a detection voltage to each of the data lines to provide a voltage between the control terminal and the first conduction terminal of the drive transistor, and detect a drive current having passed through the drive transistor and having flowed through the data line from the pixel circuit, the voltage being according to the detection voltage and the reference voltage, the display control circuit is configured to control the reference voltage, in a program period in which a data voltage is written to the pixel circuit, the reference voltage is supplied to the control terminal of the drive transistor through the reference voltage application transistor and the data voltage is supplied to the first conduction terminal of the drive transistor through the data line and the input/output transistor, the data line drive circuit includes a voltage output/current measurement circuit including:

an operational amplifier having an inverting input terminal connected to the data line, and a non-inverting input terminal to which the data voltage is provided;

a capacitor provided between the inverting input terminal and an output terminal of the operational amplifier; and a switch provided between the inverting input terminal and the output terminal of the operational amplifier in parallel to the capacitor, and configured to turn on and off in accordance with an input/output control signal, in the program period, the input/output control signal is at a first level, the switch is turned on, the output terminal and the inverting input terminal of the operational amplifier are short-circuited, and the operational amplifier functions as a buffer amplifier for providing the data voltage to the data line at a low output impedance, and in a measurement period in which the drive current having passed through the drive transistor is measured, the input/output control signal is at a second level, the switch is turned off, the output terminal and the inverting input terminal of the operational amplifier are connected to each other through the capacitor, and the operational amplifier and the capacitor function as an integrating amplifier.

2. The display device according to claim 1, further comprising a storage unit configured to store, for each of the pixel circuits, data according to a threshold voltage of the drive transistor, wherein the display control circuit is configured to control the reference voltage based on the data stored in the storage unit.

3. The display device according to claim 2, wherein the display control circuit is configured to determine a statistical value of the threshold voltages of the drive transistors based on the data stored in the storage unit, and control the reference voltage based on the determined statistical value.

4. The display device according to claim 3, wherein the storage unit is configured to store, for each of the pixel circuits, data representing a difference between the statistical value of the threshold voltages of the drive transistors and the reference voltage.

5. The display device according to claim 2, wherein the display control circuit is configured to update the data stored in the storage unit, based on results of the detection by the data line drive circuit.

6. The display device according to claim 5, wherein the display control circuit is configured to perform a correction process on video data, using the data stored in the storage unit, the correction process compensating for the threshold voltage and a gain of the drive transistor.

7. The display device according to claim 5, wherein the display control circuit is configured to perform a correction process on video data, using the data stored in the storage unit, the correction process compensating for the threshold voltage of the drive transistor.

8. The display device according to claim 1, wherein the display control circuit is configured to measure cumulative lighting time and control the reference voltage based on the measured cumulative lighting time.

9. The display device according to claim 1, wherein the display unit further includes a characteristic detection transistor, and the display control circuit is configured to control the reference voltage based on a characteristic of the characteristic detection transistor.

10. The display device according to claim 1, wherein the scanning lines are divided into one or more blocks, for each block, the scanning line drive circuit is configured to select all or some of scanning lines in the block collectively during a first period, and select all of the scanning lines in the block in turn during a second period, and for each block, the data line drive circuit is configured to convert drive currents outputted external to corresponding pixel circuits into voltages during the first period, and apply voltages to the data lines during the second period, the voltages being based on voltages according to video data and on the voltages obtained during the first period.

11. The display device according to claim 1, wherein the drive transistors are thin film transistors in which a semiconductor layer is formed of an oxide semiconductor.

12. The display device according to claim 11, wherein the oxide semiconductor is indium gallium zinc oxide.

13. The display device according to claim 12, wherein the indium gallium zinc oxide has crystallinity.

14. The display device according to claim 1, wherein in the measurement period, the reference voltage is supplied to the control terminal of the drive transistor through the reference voltage application transistor and the detection voltage is supplied to the first conduction terminal of the drive transistor through the data line and the input/output transistor.

15. The display device according to claim 14, wherein a first program period, a first measurement period, a second program period, and a second measurement period are sequentially provided as the program period and the measurement period, and a second gradation value corresponding to a second measurement voltage used in the second measurement period is larger than a first gradation value corresponding to a first measurement voltage used in the first measurement period.

16. The display device according to claim 1, wherein the reference voltage is common to all of the drive transistors.

17. A drive current detection method for an active matrix-type display device having a display unit including a plurality of scanning lines, a plurality of data lines, and a plurality of pixel circuits provided at respective intersections of the scanning lines and the data lines, and reference voltage lines configured to supply a reference voltage to the pixel circuits, when each of the pixel circuits includes an electro-optical element, a drive transistor provided in series with the electro-optical element, a reference voltage application transistor provided between a corresponding reference voltage line and the control terminal of the drive transistor, and having a control terminal connected to a corresponding scanning line, an input/output transistor provided between a corresponding data line and the first conduction terminal of the drive transistor, and having a control terminal connected to the scanning line, and a capacitive element provided between the control terminal and first conduction terminal of the drive transistor, the method comprising the steps of:

providing a detection voltage to each of the data lines to provide a voltage between the control terminal and the first conduction terminal of the drive transistor by driving a corresponding scanning line and a corresponding data line, the voltage being according to the detection voltage and the reference voltage;

detecting a drive current having passed through the drive transistor and having flowed through the data line from the pixel circuit; and controlling the reference voltage, wherein in a program period in which a data voltage is written to the pixel circuit, the reference voltage is supplied to the control terminal of the drive transistor through the reference voltage application transistor and the data voltage is supplied to the first conduction terminal of the drive transistor through the data line and the input/output transistor, in providing the detection voltage and in detecting the drive current, a data line drive circuit including a voltage output/current measurement circuit is used, the voltage output/current measurement circuit including:

an operational amplifier having an inverting input terminal connected to the data line, and a non-inverting input terminal to which the data voltage is provided;

a capacitor provided between the inverting input terminal and an output terminal of the operational amplifier; and a switch provided between the inverting input terminal and the output terminal of the operational amplifier in parallel to the capacitor, and configured to turn on and off in accordance with an input/output control signal, in the program period, the input/output control signal is at a first level, the switch is turned on, the output terminal and the inverting input terminal of the operational amplifier are short-circuited, and the operational amplifier functions as a buffer amplifier for providing the data voltage to the data line at a low output impedance, and in a measurement period in which the drive current having passed through the drive transistor is measured, the input/output control signal is at a second level, the switch is turned off, the output terminal and the inverting input terminal of the operational amplifier are connected to each other through the capacitor, and the operational amplifier and the capacitor function as an integrating amplifier.

* * * * *